US005460216A

United States Patent [19]

Hirao et al.

[11] Patent Number: 5,460,216

[45] Date of Patent: Oct. 24, 1995

[54] DEVICE FOR MOVING A WINDING SHAFT IN A BUILDING SHUTTER

[75] Inventors: Masato Hirao; Yasunori Kobayashi; Noriaki Tokuyama; Masaaki Munekata; Mitsuhiro Yoshida; Yoshihiro Ohtsuka; Atsushi Matsumura; Hisaya Tagata; Tomoyuki Kinoshita, all of Tokyo, Japan

[73] Assignee: Sanwa Shutter Corporation, Tokyo, Japan

[21] Appl. No.: 102,389

[22] Filed: Aug. 5, 1993

[51] Int. Cl.[6] ..... E06B 9/08

[52] U.S. Cl. ..... 160/133; 160/23.1; 160/120; 160/191; 160/242

[58] Field of Search ..... 160/133, 242, 160/246, 247, 248, 249, 250, 251, 261, 262, 191, 192, 32, 23.1, 317, 1, 8, 9, 7, 120

[56] References Cited

U.S. PATENT DOCUMENTS

| | | | |
|---|---|---|---|
| 1,709,305 | 4/1929 | Brunst et al. | 160/7 |
| 1,797,321 | 3/1931 | Cahill | 160/242 |
| 1,825,198 | 9/1931 | Negrini | 160/242 |
| 2,842,198 | 7/1958 | Prieto | 160/133 X |
| 3,734,161 | 5/1973 | Pierce | 160/235 X |
| 3,853,166 | 12/1974 | Wrono | 160/133 |
| 4,197,896 | 4/1980 | Reichstadt | 160/133 X |
| 4,633,927 | 1/1987 | Labelle | 160/133 |
| 4,930,563 | 6/1990 | Finch et al. | 160/133 X |
| 5,070,925 | 12/1991 | Paule | 160/133 |
| 5,265,662 | 11/1993 | Hirao et al. | 160/133 |

FOREIGN PATENT DOCUMENTS

| | | |
|---|---|---|
| 2664937 | 1/1992 | France . |
| 59-12395 | 1/1984 | Japan . |
| 2-45293 | 3/1990 | Japan . |

*Primary Examiner*—David M. Purol
*Attorney, Agent, or Firm*—Oliff & Berridge

[57] ABSTRACT

A pair of links hangingly support a bearing plate that secures a winding shaft of a shutter curtain. The links are arranged so that the dimension of the space accommodating the links can be minimized. A first link pivots at one end to an end of the bearing plate, adjacent to a shutter guide, and swings at the base end to a side wall of the shutter case so as to project upward away from the shutter guide. A second link pivots at one end to the other end of the bearing plate, away from the shutter guide, and swings at the base end to a portion of the side wall of the shutter case so that the second link extends under the winding shaft toward the shutter guide to bypass the winding shaft. Thus, both the first and second links can be accommodated within the diameter of the winding wheel.

57 Claims, 49 Drawing Sheets

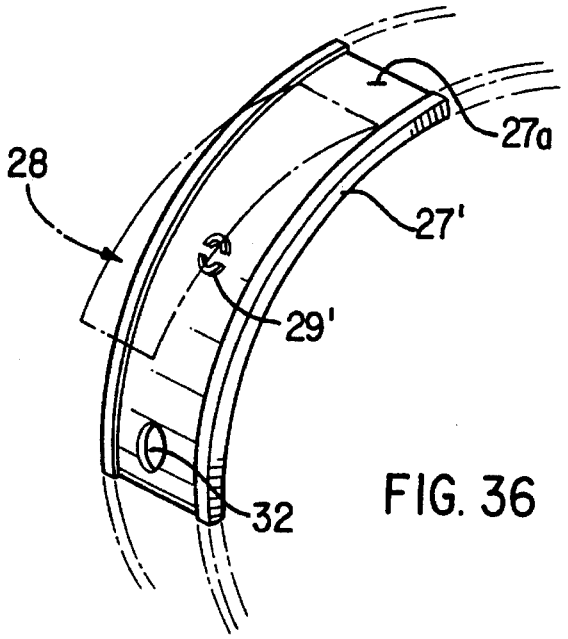
FIG. 36
FIG. 35
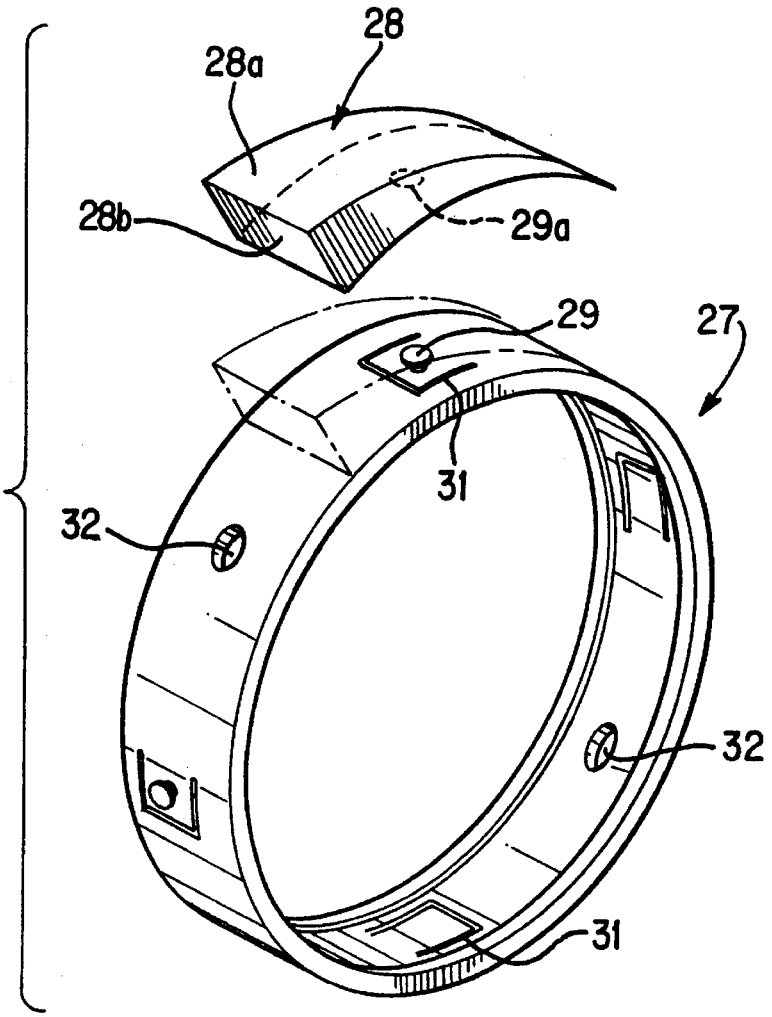

DEVICE FOR MOVING A WINDING SHAFT IN A BUILDING SHUTTER

BACKGROUND OF THE INVENTION

1. Field of the Invention

The present invention relates to a device for moving a winding shaft in a shutter used for a building. In particular, the winding shaft can be automatically moved in accordance with the winding diameter, which varies depending on the winding and unwinding of the shutter curtain.

2. Description of the Related Art

In general, the winding diameter of a winding shaft varies according to the winding and unwinding of the shutter curtain. Conventionally, since the winding shaft is attached to a case adjacent to the support, such as the building, the movement of pulling out the shutter curtain from the winding shaft to the shutter guide shifts as the winding diameter varies. In particular, when the shutter curtain approaches the closed state, in which the winding diameter becomes smaller, the shutter curtain abuts against the shutter guide. This impact produces a loud noise, damages the slats, peels off the paint, and accelerates the wear of sound-deadening members, for example. Accordingly, the shutter curtain becomes rusty, and its life is shortened.

To overcome the above drawbacks, the applicant of the present invention has disclosed a shutter in which the winding shaft moves in accordance with the winding diameter in Japanese Patent Application No. 63-124423 (Japanese Utility Model Laid-Open No. 2-45293.) Such a shutter is simply constructed with a bearing plate that pivots the winding shaft and is supported by a pair of links. With such a simple construction, according to the change of the winding diameter, a quick response can be made to move the winding shaft reliably. Thereby, the problems inherent in a conventional shaft secured to the support are solved. However, such a shutter is constructed with the pair of links 68 extending upward through the outer circumference of the winding wheel, as shown in FIG. 8. Thus, a space for arranging the links 68*a* and 68*b* must be ensured between the right and left ends of the winding wheel 4 and a side wall 2*b* secured to the support for swingably supporting the links 68. Thus, the dimension of the space accommodating the links 68 must be enlarged. This prevents the shutter case from being downsized, and therefore the resulting shutter case is not suitable in limited spaces.

SUMMARY OF THE INVENTION

Accordingly, in view of the foregoing background, an object of the present invention is to provide a device for moving a winding shaft in a building shutter, totally free from the above drawbacks.

To achieve the above and other objects, the present invention provides a device for moving a winding shaft in a building shutter having a link mechanism arranged at both ends along a front and rear dimension of a bearing plate integrally supporting the winding shaft. The link mechanism swings the bearing plate forward and backward and includes a first and second link. The first link is pivoted at one end to an end of the bearing plate, adjacent to a shutter guide. The other base end of the first link is swingably coupled to a portion of the case close to the support to project upward away from the shutter guide. A second link is pivoted at one end to the other end of the bearing plate, away from the shutter guide. The other base end of the second link is swingably coupled to a portion of the case close to the support so that the second link extends under the winding shaft toward the shutter guide to bypass the winding shaft.

Further, a protecting link intervenes between the base ends of both of the links. Stoppers are also arranged on the protecting link for controlling the swing range of the bearing plate.

According to the above construction of this invention, the winding shaft can be automatically moved according to the winding diameter of the shutter curtain. Also, the dimension of the space accommodating the links can be reduced as much as possible.

BRIEF DESCRIPTION OF THE DRAWINGS

FIG. 7 (B) is a partial front view in partial section of FIG. 7 (A);

FIG. 8 (B) is a partial front view in partial section of FIG. 8 (A);

FIG. 35 is an exploded perspective view of a protecting band;

FIG. 36 is a perspective view of a protecting band in another embodiment;

DETAILED DESCRIPTION OF PREFERRED EMBODIMENTS

Figure 1:
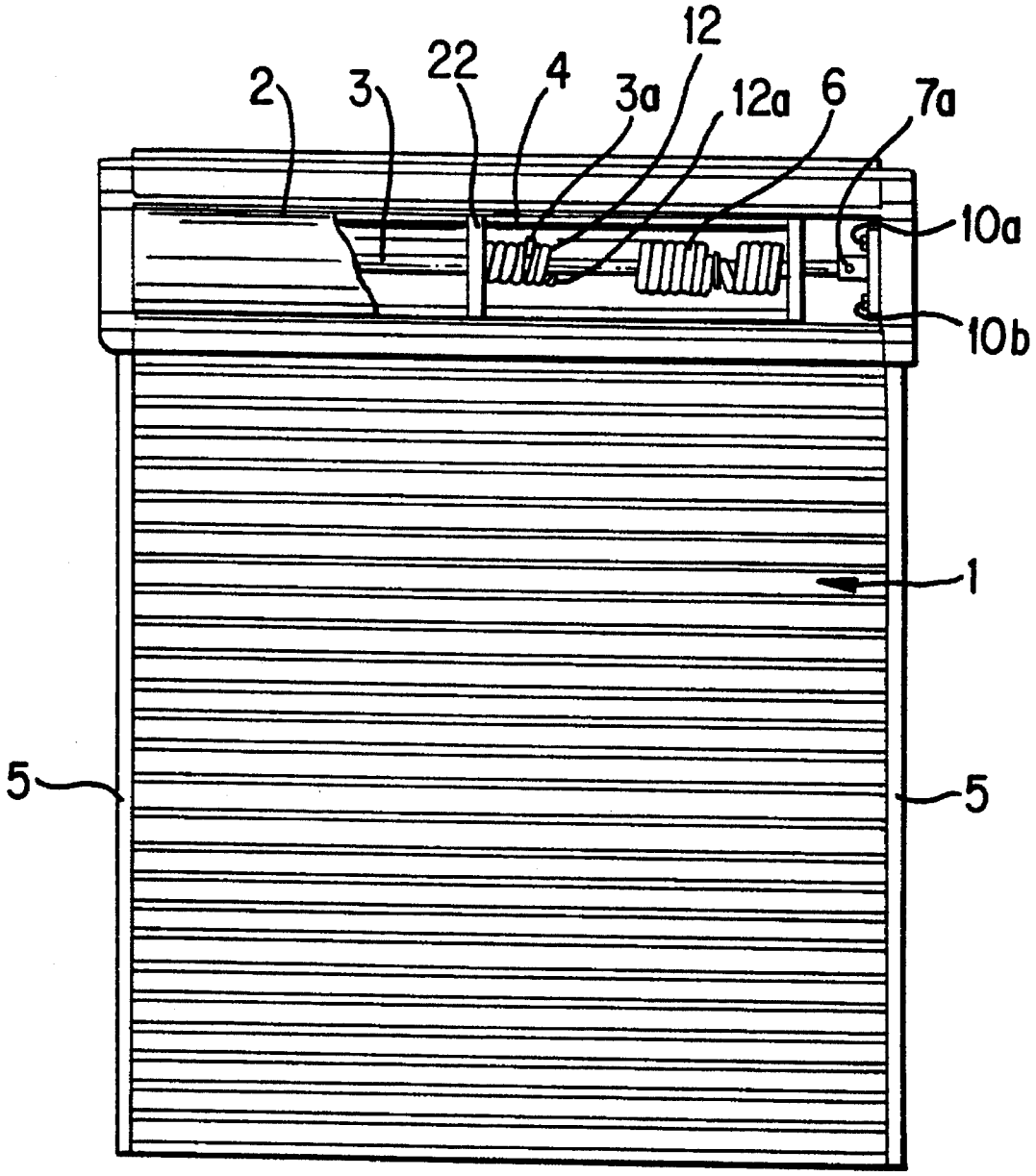
FIG. 1 is a schematic front view of a shutter assembly.

As seen in FIG. 1, a shutter includes a shutter curtain 1 for closing an opening portion of a building, a shutter case 2 arranged above the opening portion, and a winding shaft 3 fitted in the shutter case 2 such that the rotation of the winding shaft 3 is controlled. A winding drum 4 comprises a plurality of winding wheels 22 rotatably supported by the winding shaft 3. A balance spring 6 fits between the winding shaft 3 and the winding drum 4 for urging the shutter curtain 1 in the winding direction. The shutter curtain 1 winds on and off the winding drum 4, thereby ascending and descending, guided by guide rails arranged on both the right and left sides of the opening of the building.

The shutter curtain 1 is constructed and operated in a manner similar to a conventional shutter as discussed above. The shutter in this embodiment also includes a shutter guide 30, seen in FIG. 7A, which is arranged in the shutter case 2 for guiding the shutter curtain 1 pulled out from the winding drum 4 toward the guide rails 5.

Referring to FIGS. 1–7, the winding shaft 3 is adapted to be movable against a side plate 2*a* forming the shutter case 2. At each end of the winding shaft 3, a bearing 7*a* is formed at the center of a bearing plate 7 that is arranged at each side plate 2*a* to support the right and left ends of the winding shaft 3. A lead end of a first link 8*a* and a lead end of a second link 8*b* are swingably supported by one end of the bearing plate 7, and the base ends of each link 8*a* and 8*b* are pivotally supported by the respective side plate 2*a*.

Figure 7A:
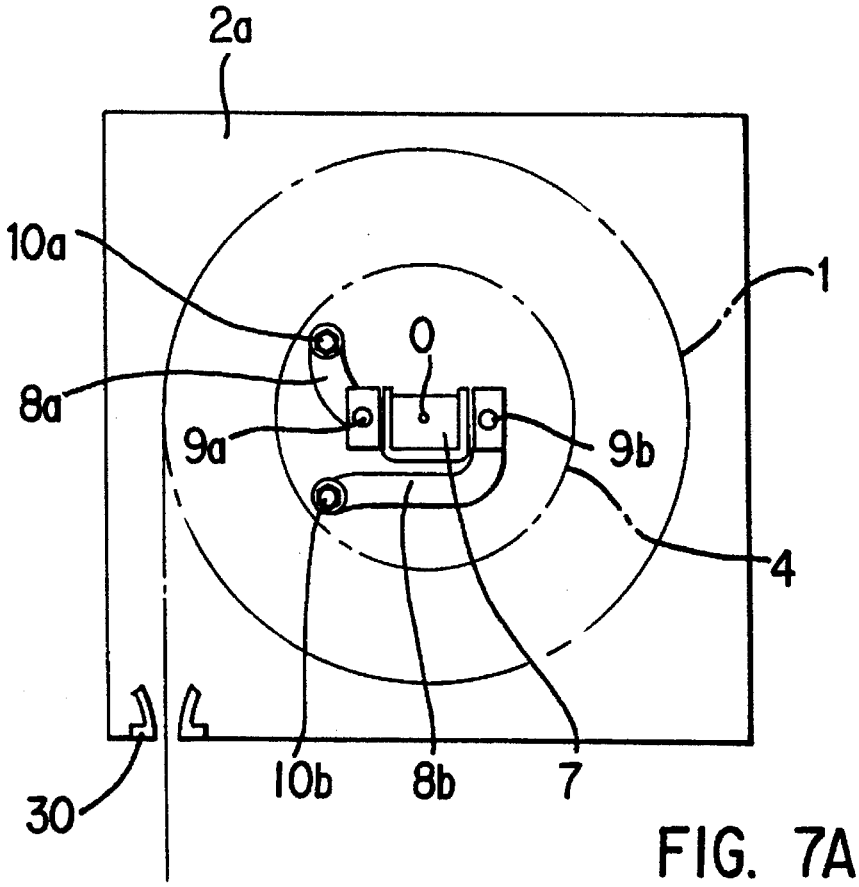
FIG. 7 (A) is a side view showing the links accommodated with a winding shaft.
Figure 7B:
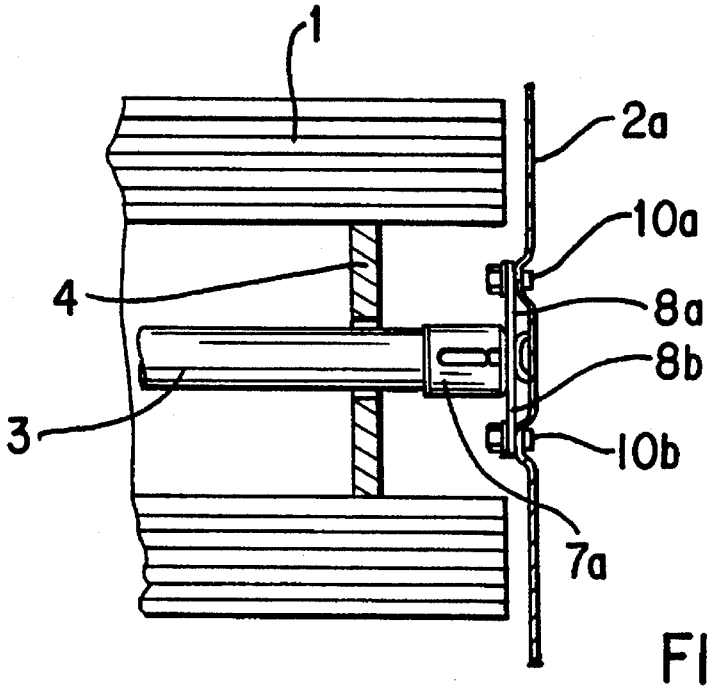
Figure 8A:
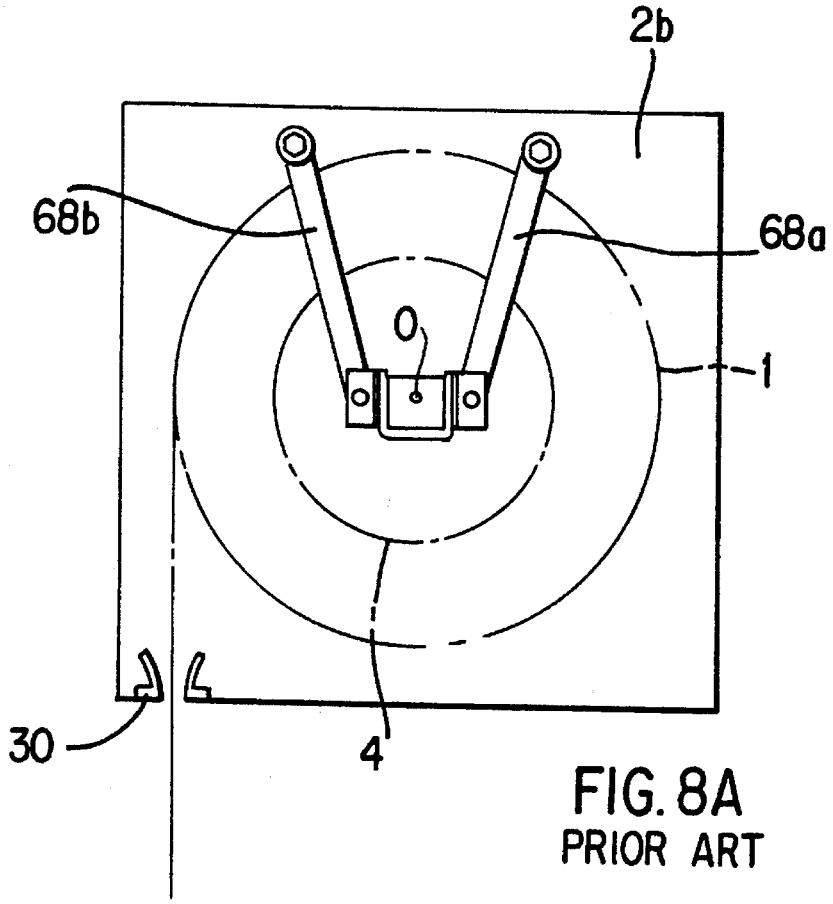
FIG. 8A PRIOR ART
FIG. 8 (A) is a side view showing conventional links accommodated with a winding shaft.
Figure 8B:
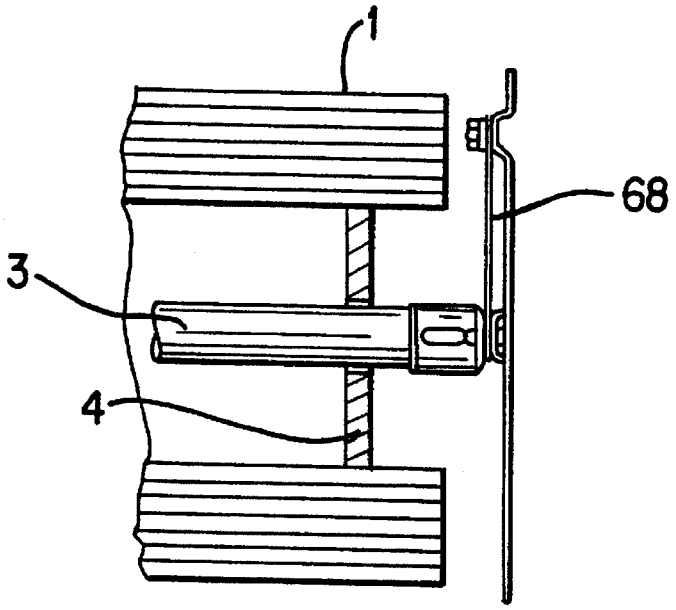
FIG. 8B PRIOR ART
Figure 9:
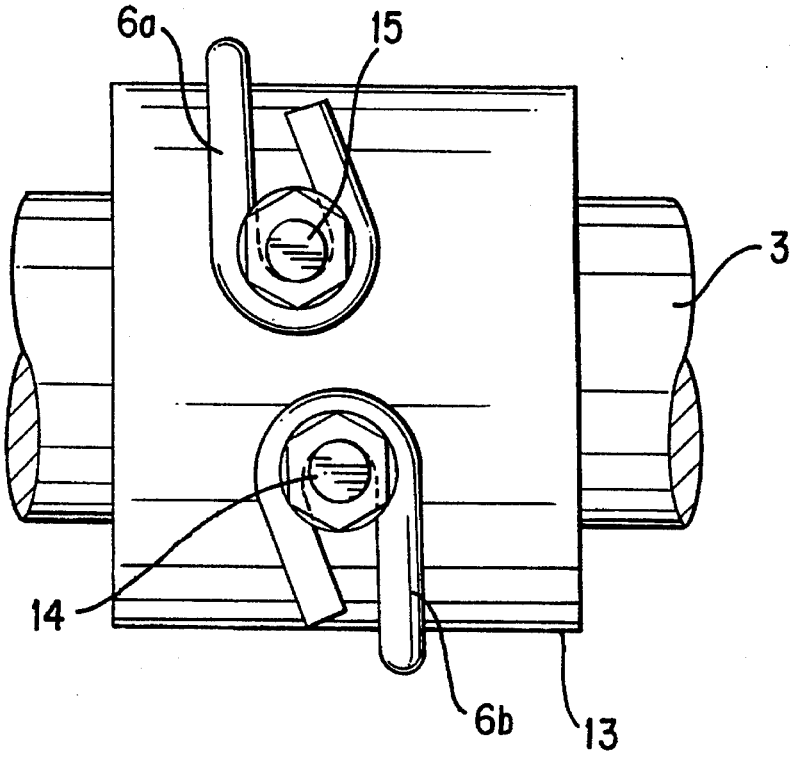
FIG. 9 is a plan view showing a connecting portion of balance springs.
Figure 10:
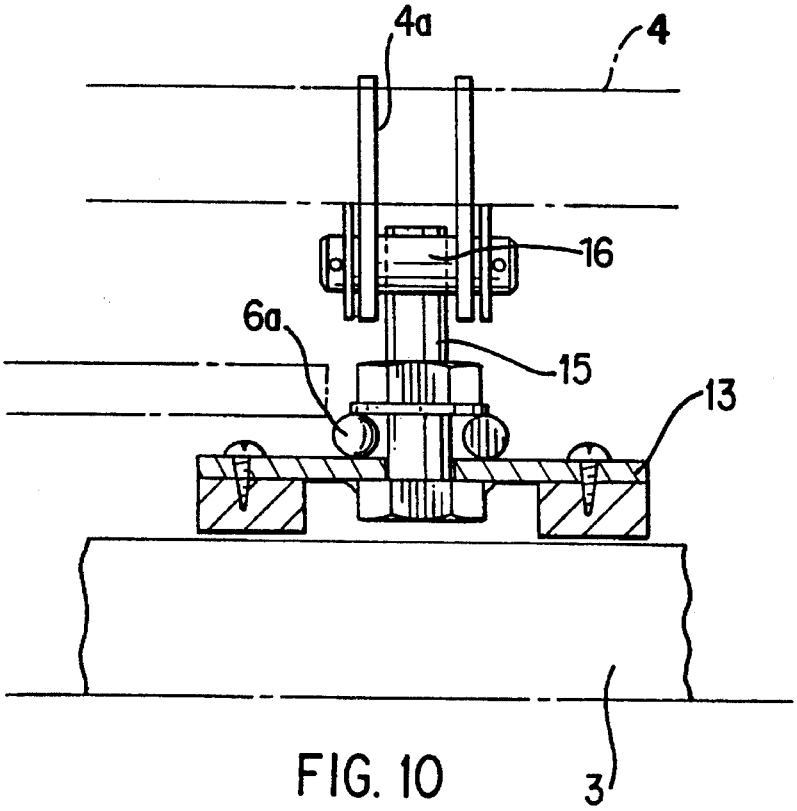
FIG. 10 is a front view of FIG. 9 in partial section.
Figure 11:
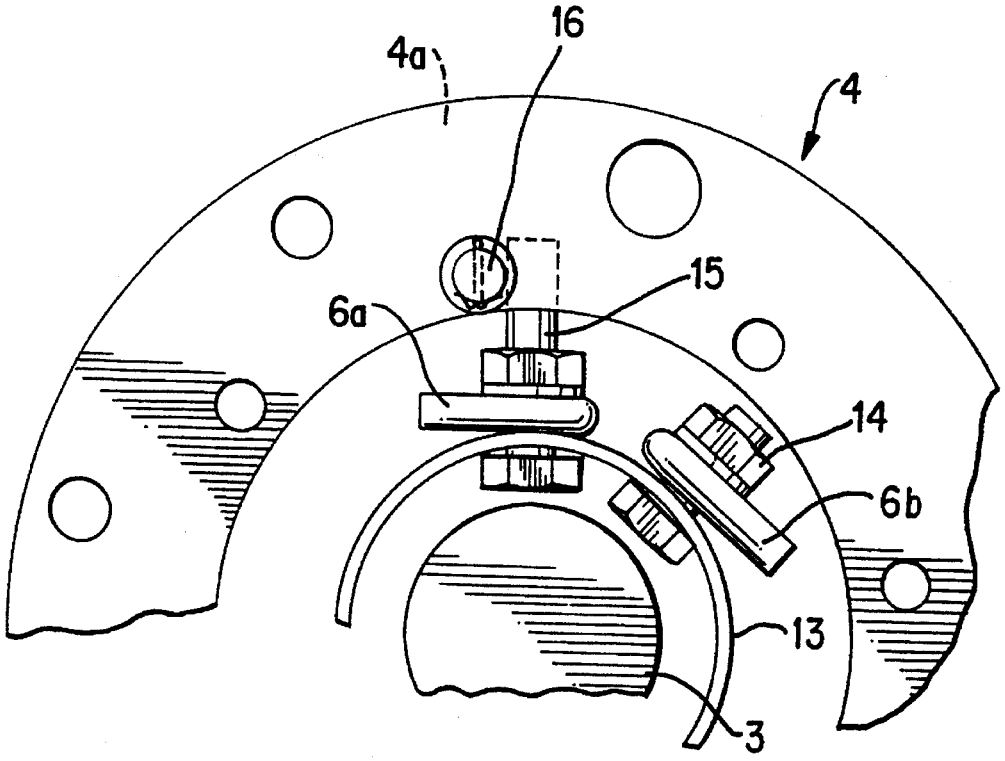
FIG. 11 is a partial side view of FIG. 9.

The first link 8*a* is swingably supported at its lead end by one end of the bearing plate 7 adjacent to the shutter guide 30 at pivot 9*a* as stated above and at its base end by the side plate 2*a* of the shutter case 2 via a pivot 10*a* so as to project upward away from the shutter guide 30. On the other hand, the second link 8*b* is swingably supported at its lead end by the other end of the bearing plate 7 away from the shutter guide 30 at pivot 9*b* as stated above and at its base end by the side plate 2*a* of the shutter case 2 via another pivot 10*b*. The second link 8*b* extends under the winding shaft 3 toward the shutter guide 30 to bypass the winding shaft 3, as shown in FIG. 7A. Further, a protecting link 11, seen in FIGS. 2–5, intervenes between the base ends of both links 8*a* and 8*b*, and first and second stoppers 11*a* and 11*b* are formed on the protecting link 11 to control the swing range of the bearing plate 7. The pivots 10*a* and 10*b* are positioned to be within the diameter of the winding wheels 22 rotatably supported by the winding shaft 3. A collar 10*c* fits around the pivots 10*a* and 10*b*, thereby allowing the relative swinging of the first and second links 8*a* and 8*b* against the protecting link 11 even though bolts forming the pivots are tightly screwed.

Figure 2:
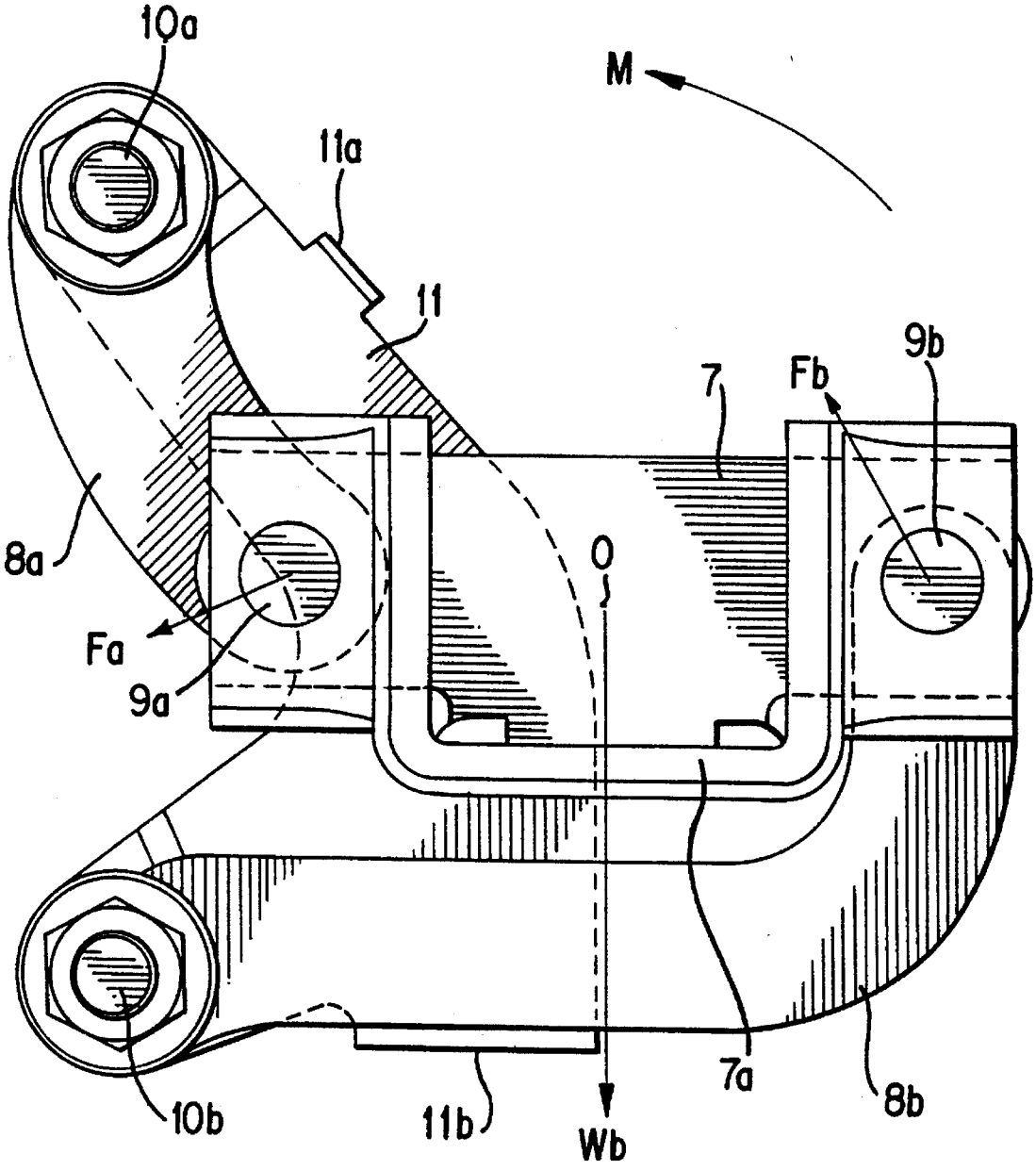
FIG. 2 is a side view of the links when the shutter curtain is fully opened.
Figure 3:
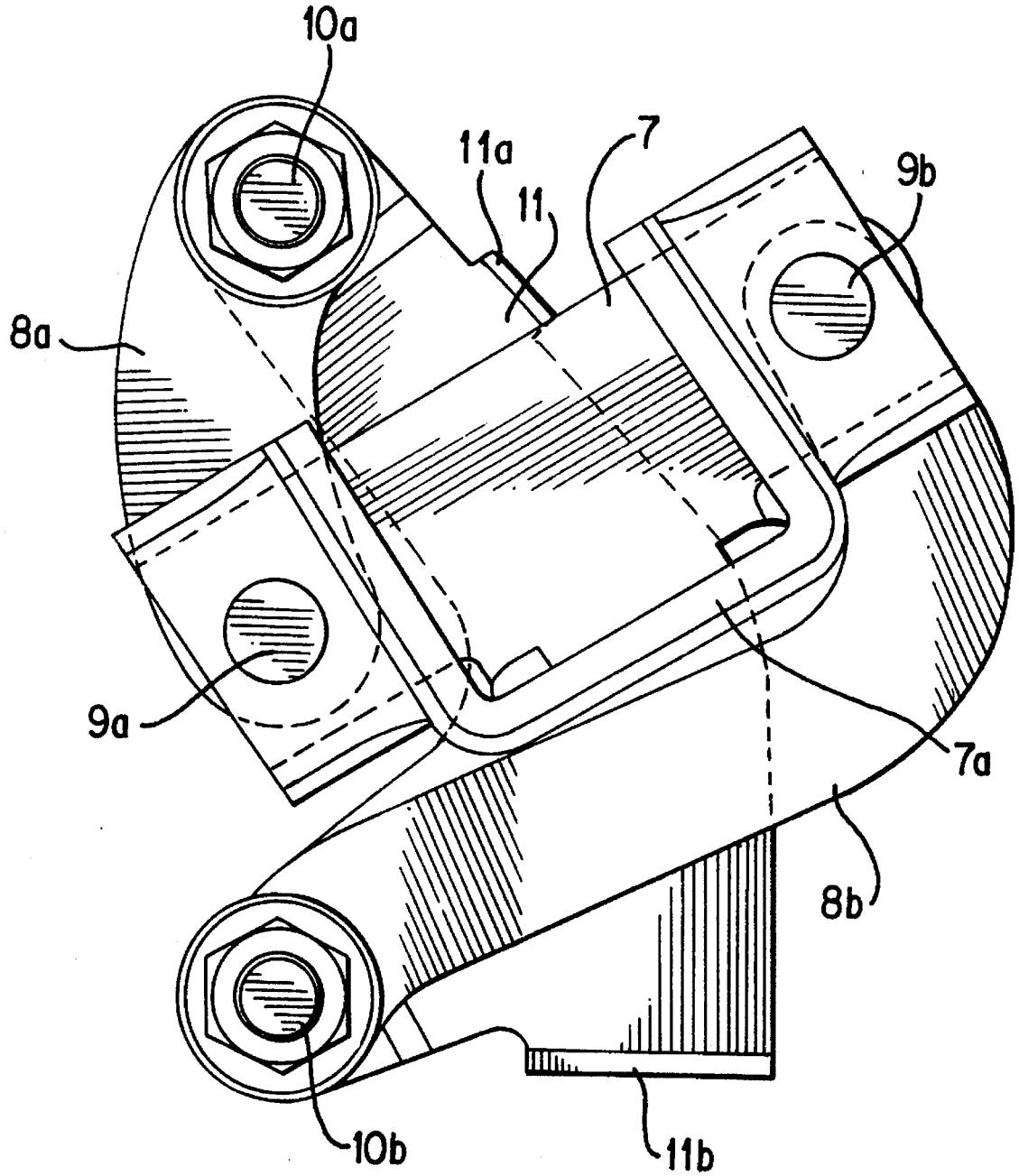
FIG. 3 is a side view of the links when the shutter curtain is fully closed.
Figure 4:
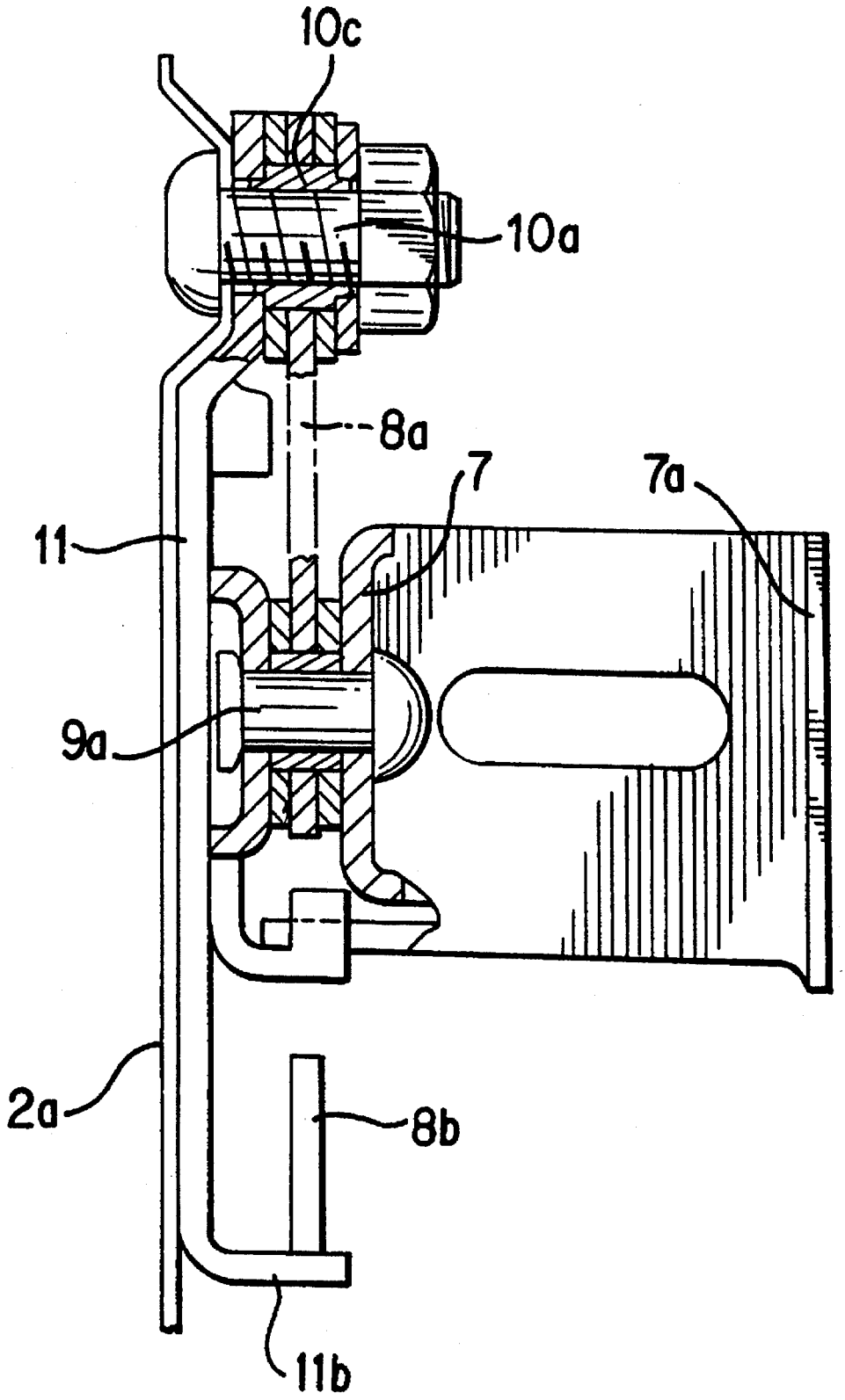
FIG. 4 is another side view in partial section of the links.
Figure 5:
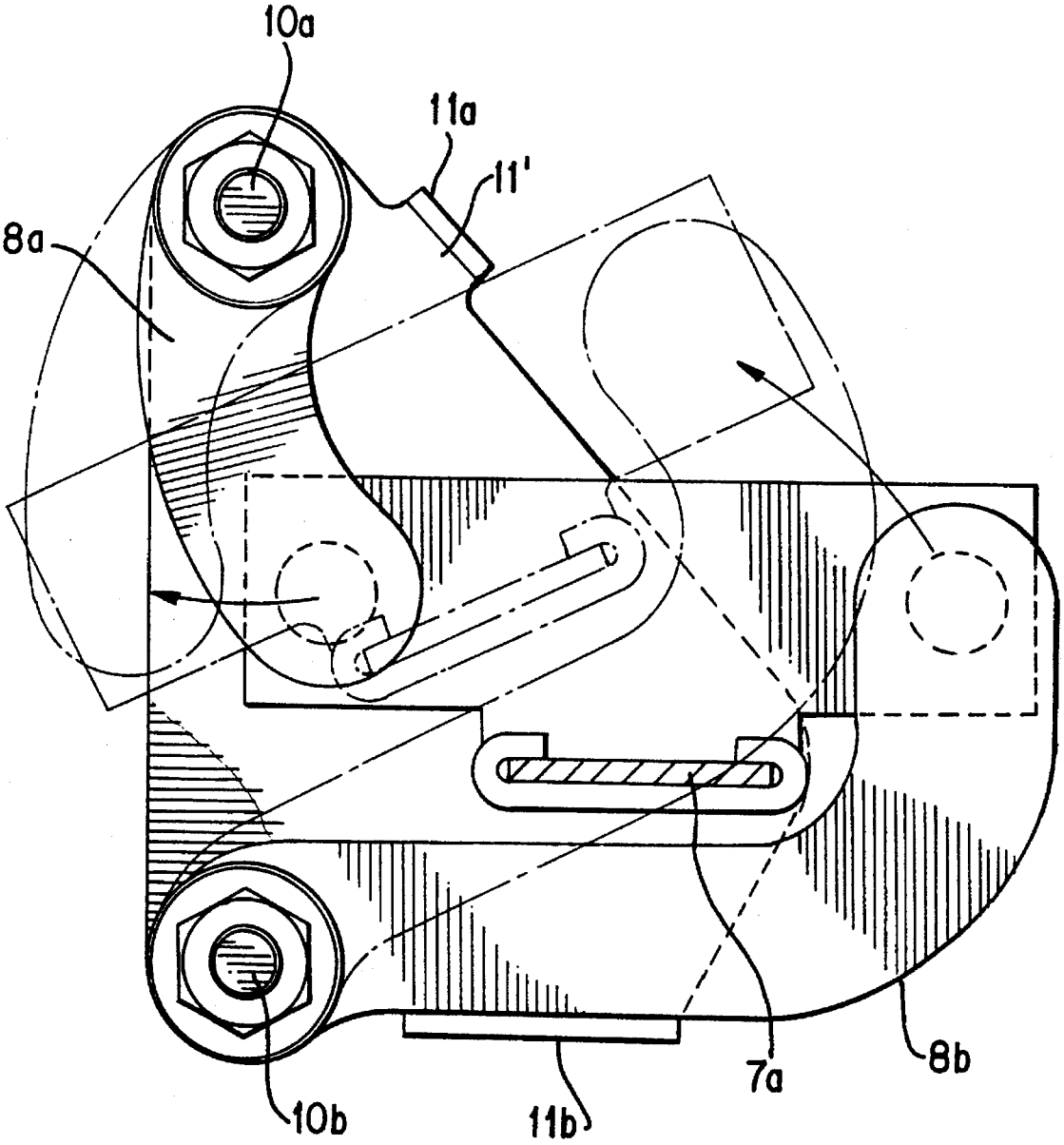
FIG. 5 is a side view of the links in another embodiment.

As illustrated by the links in FIG. 2, when the shutter curtain 1 is wound on the winding drum 4 to the maximum to fully open, a load Wb of the wound-on portion of the shutter curtain 1 is applied to the bearing plate 7 to force it downward, and the second link 8*b* abuts against the second stopper 11*b*. As the shutter curtain 1 is pulled out from the winding drum 4, the rotating moment M created by the weight of the pulled-out portion of the shutter curtain 1 is applied to both ends of the bearing plate 7. Then, the downward force Fa toward the shutter guide 30 is applied to the first link 8*a* at the center of the base end. Whereas, the upward force Fb away from the shutter guide 30 is applied to the second link 8*b* at the center of the base end. Thus, as illustrated in FIG. 3, when the shutter curtain 1 is pulled out to the maximum to close fully, the bearing plate 7 swings upward away from the shutter guide 30 until it abuts against the first stopper 11*a*. The protecting link may also be shaped as protecting link 11 as shown in FIG. 5.

Figure 6:
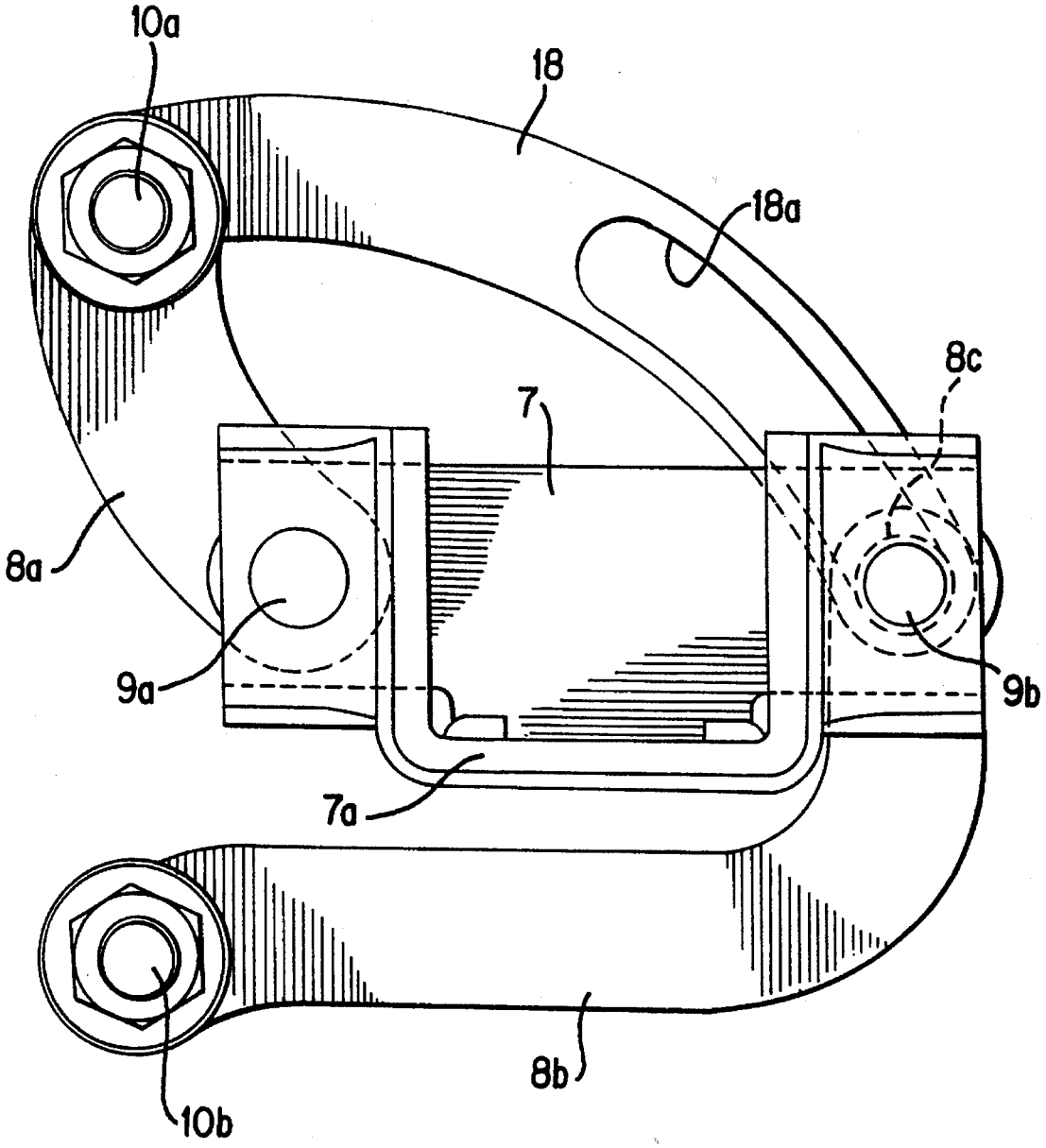
FIG. 6 is a side view of the links in another embodiment.

FIG. 6 illustrates another embodiment of a protecting link 18 having the following construction. The base end of the protecting link 18 is integrally supported by the pivot 10*a* of the first link 8*a*, and an elongated hole 18*a* is formed at the lead end of the protecting link 18. In this construction, a pin 8*c* at the lead end of the second link 8*b* is movably fit into the elongated hole 18*a*. Thus, the pin 8*c* moves within the elongated hole 18*a* according to the swinging of the second link 8*b* to abut against both ends of the elongated hole 18*a*, thereby controlling the swing range of the second link 8*b*.

Referring to FIGS. 1 and 9–13, the balance spring 6 is a split-type comprising first and second balance springs 6*a* and 6*b*. The spring 6 moves together with a buffer spring 12 urged in the direction opposite to the direction that the balance spring 6 is urged to closely follow the turning effect of the winding drum 4 produced by the weight of the shutter curtain 1 to considerably reduce the operation force of opening the shutter curtain 1. The buffer spring 12, shown in FIG. 1, is fixed at one end to the winding wheel 22 and is free at the other end, which has a hook 12*a* formed thereon. A projection 3*a* is formed on the winding shaft 3 and passes through the coil of the buffer spring 12. When the shutter curtain 1 is fully open, the projection 3*a* is positioned suitably in the coil. According to the rotation of the winding drum 4, the projection 3*a* advances toward the hook 12*a* through the coil until it is stopped by the hook 12*a* at the point where the shutter curtain 1 reaches a predetermined partially-open position $H_1$. The buffer spring 12 is arranged to be loaded as the winding drum 4 rotates to open the shutter curtain 1 fully.

As seen in FIGS. 9–13, the balance spring 6 includes the first balance spring 6*a* fixed at one end to the winding wheel 22 and integral at the other end with a retainer 13 via a fastener 14. The retainer 13 is freely rotatably supported by the winding shaft 3, and the second balance spring 6*b* is fixed at one end to the retainer 13 via another fastener 14 and at the other end to the winding shaft 3. An operating pin 15 projects from the retainer 13 toward the outer diameter of the winding drum 4 and has a top end movably loosely fit into a guide groove 4*a* in the inner periphery of the winding drum 4. A stopper pin 16 is arranged in the guide groove 4*a* to stop the operating pin 15. The position of the operating pin 15 stopped by the stopper pin 16 is determined as follows.

Figure 12:
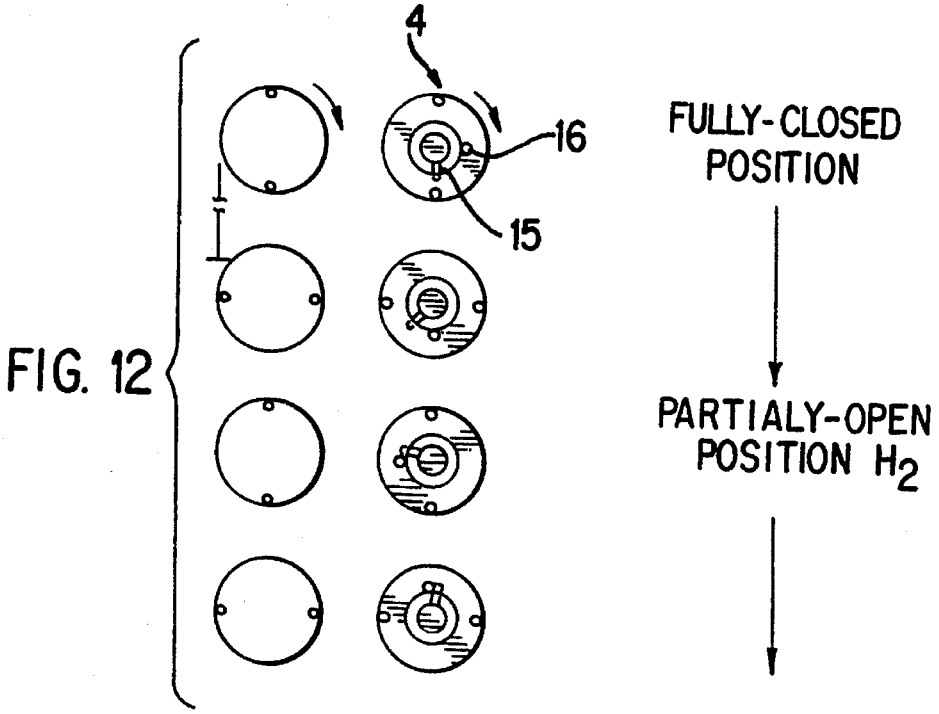
FIG. 12 shows the operation of the shutter.
Figure 13:
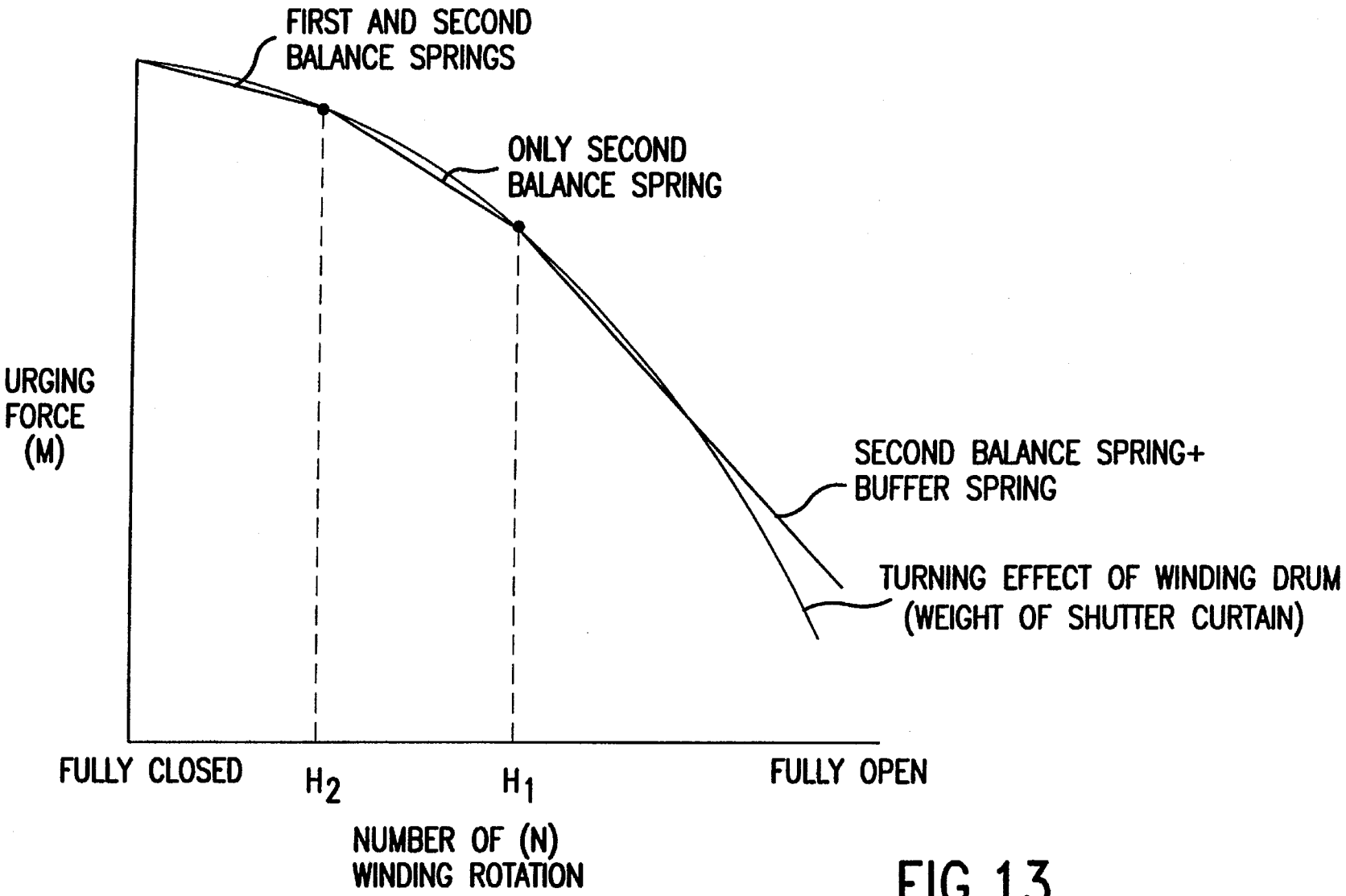
FIG. 13 is a graph indicating the relationship between the urging force and the weight of the pulled-out portion of the shutter curtain.
Figure 14:
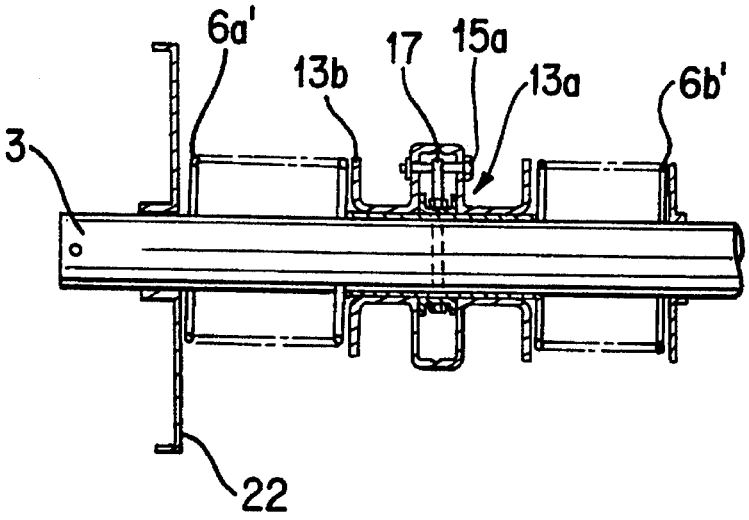
FIG. 14 is a front view in partial section of the balance springs in another embodiment.
Figure 15:
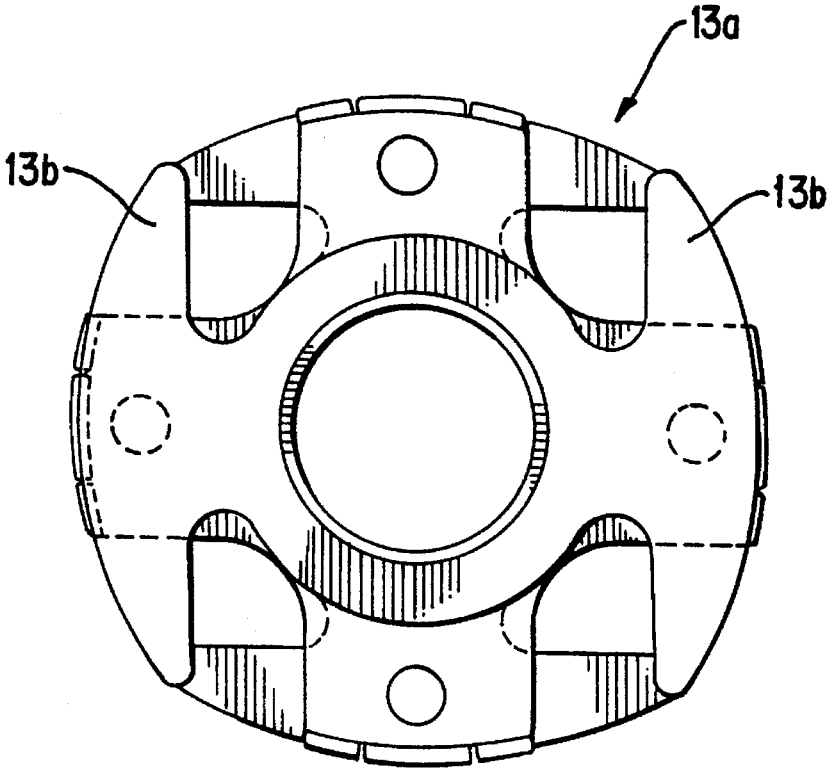
FIG. 15 is a side view of a retainer of FIG. 14.
Figure 16:
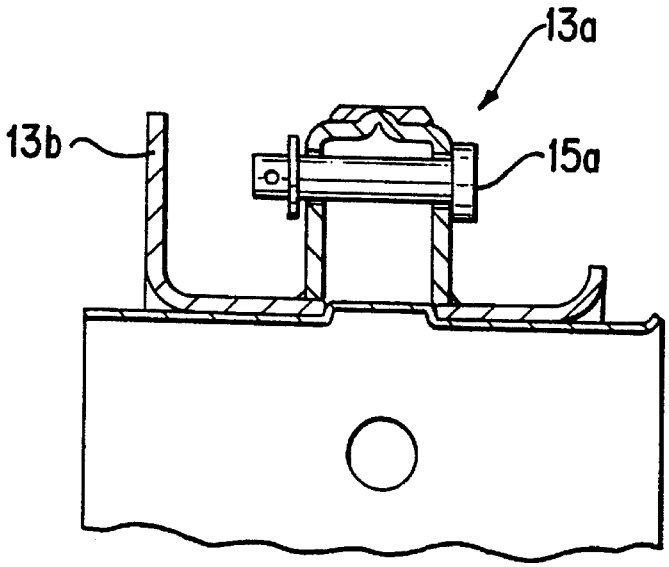
FIG. 16 is a partial sectional view of the retainer of FIG. 14.
Figure 17:
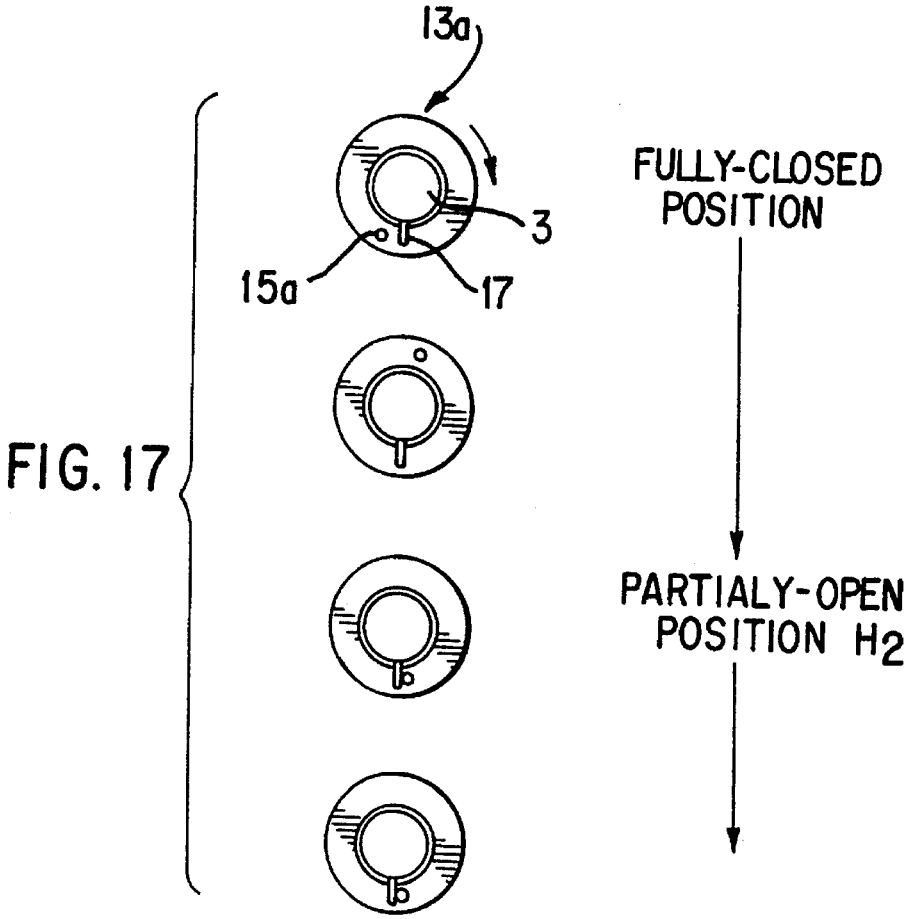
FIG. 17 shows the operation of a shutter of FIG. 14.

More specifically referring to FIGS. 12 and 13, when the shutter curtain 1 is fully closed, the operating pin 15 and the stopper pin 16 do not abut against each other, thus loading the first and second balance springs 6*a* and 6*b* equally. The winding drum 4 is then rotated to raise the shutter curtain 1 allowing the first and second balance springs 6*a* and 6*b* to urge the winding drum 4 in the direction in which the shutter curtain 1 is wound based on the loading force. At this time, the operating pin 15 formed in the retainer 13 rotates relative to the winding drum 4 due to the restoring force of the torsion of the first and second springs 6*a* and 6*b*. Thus, the pin 15 approaches the stopper pin 16. The operating pin 15 is adapted to abut against the stopper pin 16 at the partially-open position $H_2$, lower than the foregoing partially-open position $H_1$. When the operating pin 15 is stopped by the stopper pin 16, the restoring force of the torsion of the first balance spring 6*a*, which is fixed to the winding wheel 22, is controlled. Thus, the winding drum 4 is urged only by the loading force of the second balance spring 6*b* for further operation.

On the other hand, when the shutter curtain 1 is fully open, the second balance spring 6*b* urges the winding drum 4 in the winding direction, while the buffer spring 12 urges the winding drum 4 in the balancing direction. When the winding drum 4 is rotated to lower the shutter curtain 1, the second balance spring 6*b* is loaded by urging the winding drum 4. The buffer spring 12 restores the winding drum 4 by urging it in the rewinding direction. When the shutter curtain 1 reaches the partially-open position $H_1$, the buffer spring 12 disengages from the projection 3*a*. For further operation, only the second spring 6*b* urges the winding drum 4. When the shutter curtain 1 is further lowered to reach the partially-open position $H_2$, the loading force of the first balance spring 6*a*, which is controlled to be restored, conforms with the loading force of the second spring 6*b*. Whereby, in a position lower than the partially-open position $H_2$, the operating pin 15 disengages from the stopper pin 16, and the first and second balance springs 6*a* and 6*b* are loaded by urging the winding drum 4 in the winding direction.

Thus, the above balance spring 6 operates as follows. When the shutter curtain 1 is wound on the winding drum 4, for example, in a range from the full-closing position to the partially-open position $H_2$, the torsion of the first and second balance springs 6*a* and 6*b* connected in series is restored by a half turn per one rotation of the winding drum 4 (where the first and second balance springs 6*a* and 6*b* have the same length.) Consequently, the urging force is gradually decreased, as illustrated in FIG. 13. In a range from the partially-open position $H_2$ to the partially-open position $H_1$ of the shutter curtain 1, since the torsion of the second balance spring 6*b* is restored by one turn per one rotation of the winding drum 4, the urging force is sharply decreased. Further, in a range from the partially-open position $H_1$ to the full-opening position of the shutter curtain 1, since the urging force of the second balance spring 6*b* is balanced by the buffer spring 12, the overall urging force is decreased even more sharply. Thus, the overall urging force is adapted to follow, as close as possible, the turning effect of the winding drum 4, which changes in three stages in an opening and closing range of the shutter curtain 1 for adjustment of the turning effect as indicated by a curve shown in FIG. 13. The curve of FIG. 13 diagrammatically illustrates the load of the pulled-out portion of the shutter curtain 1.

The balance spring 6 may be modified as follows as shown in the embodiment of FIGS. 14–17. A stopper pin 17 integrally projects from the winding shaft 3, and an operating pin 15*a* is arranged on a retainer 13*a*. Further, a retaining claw 13*b* for retaining the first and second balance springs 6*a*' and 6*b*' is formed in the retainer 13*a*. In the fully-opened state of the shutter curtain 1, the second balance spring 6*b*, urges the winding drum 4 in the winding direction, whereas the buffer spring 12 urges the winding drum 4 in the balancing direction. In this state, the winding drum 4 is rotated to lower the shutter curtain 1. The second balance spring 6*b* is loaded by urging the winding drum 4 in the winding direction, while the buffer spring 12 restores the winding drum 4 by urging it in the unwinding direction. When the shutter curtain 1 reaches the partially-open position $H_1$, the buffer spring 12 disengages from the projection 13*a*. For further operation, only the second balance spring 6*b* urges the winding drum 4. When the shutter curtain 1 is further lowered so as to reach the partially-open position $H_2$, the loading force of the first balance spring 6*a*' the restoration of which is controlled, conforms with the loading force of the second balance spring 6*b*'. In a lowering position in excess of the partially-open position $H_2$, the operating pin 15 disengages from the stopper pin 17 and the first and second balance springs 6*a*' and 6*b*' are loaded by urging the winding drum 4 in the winding direction.

Both balance spring arrangements enable a well-balanced light opening operation of the shutter curtain 1. The balance spring arrangement of FIGS. 14–17 is superior to the arrangement of FIGS. 9–13 in the following respects. The stopper pin 17 can be arranged on the winding shaft 3, thus having intrinsically greater strength, whereas the stopper pin in the first embodiment is arranged on the weaker winding drum 4. Thus, a winding drum for general purpose can be used for the former balance spring without upgrading the strength thereof. Further, the operation of fitting the balance springs 6*a*' and 6*b*' is simplified by the retaining claw 13*b*.

Figure 18:
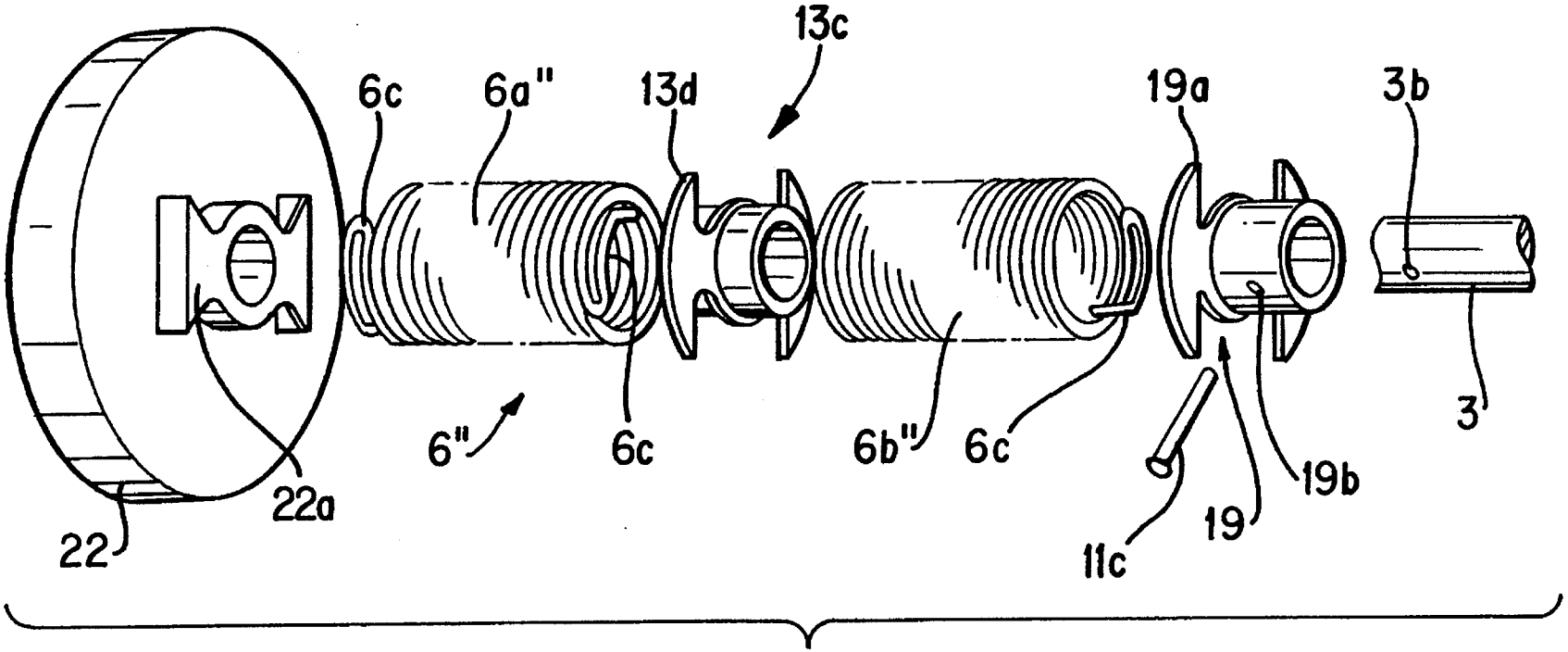
FIG. 18 is an exploded perspective view of a balance spring assembly in another embodiment.
Figure 19:
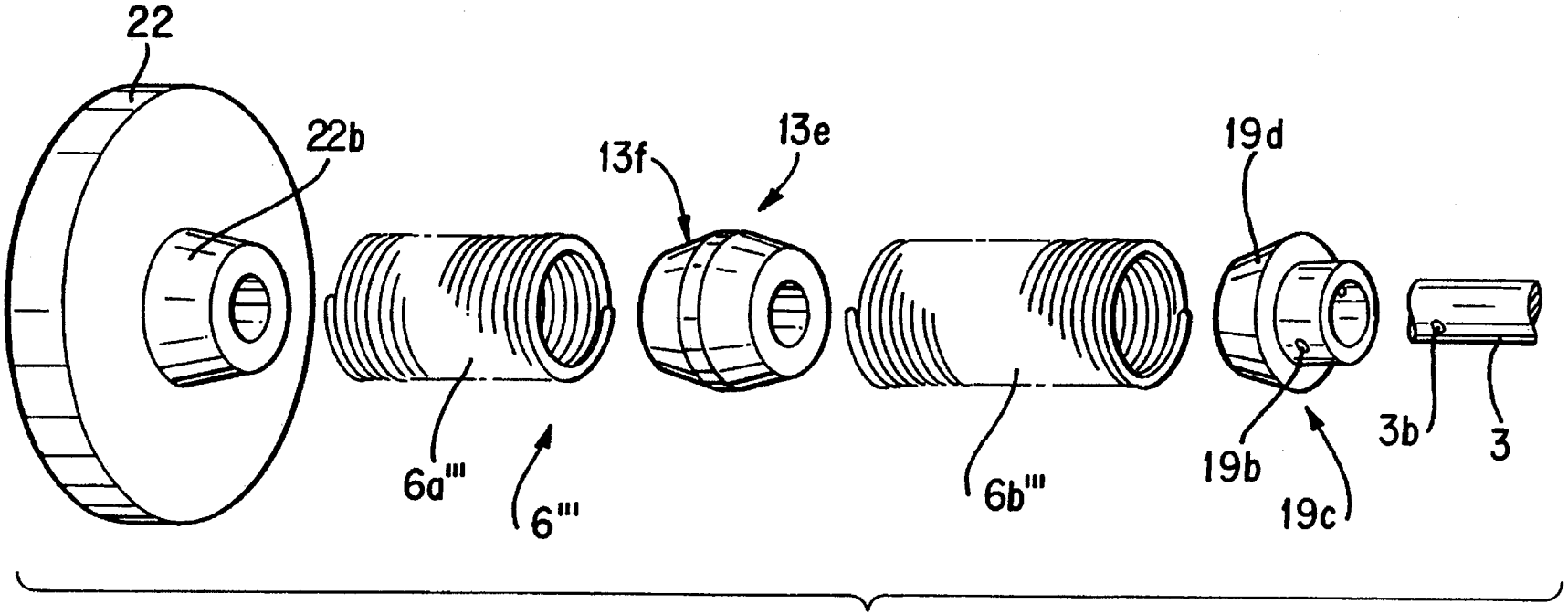
FIG. 19 is an exploded perspective view of a balance spring assembly in another embodiment.
Figure 20:
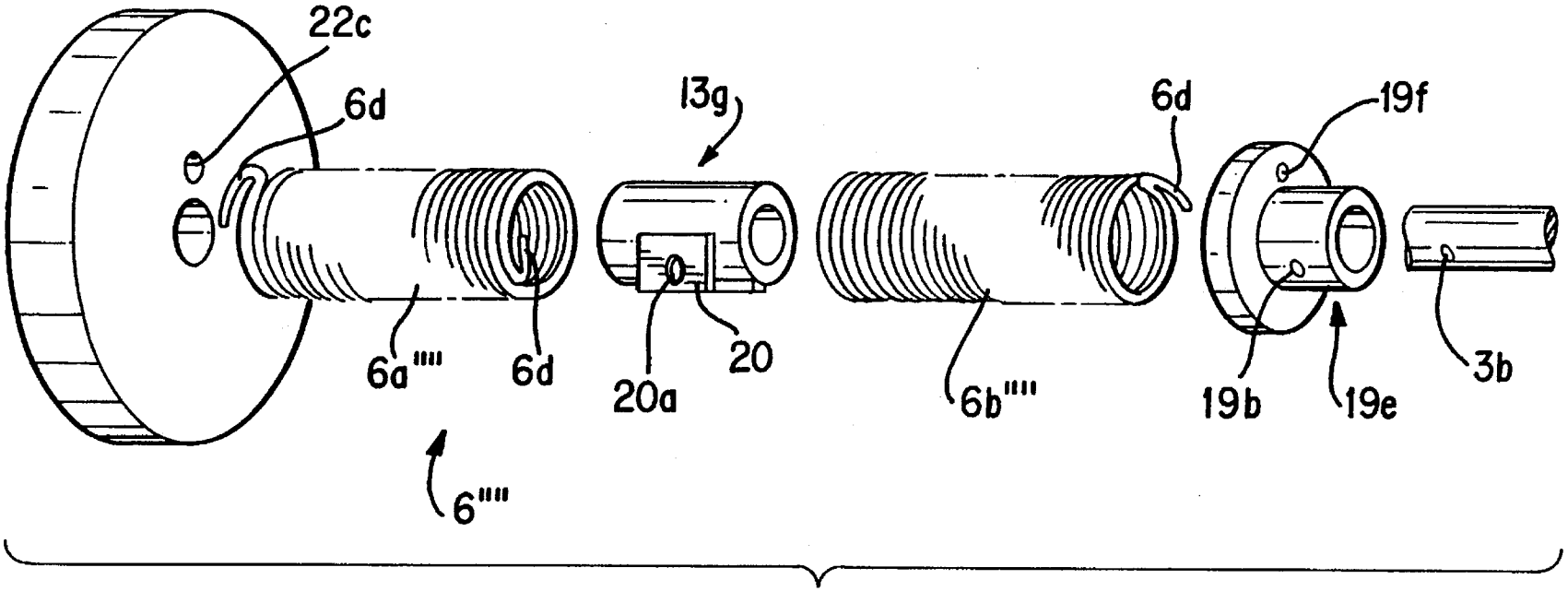
FIG. 20 is an exploded perspective view of a balance spring assembly in another embodiment.

The retainer 13 for interconnecting the split-type balance spring 6 may be modified to eliminate a retaining member, so that it does not fasten the first balance spring, as shown in the embodiments of FIGS. 18–20. The balance spring 6" and the retainer 13*c* shown in the embodiment of the FIG. 18 are modified as follows. A hook 6*c* at one end of the first balance spring 6*a*" is retained and connected by a retaining claw 22*a* integrally formed on the winding wheel 22. Respective hooks 6*c* formed on the other end of the first balance spring 6*a*" and one end of the second balance spring 6*b*" are retained by a retaining claw 13*d* that faces toward the outer diameter and is arranged in the retainer 13*c*. Another hook 6*c* at the other end of the second balance spring 6*b*" is retained by a retaining claw 19*a* formed on a fixing member 19. The fixing member 19 is secured to the winding shaft 3 preferably by pin and hole arrangement 19*e*, 19*b* and 3*b*. The hooks 6*c* of the balance spring 6" retained by the retaining claws 22*a*, 13*d* and 19*a* are bent with folds in order to produce some play. Thus, even though holes 19*b* and 3*b* are positioned not to match each other, they can be easily matched without forcing the fixing member 19 to rotate against the urging force of the first and second balance springs 6*a*" and 6*b*".

The balance spring 6''' and the retainer is shown in another embodiment in FIG. 19. A thread 13*f* is engraved around the outer periphery of the retainer 13*e*, and respective ends of the cut coil-type first and second balance springs 6*a*''' and 6*b*''' are turned onto the thread 13*f*. Further, threads 22*a* and 19*d* similar to the thread 13*f* are formed on a spring-connecting portion of the winding wheel 22 and a spring-connecting portion of the fixing member 19*c*, respectively. Thereby, the other ends of the first and second balance springs 6*a*''' and 6*b*''' are threaded onto the threads 22*a* and 19*d*. These threads 13*f*, 22*a* and 19*d* are tapered such that the farther the first and second balance springs 6*a*''' and 6*b*''' are turned thereonto, the more firmly they are tightened. The operation of turning the balance springs onto the threads is as follows. The one end of the first balance spring 6*a*''' is first turned onto the thread 22*b* of the winding wheel 22. Then, the other end of the first balance spring 6*a*''' is turned onto one end of the thread 13*f* of the retainer 13*e*. Further, the one end of the second balance spring 6*b*''' is turned onto the other end of the thread 13*f*. Lastly, the other end of the second balance spring 6*b*''' is turned onto the thread 19*d* of the fixing member 19*c*. In this state, the fixing member 19*c* is connected to the winding shaft 3 by a pin and hole arrangement.

Alternatively, the balance springs may be turned onto the threads by the following operation. The fixing member 19*c* is fastened to the winding shaft 3, and the balance springs 6*a*''' and 6*b*''' are loosely turned into the threads 13*f*, 22*b* and 19*d*. In this state, either the winding shaft 3 or the winding wheel 22 is rotated, thereby turning the balance springs 6*a*''' and 6*b*''' onto the threads firmly. The latter operation offers the following advantage. When the holes 3*b* and 19*b* provided for the winding shaft 3 and the fixing member 19*c*, respectively, are displaced from the correct positions, they can be matched by adjusting the amount the respective threads are tightened.

The balance spring and the retainer may be modified as illustrated in another embodiment of FIG. 20 by the following construction. A bracket 20 having an engaging hole 20*a* is provided for a retainer 13*g* to engage with hooks 6d formed in the first and second balance springs 6*a*''' and 6*b*'''. Other engaging holes 22*c* and 19*f* are also provided for the winding wheel 22 and the fixing member 19*e*, respectively. The balance springs 6*a*''' and 6*b*''', the retainer 13*g*, the winding wheel 22 and the fixing member 19*e* are serially connected to each other by the engagement of the hooks 6*d* with the engaging holes 20*a*, 22*c* and 19*f*. In this embodiment as well as the embodiment of FIG. 18, the holes 3*b* and 19*b* provided with the winding shaft 3 and the fixing member 19*e*, respectively, can be positioned to match each other owing to some play produced by bending the hooks 6*d* with folds.

The foregoing embodiments offer the following advantage. The balance spring 6 having a desired urging force can be obtained by variously selecting and combining standardized balance springs having a predetermined urging force. Consequently, it is not necessary to take the trouble of preparing a spring having an urging force in correspondence with the weight of the shutter curtain, thus enabling a decrease in the number of parts.

Figure 21:
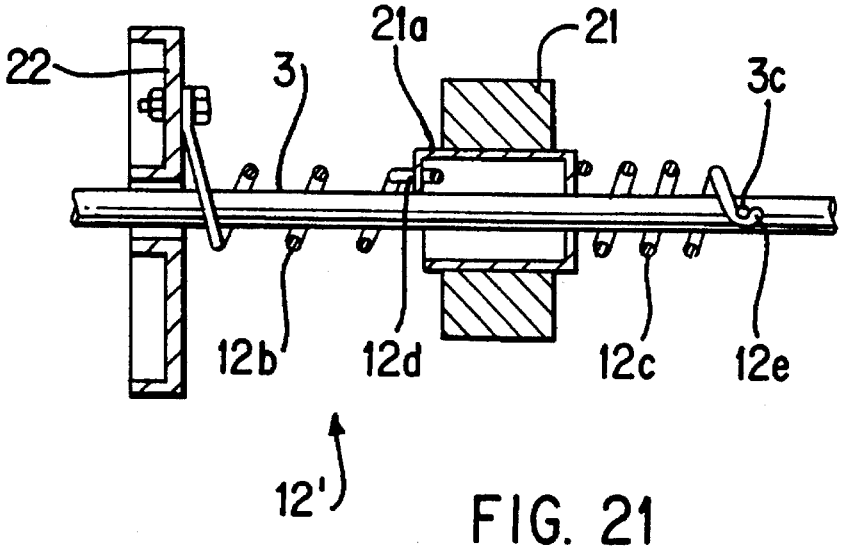
FIG. 21 is a partial sectional view of a winding drum when the shutter curtain moves at a slower speed in an embodiment of the buffer spring.
Figure 22:
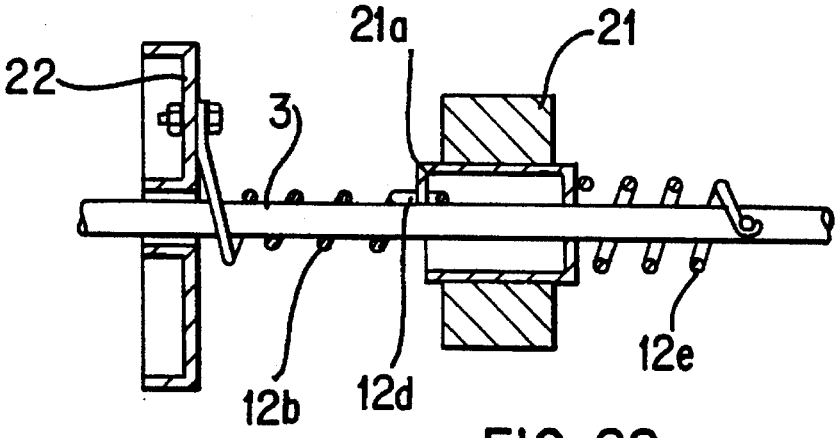
FIG. 22 is a partial sectional view of a winding drum of FIG. 21 when the shutter curtain moves at a greater speed.

The buffer spring 12 for absorbing the impact when the shutter curtain is fully opened is described with reference to FIGS. 21 and 22. The buffer spring 12 is not limited to that shown in the first embodiment of FIG. 1, but may be a split-type provided with a weight of inertia 21. Thus, the buffer spring 12' can be adapted to absorb the impact by a loading force corresponding to the raising speed of the shutter curtain 1. That is, the buffer spring 12' comprises first and second buffer springs 12*b* and 12*c*, and a weight of inertia 21 intervening therebetween is freely rotatably supported by the winding shaft 3. The first buffer spring 12*b* is fixed at one end by the winding wheel 22 and has a retaining hook 12*d* at the other end. The second buffer spring 12*c* is fixed at one end by the weight of inertia 21 and has a hook 12*e* at the other end, retained by a projection 3*c* on the winding shaft 3. When the shutter curtain 1 is opened and closed, the winding wheel 22 and the winding shaft 3 are relatively rotated with each other in correspondence with the rotation of the winding wheel 22. When the shutter curtain 1 is operated for closing, a retaining claw 12*a* arranged on the weight of inertia 21 moves through the coil of the first buffer spring 12*b* toward the winding drum 4. However, the retaining claw 21*a* is adapted to not contact the winding drum 4 even when the shutter curtain 1 is fully closed.

On the other hand, when the shutter curtain 1 is operated for opening from the closed state, the retaining claw 21*a* gradually moves through the coil of the first buffer spring 12*b* toward the retaining hook 12*d* to be stopped by the retaining hook 12*d* when the shutter curtain 1 is raised to some degree. Beyond this state, as the shutter curtain 1 is further raised, the buffer spring 12' is wound to be gradually loaded, thereby resisting the force of raising the shutter curtain 1, and exerting a buffering effect. When the shutter curtain 1 is raised at a slower speed, the weight of inertia 21 is rotated to follow the first buffer spring 12*b*, being susceptible to the turning effect caused by the winding of the first buffer spring 12*b*, thereby further winding the second buffer spring 12*c*. Thus, the loading forces of both the buffer springs 12*b* and 12*c* are applied to the shutter curtain 1, the raising speed of which can be buffered. On the other hand, when the shutter curtain 1 is raised at a greater speed, the first buffer spring 12*b* is rapidly wound. However, the weight of inertia 21 does not rotate at a greater speed in correspondence with the rapidly increasing turning effect of the first buffer spring 12*b*, but instead acts firmly connected. Thus, the first buffer spring 12*b* is nearly loaded gradually narrowing the winding diameter and wound firmly on the winding shaft 3, thereby controlling the rotation of the winding wheel 22. Such a controlled state of the winding wheel 22 can be gradually released by the following operation. The turning effect of the loaded first buffer spring 12*b* is applied to the weight of inertia 21, which is rotated by loading the second buffer spring 12*c*.

As described above, in this type of buffer spring, when the shutter curtain 1 is raised at a greater speed, the coil diameter of the first buffer spring 12*b* is narrowed to be firmly wound on the winding shaft 3, thereby controlling the winding wheel 22 and decreasing the speed. Hence, the use of the buffer spring 12' set to exert a smaller buffering effect in correspondence with the slower speed of raising the shutter curtain 1 also enables the reliable absorption of the impact caused by raising the shutter curtain 1 at a greater speed. As a result, the shutter curtain 1 can be fully opened quietly, free from impact, and influenced very little by the raising speed.

Figure 23:
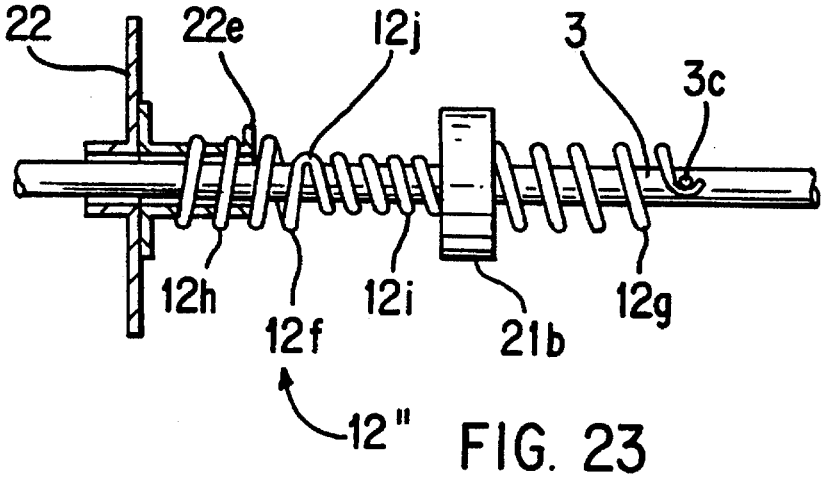
FIG. 23 is a partial sectional view of a buffer spring in another embodiment.

The buffer spring 12' provided with the weight of inertia 21 may be modified as shown in the embodiment of FIG. 23. More specifically, the buffer spring 12' is constructed similar to the embodiment of FIGS. 21 and 22 with the buffer spring 12' fitted between the winding wheel 22 and winding shaft 3. The spring assembly comprises first and second buffer springs 12*f* and 12*g* and a weight of inertia 21*b* intervening therebetween. However, the first buffer spring 12*f* further includes a larger coil 12*h* and a smaller coil 12*i* having opposite winding directions. A retaining portion 12*j* is formed between both the coils 12*h* and 12*i*. A claw 22*e* formed on the winding wheel 22 is adapted to move through the larger coil 12*h*. When the shutter curtain 1 is raised at a greater speed to allow the winding wheel 22 to rotate rapidly, the claw 22*e* is retained by the retaining portion 12*j*, thereby winding on the smaller coil 12*i* and controlling the rotation of the winding wheel 22. Hence, the buffer spring 12' can exert a buffering effect in a manner similar to that of the embodiment of FIGS. 21 and 22.

Figure 24:
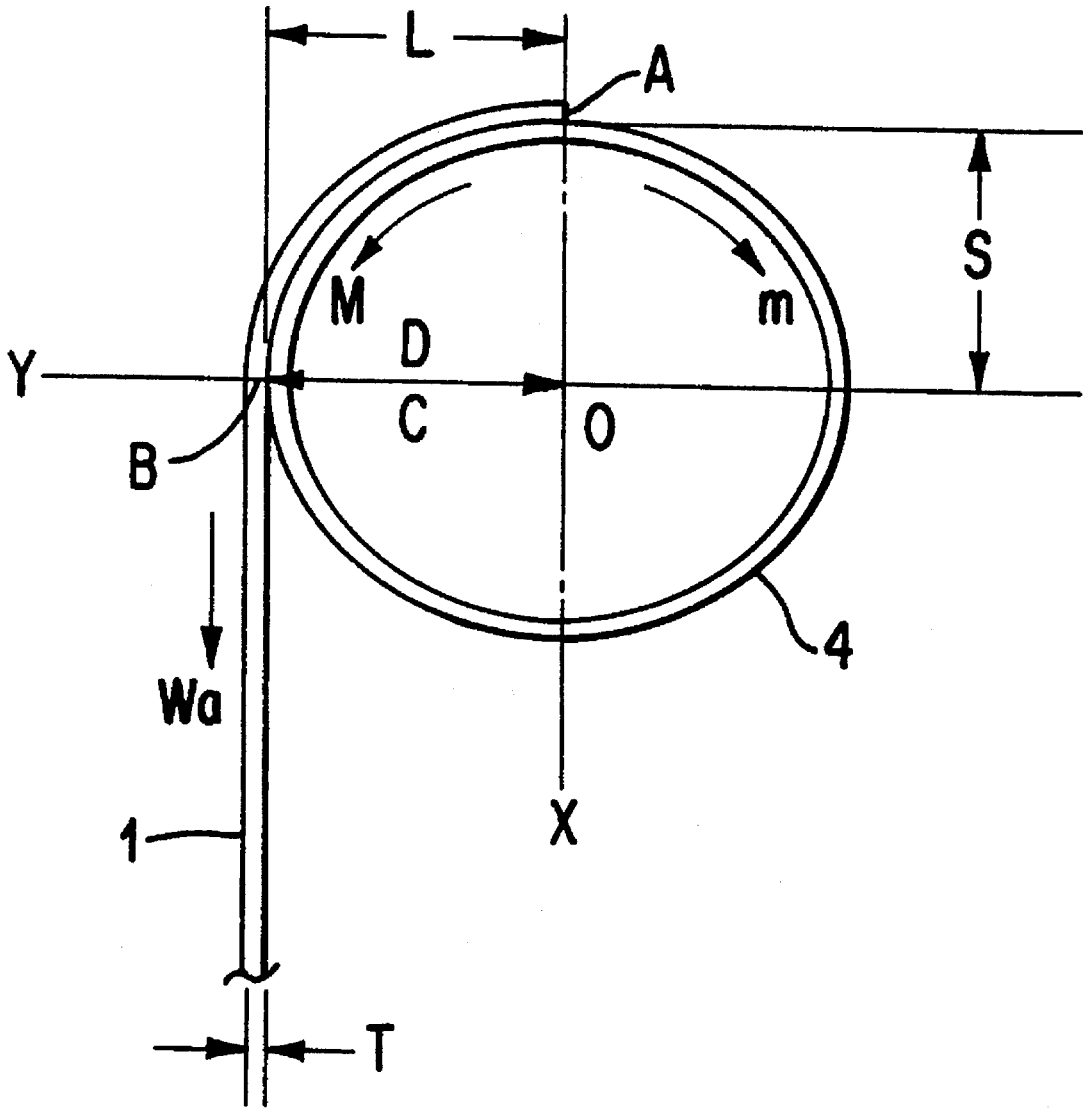
FIG. 24 is a schematic side view of a winding drum.
Figure 25A:
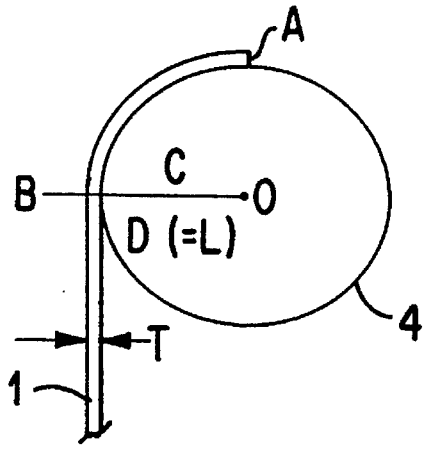
FIG. 25A, B, C and D are schematic side views showing a shutter curtain of FIG. 24 being wound on a first rotation.
Figure 25B:
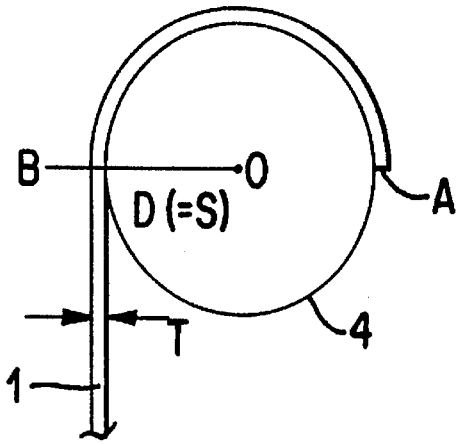
Figure 25C:
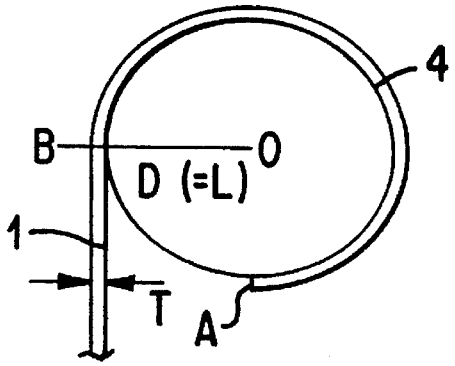
Figure 25D:
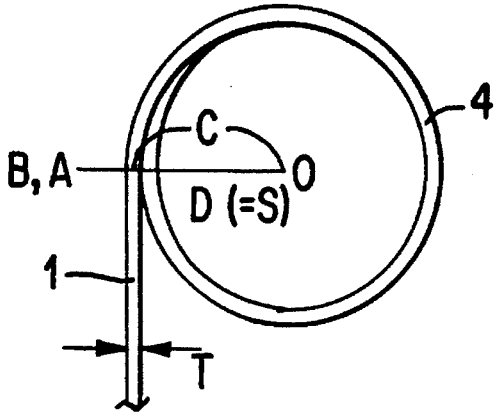
Figure 26:
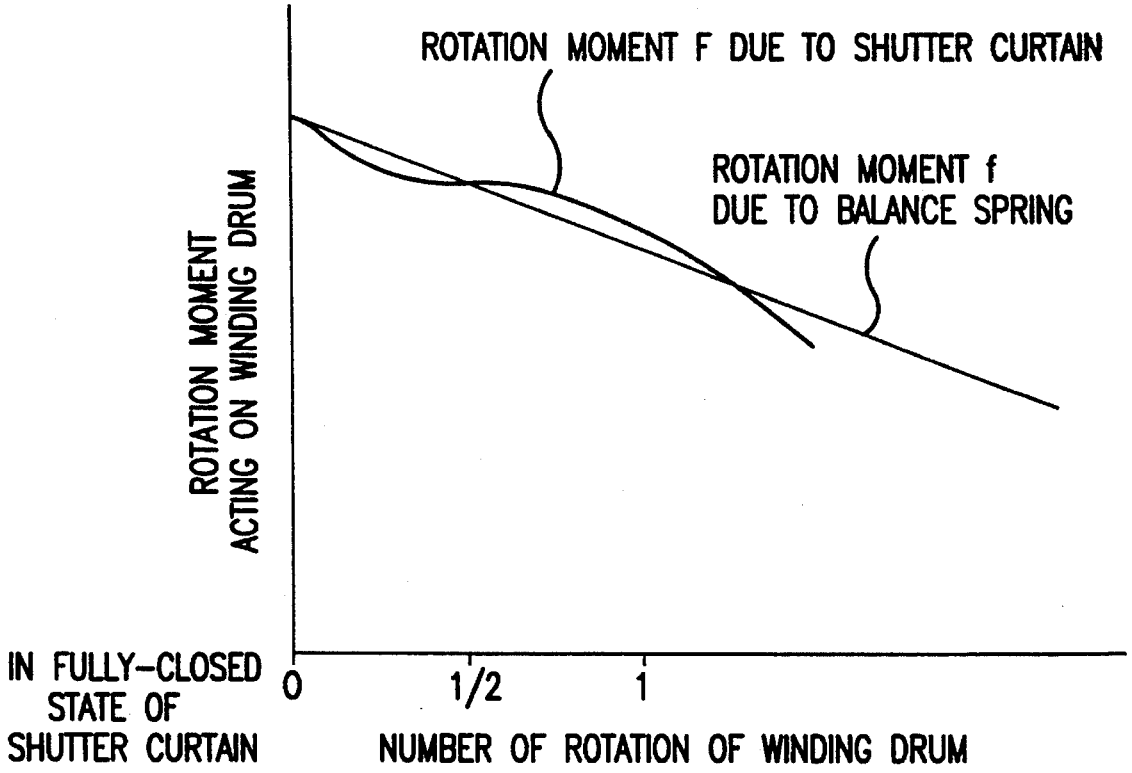
FIG. 26 is a graph indicating the rotation moment with respect to the winding drum of FIG. 24.
Figure 27A:
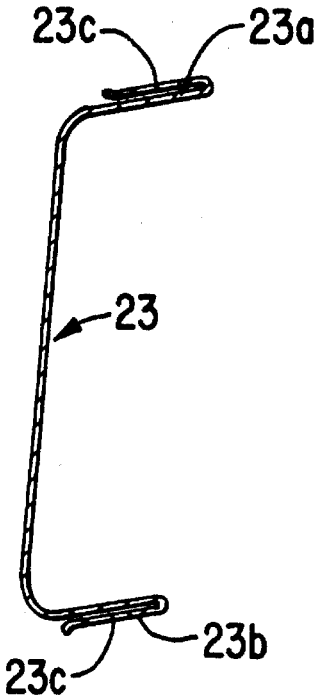
FIG. 27A is a side sectional view of a main slat.
Figure 27B:
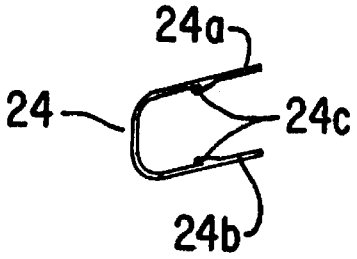
FIG. 27B is a side sectional view of a subsidiary slat.
Figure 27C:
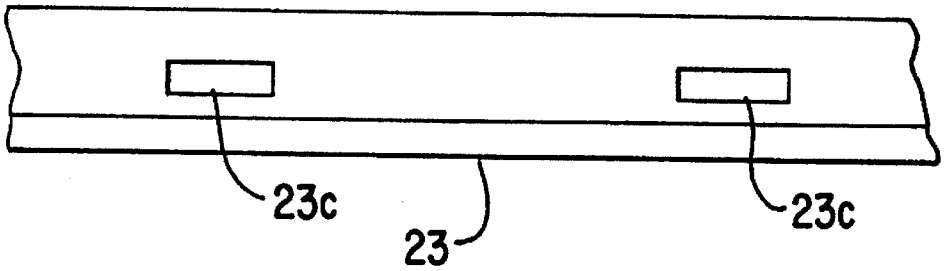
FIG. 27C is a partial plan view of the main slat.
Figure 27D:
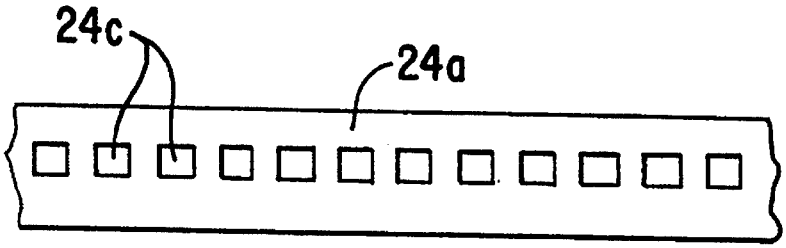
FIG. 27D is a partial sectional view of the subsidiary slat.

Referring to FIG. 24, the winding drum 4 is rotatably supported by the winding shaft 3. The shutter curtain 1 is integrally interconnected at one end to the winding drum 4. The winding drum 4 is generally shaped to have a complete circular section, but may be shaped to have an elliptic section as shown in FIGS. 24–26. The use of the winding drum 4 having an elliptic section as well as the use of the split-type balance spring 6 enables a light opening operation of the shutter curtain 1.

More specifically, the position A for connecting the winding drum 4 to the shutter curtain 1 is determined to be substantially at the top of the winding wheel 22 when the shutter curtain 1 is fully closed. The wheel diameter is determined to have the smaller diameter X passing through the position A for connecting the shutter curtain 1. The greater diameter Y passing through the position turned at substantially 90 degrees from the position A determines the position B for pulling the shutter curtain 1 out from the winding drum 4 when the shutter curtain 1 is fully closed (when the radiuses of the greater and smaller diameters are indicated by L and S, respectively, L>S.)

In the shutter constructed as described above, the rotation moment due to the weight of the shutter curtain 1 is indicated as M, and the rotation moment due to a loading force of the balance spring 6 is indicated as m. The weight of the pulled-out portion of the shutter curtain 1 is Wa, the thickness of the shutter curtain 1 is T, the winding diameter of the shutter curtain 1 (distance from the central position O to the pulled-out position B of the winding drum 4) is C, and the radius of the winding drum 4 at the pulling-out position B is D. In the fully-closed state of the shutter curtain 1 (no rotation of the winding drum 4), the winding diameter C is substantially expressed by the total of the radius D of the winding drum 4 and the length T/2 equivalent to one half the thickness of the shutter curtain 1: that is, ($C \approx D+T/2$). Thus, the rotation moment M caused by the shutter curtain 1 can be obtained by the product of the weight Wa of the pulled-out portion of the shutter curtain 1 and the winding diameter C, or [$M \approx Wa \times (D+T/2)$]. In the fully-closed state of the shutter curtain 1, the rotation moment M and the rotation moment m due to the loading force of the balance spring 6 are substantially balanced ($M \approx m$). In the winding drum 4, the diameter passing through the position B for pulling out the shutter curtain 1 coincides with the greater diameter: that is, D=L.

When the shutter curtain 1 is raised from the fully-closed state, as illustrated in FIGS. 25A–D and 26, the rotation moment m due to the loading force of the balance spring 26 decreases linearly in proportion to the rotation amount of the winding drum 4. On the other hand, in a range from the fully-closed state of the shutter curtain 1 to ¼ rotation of the winding drum 4, the rotation moment M due to the weight of the shutter curtain 1 varies in accordance with a decrease of the radius D of the winding drum 4 at the pulled-out position B from the radius L of the greater diameter and the radius S of the smaller diameter, together with a decrease of the weight of the shutter curtain 1. Thus, the rotation moment M due to the shutter curtain 1 is decreased as shown in the curve having the shape of a projection as viewed from under the straight line of the rotation moment m, as illustrated in FIG. 26. As a result, the rotating moment M is smaller than the rotating moment m ($M<m$).

In a range from ¼ rotation to ½ rotation of the winding drum 4, since the radius D of the winding drum 4 at the pulling-out position B increases from the radius S of the smaller diameter to the radius L of the greater diameter, the rotation moment M due to the shutter curtain 1 gradually approximates the rotation moment m due to the loading force. At the point of substantially a ½ rotation of the winding drum 4, the rotation moment M due to the shutter curtain 1 and the rotation moment m due to the balance spring 6 substantially conform with each other ($M \approx m$). In a further range from ½ rotation to ¾ rotation of the winding drum 4, the shutter curtain 1 starts on a second rotation when the winding drum 4 is at 4 rotation; the winding diameter C gradually increases ($C \approx D+3T/2$ at ¾ rotation). Accordingly, the rotation moment M due to the shutter curtain 1 becomes greater than the rotation moment m due to the balance spring 6. At ¾ rotation of the winding drum 4, the diameter D of the winding drum 4 coincides with the radius S of the smaller diameter, thereby controlling an increase in the winding diameter C. Hence, the rotation moment M can be prevented from being considerably greater than the rotation moment m.

As a result, the rotation moment M due to the shutter curtain 1 and the rotation moment m due to the urging force of the balance spring 6 are substantially balanced. When the shutter curtain 1 is raised from the fully-closed state, in a range from the fully-closed state to substantially ½ rotation of the winding drum 4, the rotation moment m due to the loading force of the balance spring 6 acting upon the winding drum 4 in the winding direction is more influential than the rotation moment M due to the weight of the pulled-out shutter curtain 1 acting upon the winding drum 4 in the unwinding direction. Thereby, the shutter curtain 1 is raised easily as desired. Thus, the operational force required immediately after raising the shutter curtain 1 from the fully-closed state can be reduced. For further operation, the shutter curtain 1 can be raised smoothly due to the inertia. As a result, the shutter curtain 1 can be operated with little force for opening.

On the other hand, when the shutter curtain 1 is closed, the rotation moment m due to the balance spring 6 is more influential at the stage immediately before the fully-closed state, thus effectively avoiding the following inconveniences inherent in a conventional shutter. Conventionally, the rotation moment M due to the pulled-out shutter curtain 1 becomes more influential immediately before the fully-closed state, thus accelerating the lowering of the shutter curtain 1 so as to close with great impact.

When the shutter curtain 1 is wound on and off the winding drum 4, for example, when it shifts from the first rotation to the second rotation or from the third rotation to the fourth rotation, the winding diameter considerably changes because of an increase or decrease of the winding amount. However, in this embodiment, since the winding drum 4 is elliptically shaped, the diameter passing through the position for pulling out the shutter curtain 1 coincides with the smaller diameter, thus controlling the change of the winding diameter. Hence, the rotation moment M due to the shutter curtain 1 changes as linearly as possible.

The winding drum is not limited to an elliptic section, but may be ovaloidal. Further, a non-complete circular shaped winding drum having a greater diameter coinciding with the diameter passing through the position for pulling out the shutter curtain 1 from the winding drum 4 in the fully-closed state effectively reduces the operating force required immediately after raising the shutter curtain 1 from the fully-closed state. A suitable value of the difference between the greater diameter and the smaller diameter of the winding drum is not limited to the difference shown in the drawings, but may be determined according to various conditions such as the thickness and weight of the shutter curtain 1, the diameter of the winding drum, and the like.

Figure 28A:
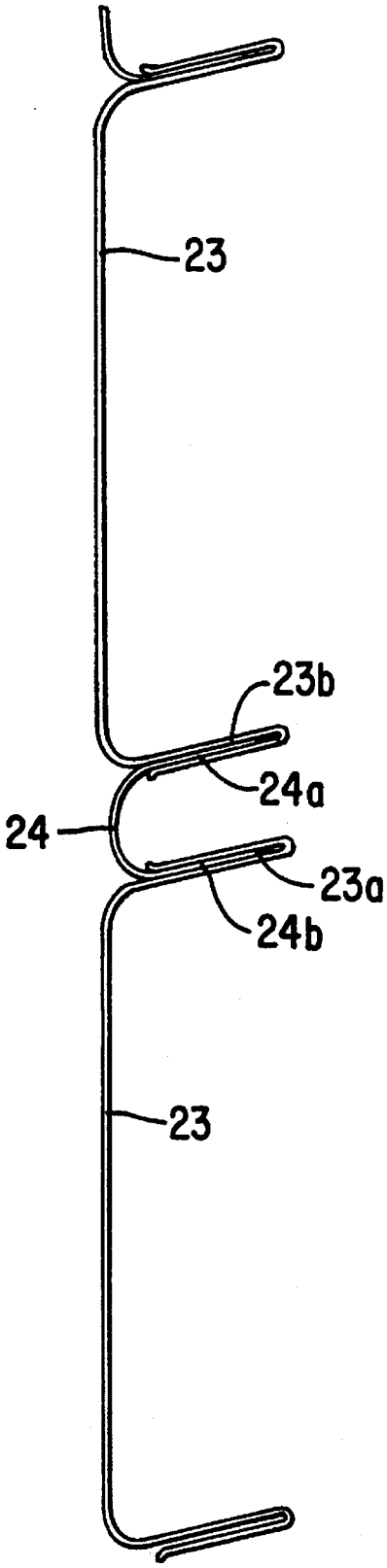
FIG. 28A is a partial side view of the shutter curtain.
Figure 28B:
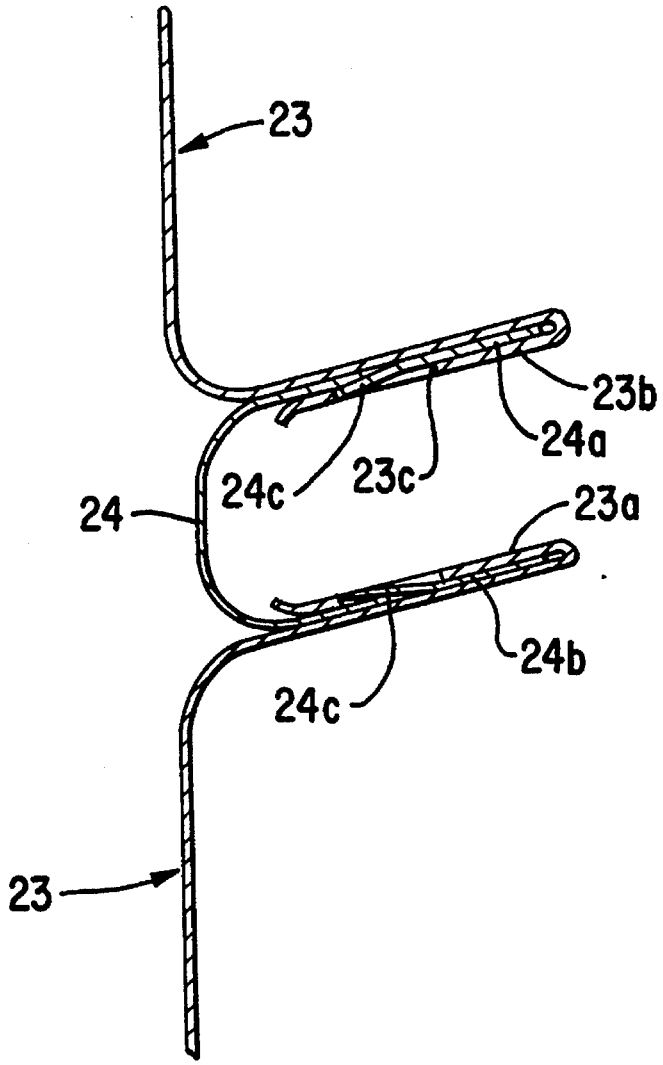
FIG. 28B is an enlarged sectional view of the shutter curtain shown in FIG. 28A.
Figure 29A:
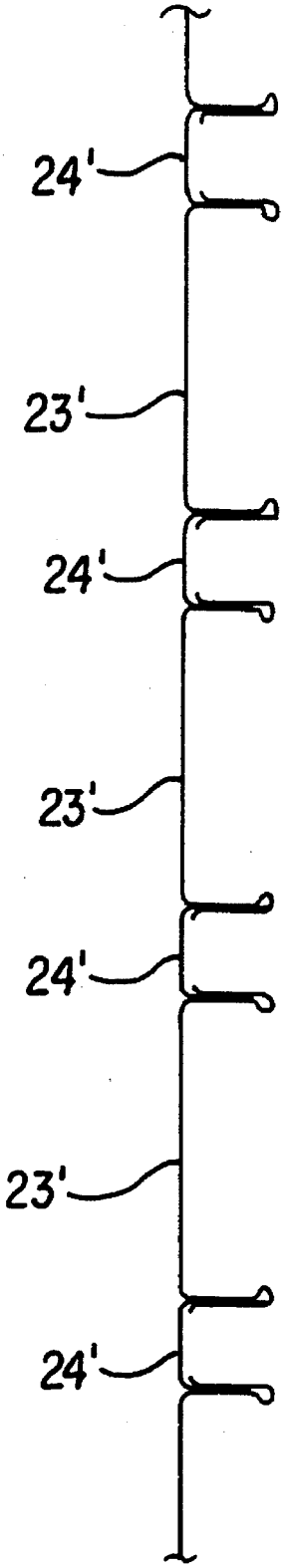
FIG. 29A, B and C are schematic views showing patterns of the shutter curtain.
Figure 29B:
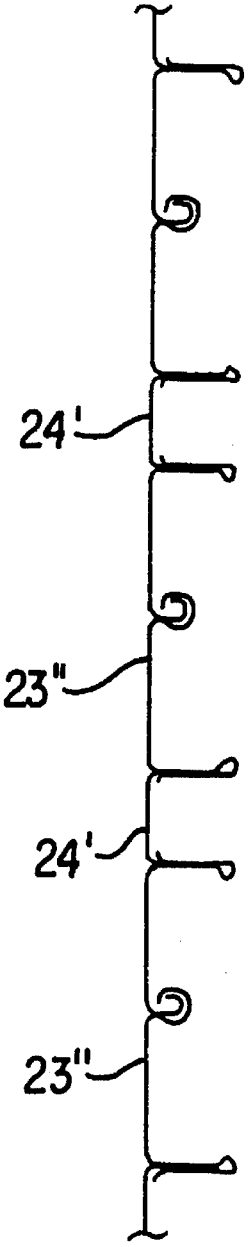
FIG. 29D is a schematic view showing the shutter curtain being wound.
Figure 29C:
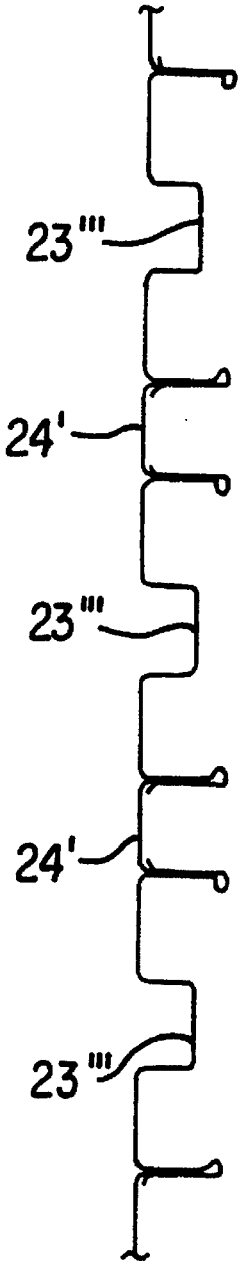
Figure 29D:
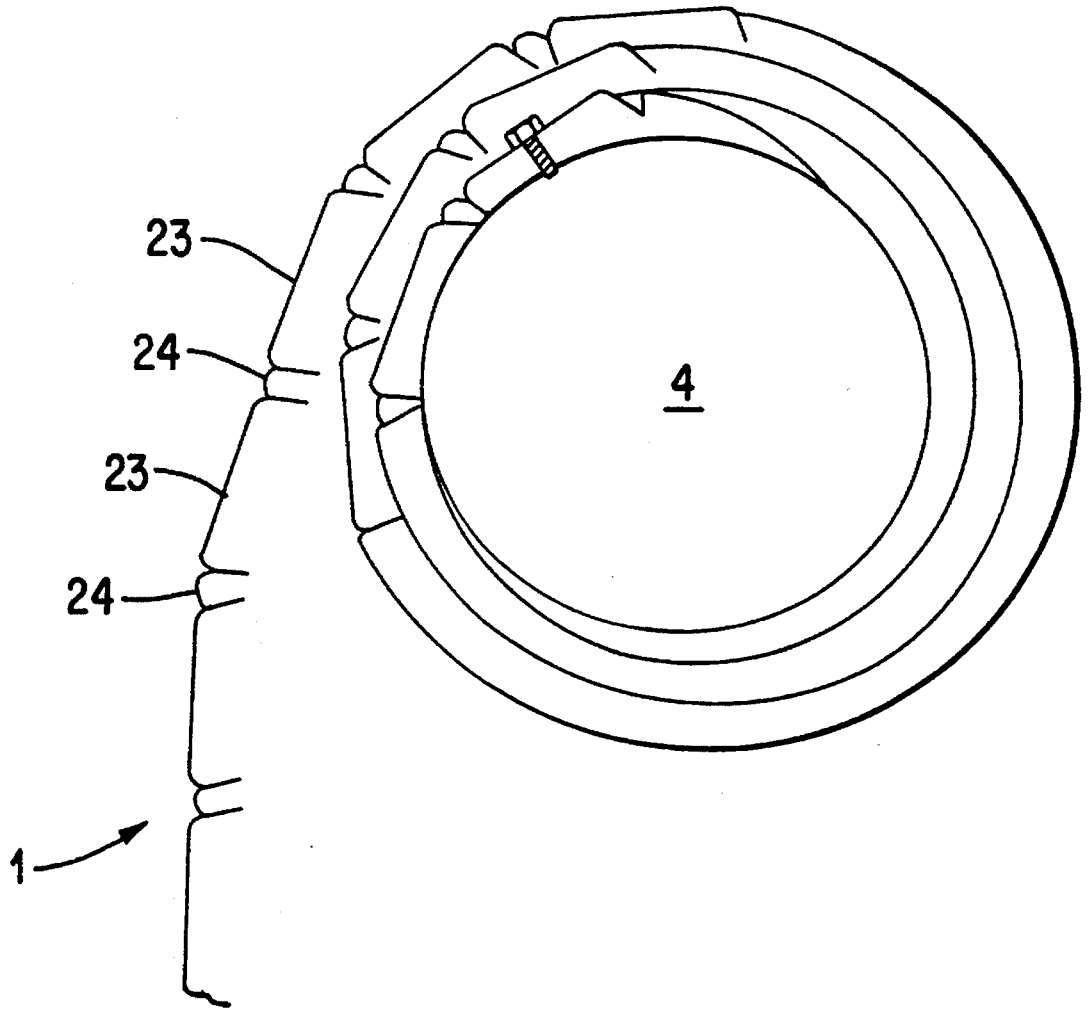

The shutter curtain 1 will now be described with reference to FIGS. 27–29. The shutter curtain 1 is constructed by integrally interconnecting a main slat 23 having rigidity to a subsidiary slat 24 having flexibility to be deformed elastically. Due to elastic deformation of the subsidiary slat 24, the shutter curtain 1 can be deformed to either a wound or unwound configuration. More specifically, the main slat 23 is generally formed in a U-shape to slant upward gradiently toward the top by suitable forming, such as mold forming and roll forming. Also, fitting grooves **23*a* and 23*b* bent outward with folds are formed on leg portions. (As a matter of convenience, assuming that the shutter curtain 1 is moved vertically, the upper and lower fitting grooves are numbered as 23*a* and 23*b*, respectively, but the shutter curtain 1 may be used for a symmetrical-opening type for opening and closing both to the right and left directions and for a horizontal-opening type for opening and closing horizontally.) Engaging holes 23*c* are further provided outside of the fitting grooves 23*a* and 23*b*. On the other hand, the subsidiary slat 24 is also generally formed in a U-shape to slant upward gradiently toward the top. Leg portions 24*a* and 24*b* form engaging pieces 24*c* having the top ends toward the opposite side of the leg portions and projecting facing opposite to each other from both the leg portions. The main slats 23 and the subsidiary slats 24 are serially connected by fitting the lower leg portion 24*b* of the subsidiary slat 24 into the upper fitting groove 23*a* of the main slat 23 as shown in FIGS. 28A and 28B to form the shutter curtain 1 having a round pattern as illustrated in FIG. 29D. Unlike a conventional shutter curtain constructed by interlock-connecting rigid slats to freely bend, this type of shutter curtain 1** is free from a gap in a connecting portion between slats. Thus, the noise caused by the operation of opening and closing or the wind due to the abutment of slats is effectively avoided. Hence, a quiet and low-noise shutter used for buildings, for example, can be obtained. This type of shutter also has good building properties such as being flame-proof, fume-tight and sound insulating since no gaps are present in the connecting portions between slats.

The shutter curtain 1 may also be a general-use type obtained by interlock-connecting rigid slats. The shutter curtain constructed by combining the rigid main slat 23 and the elastic subsidiary slat 24 may include the shutter curtain disclosed in France Patent No. 2664937. The shutter curtains having the patterns shown in FIGS. 29A, 29B and 29C, respectively, may also be used.

Moreover, as shown in the embodiment of FIGS. 30–33, the shutter curtain 1 may be constructed of single thin-plate-like slat main members **1*a* having flexibility to freely bend and slat skeleton members 1*b* having rigidity. In such patterns, the slat skeleton members are fastened to one side of the slat main members 1*a*** at predetermined spacing in parallel to each other by utilizing thermosetting adhesives or fastening members, such as rivets or the like.

Figure 30A:
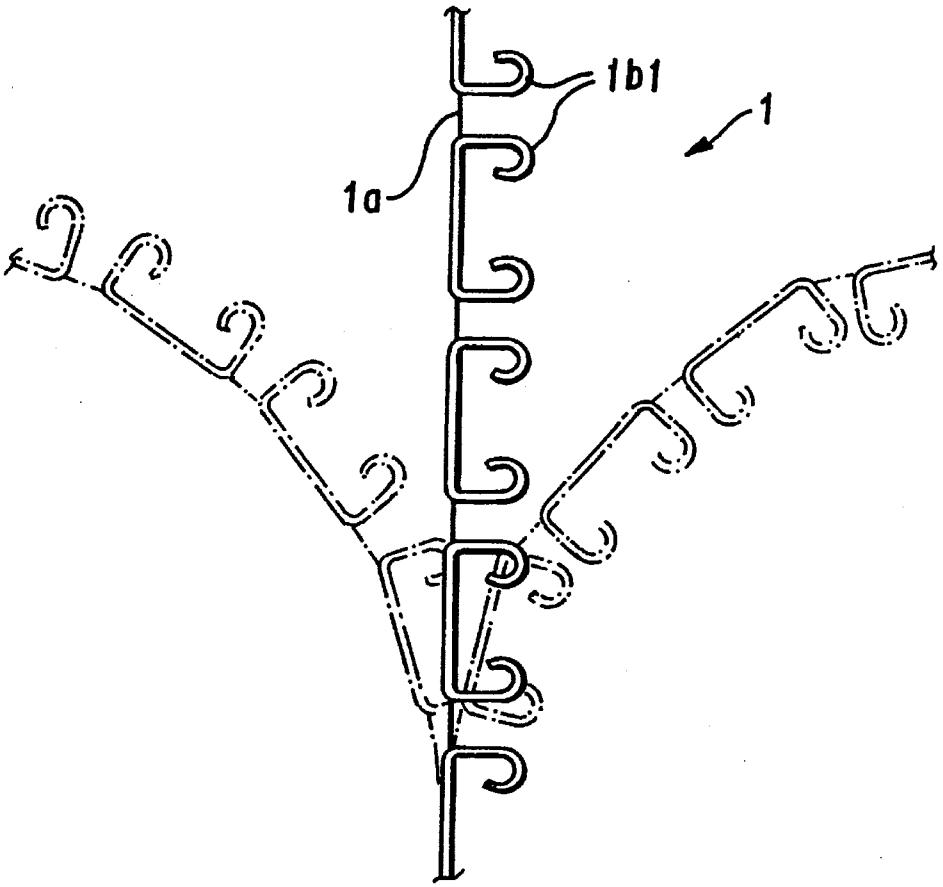
FIG. 30A, B and C are schematic views showing patterns of the shutter curtain.
Figure 30B:
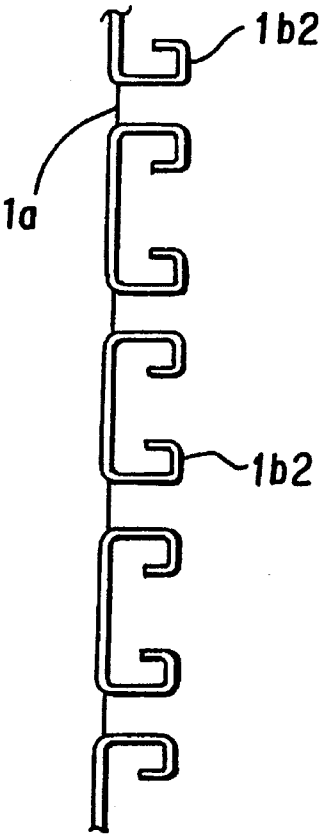
Figure 30C:
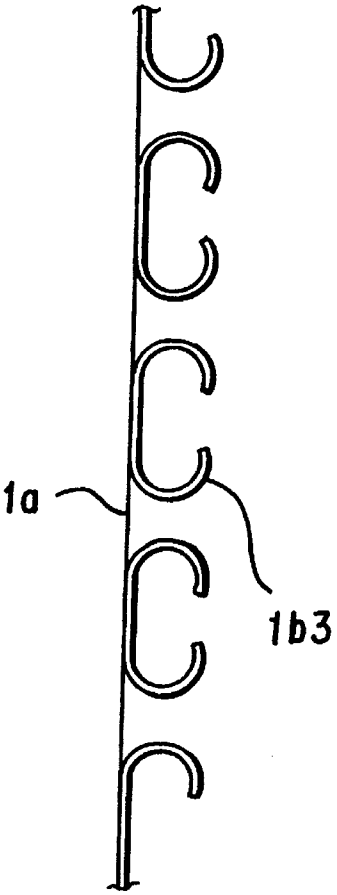
Figure 31A:
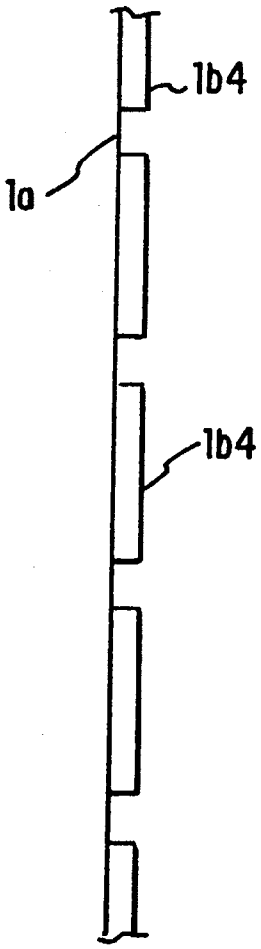
FIG. 31A, B and C are schematic views showing different patterns of the shutter curtain.
Figure 31B:
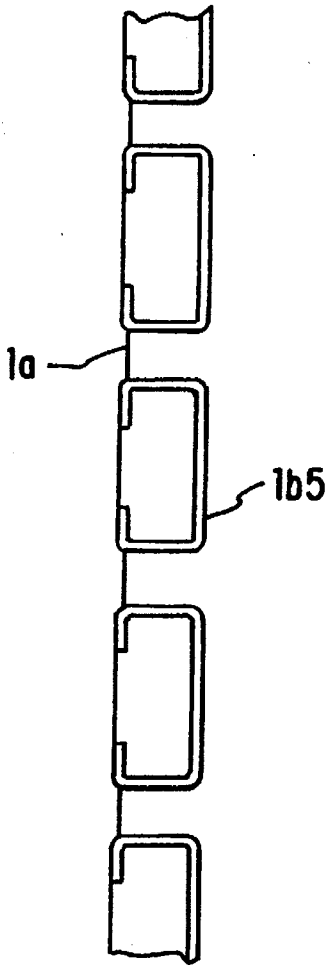
Figure 31C:
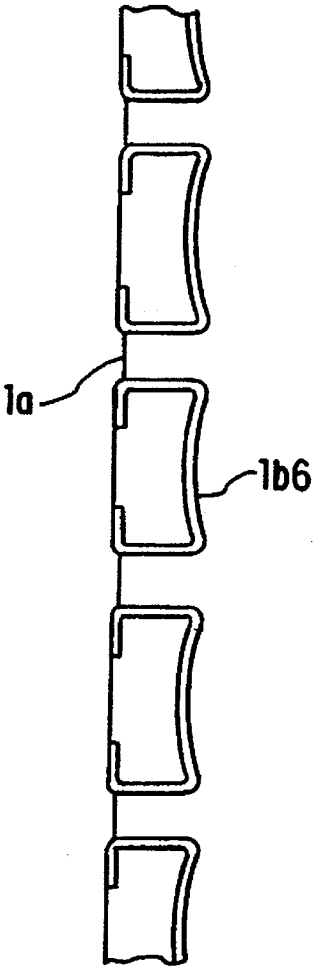
Figure 32A:
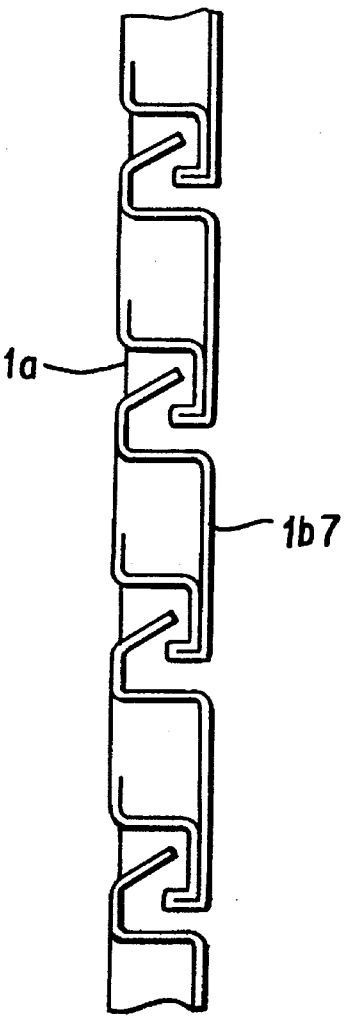
FIG. 32A, B, C and D show further different patterns of the shutter curtain.
Figure 32B:
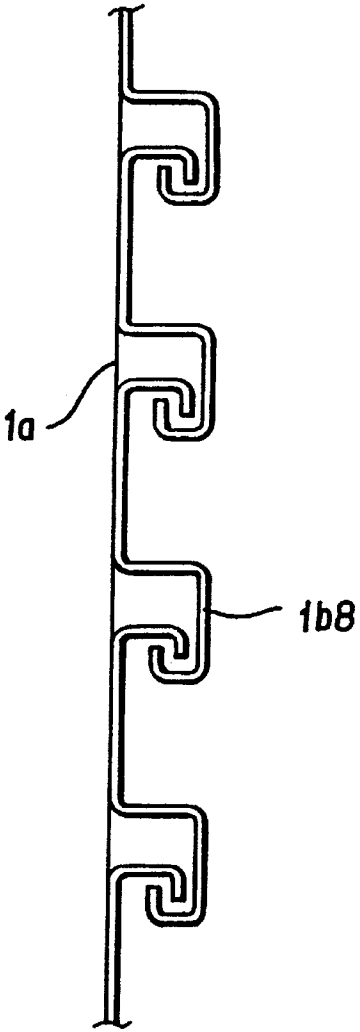
Figure 32C:
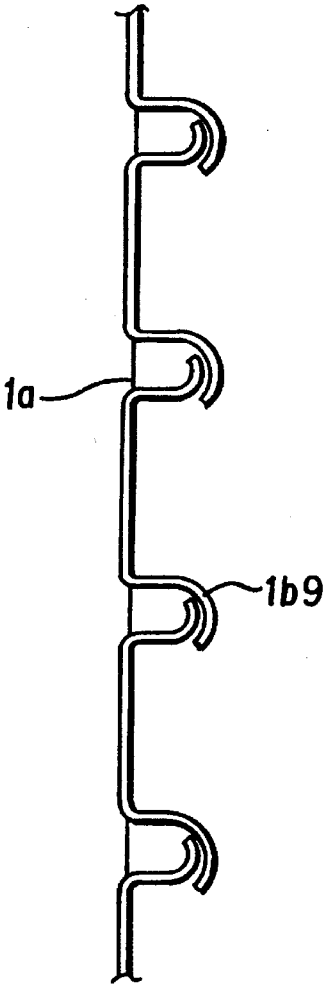
Figure 32D:
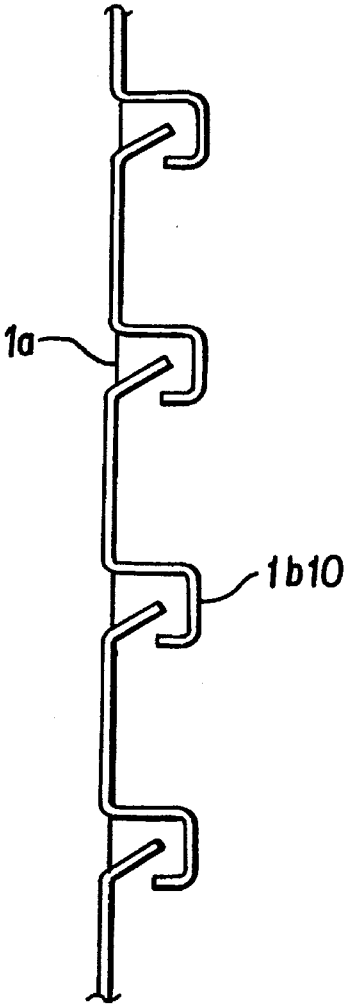
Figure 33A:
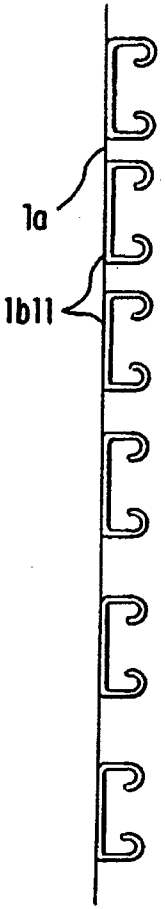
FIG. 33A, B and C show still further different patterns of the shutter curtain.
Figure 33B:
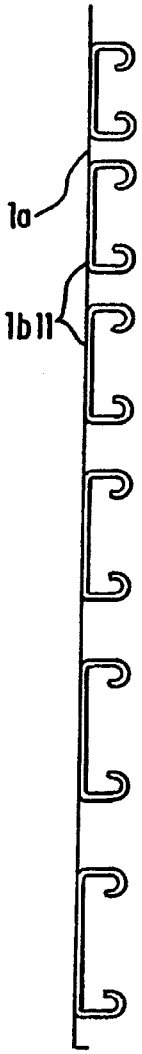
FIG. 33D is a schematic drawing showing the shutter curtain being wound.
Figure 33C:
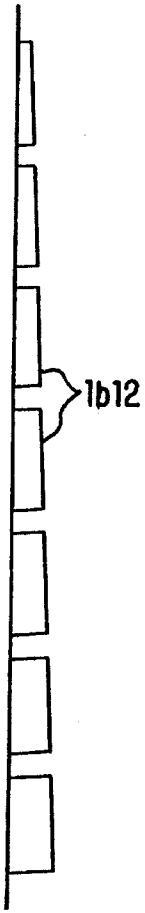
Figure 33D:
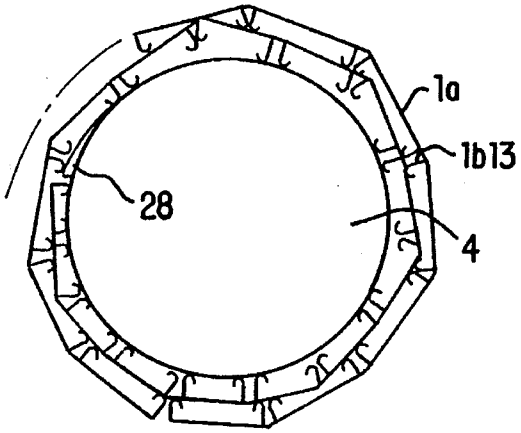
Figure 34A:
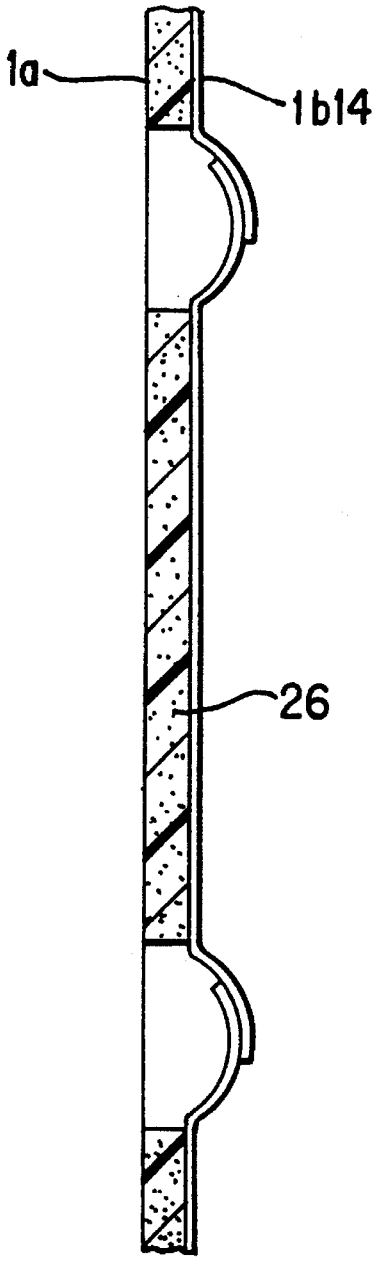
FIG. 34A and B show a partial section of patterns of a shutter curtain in another embodiment.
Figure 34B:
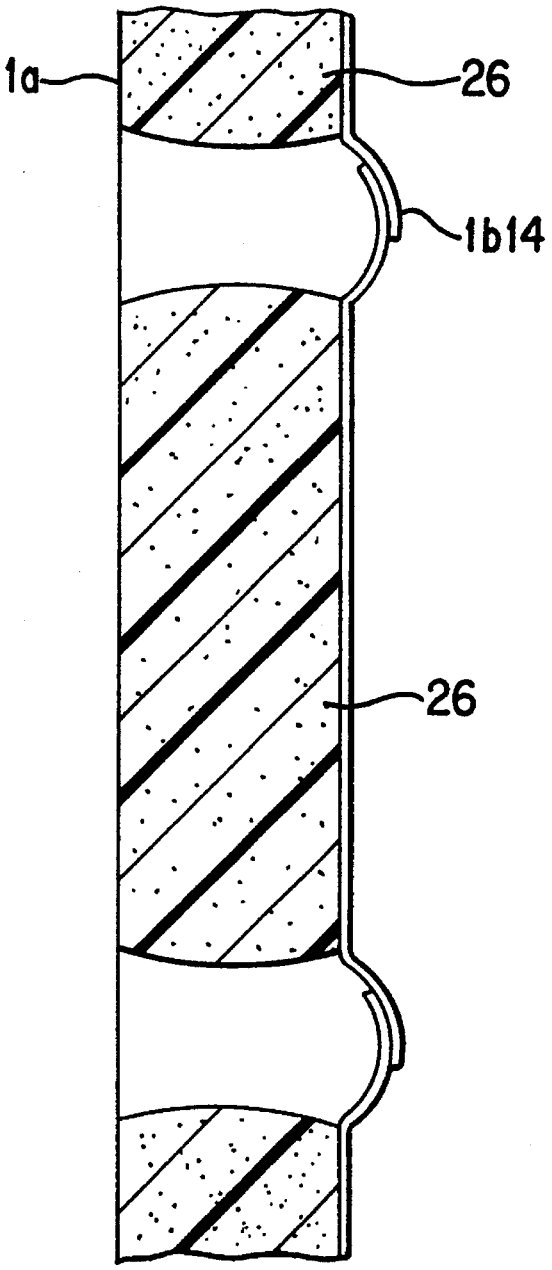
FIG. 34C and D are partial sectional views of the patterns shown in FIG. 34A and B, respectively.
FIG. 34E and F are partial longitudinal sectional views of the patterns shown in FIG. 34A and B, respectively.
Figure 34C:
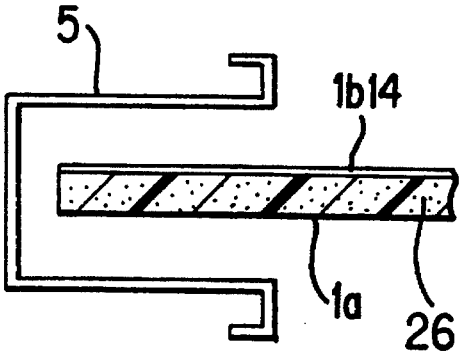
Figure 34D:
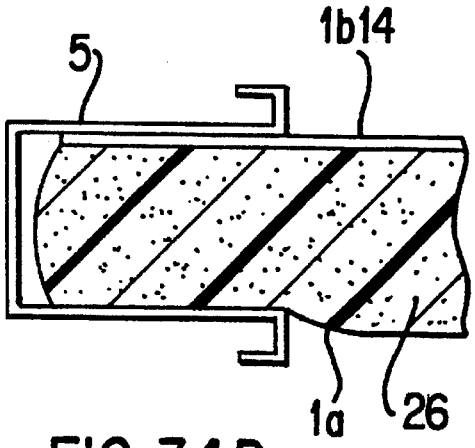
Figure 34E:
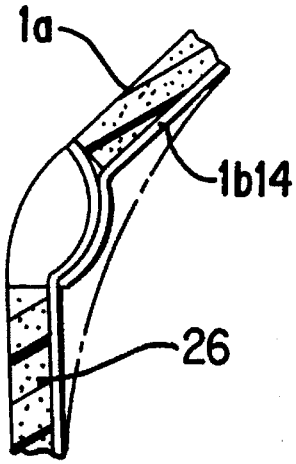
Figure 34F:
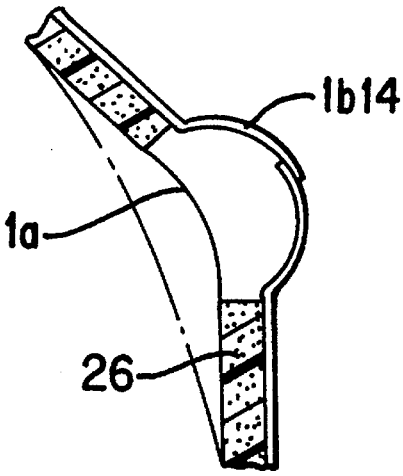

The slat skeleton members **1*b* may be modified as follows. As shown in FIGS. 30A, B and C, the slat skeleton members 1*b*1–1*b*3 generally formed in a U-shape (bending-form) are fastened at the flat side to the main slat member 1*a*. As illustrated in FIGS. 31A, B and C, the leg portions of the slat skeleton members 1*b*5–1*b*6 are fastened to the slat main members 1*a*, or the tubular slat skeleton members 1*b*4 are fastened to the slat main members 1*a*. The adjacent slat skeleton members 1*b*7–1*b*10 are overlapped, as shown in FIGS. 32A–D. Further, the slat skeleton members 1*b*11–1*b*13 may be modified as illustrated in FIG. 33A–D by successively varying the spacing between the slat skeleton members 1*b*11–1*b*13 fastened to the slat main members 1*a*, the length of the skeleton members, the thickness thereof, and combining these changes. Modified as such, the surface of the slat main members 1*a* is nearly flat so that it can be effectively utilized as a canvas for drawing pictures and for sticking photographs, posters, or the like, when necessary. This enhances the effective use of the shutter curtain 1. In this case, the shutter curtain 1 can be produced by using the slat main members 1*a* on which pictures are drawn in advance. Also, a buffer member may be adhered to the slat skeleton members 1***b* to protect them from being scratched. As stated above, since the shutter curtain 1 can be produced simply by fastening the slat skeleton members 1*b* to the slat main members 1*a* by means of adhering, or the like, equipment for producing the shutter curtain 1 can be simple, thereby enhancing operational and economical performances.

The overlapped-type shutter curtain 1 shown in FIGS. 32A–D has the advantages of improving heat-insulation and flame-proof properties in case of fire. Some of these types of shutter curtains can be further prevented from collapsing, which might be caused by the engagement of the slat skeleton members 1*b* due to the damage (by burning) of the slat main members 1*a* in case of fire, thus producing even better flame-proof properties.

The shutter curtain 1 produced by successively varying the spacing between the slat skeleton members, the length, or the thickness thereof offers the following advantages. When the shutter curtain 1 is wound on the drum as shown in the pattern in FIG. 33D, it can be configured as closely as possible to a spiral shape. Thus, the slat main members 1*a* cannot be forcibly bent, thereby effectively avoiding the resulting folds for the slat main members 1*a*.

The slat main members formed of a transparent or translucent material can be used as a daylight shutter. The slat main members can also be formed of various materials, such as a flexible-thin metal plate, for example, a spring steel plate, a synthetic resin film, or narrow woven materials. The fastening means of the slat main members and the skeleton members is not limited to adhering, but may employ suitable means such as welding, vis fastening, or the like, when necessary.

Still further, the shutter curtain 1 produced by overlapping the slat skeleton members 1*b*–14 as shown in FIGS. 34A–F may be constructed such that an incombustible foaming member 26, which is thermally foamed, intervenes between the slat main member 1*a* and the slat skeleton member 1*b*14. Such construction offers the following advantages. The shutter curtain 1 is usually thin so as to have a smaller winding diameter. However, in case of fire, or the like, a thick heat insulating layer between the slat main member 1*a* and skeleton member 1*b*14 is formed by foaming the foaming member 26, thus effectively obtaining good heat insulating properties.

Figure 37:
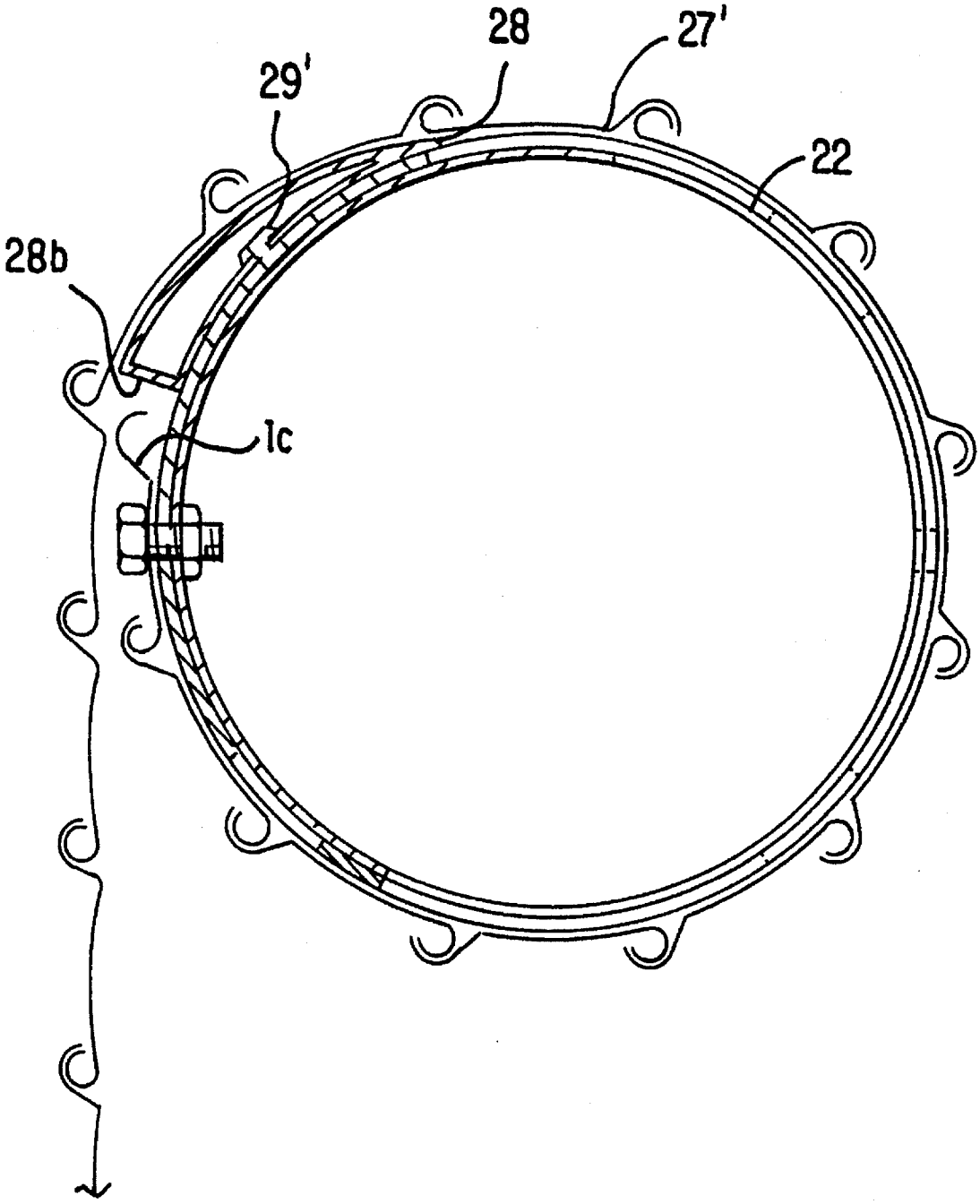
FIG. 37 is a schematic sectional view of the protecting band shown in FIG. 36.

Referring to FIGS. 35–37, the construction of interconnecting the winding wheel 22 and the shutter curtain 1 is described. Hanging members (which can be, for example, short pieces obtained by cutting a slat) 1*c* connected to the top end of the shutter curtain 1 are interconnected to the winding wheel 22, together with a shutter protecting band 27 fitted on the outside of the winding wheel 22. A protecting pad 28 is further provided for the protecting band 27 to adjust the winding shape of the shutter curtain 1. The protecting band 27 and the protecting pad 28 are formed of materials having surfaces that are at least safe from damaging the respective slats forming the shutter curtain 1. For example, the protecting band 27 and the protecting pad 28 can be made of a synthetic resin such as nylon, vinyl chloride, or the like. The protecting pad 28 is constructed to comprise a surface slanting 28*a* gradiently upward toward the hanging member 1*c* in the unwinding direction of the shutter curtain 1 and a difference in level 28*b* adjacent to the hanging member 1*c*. Thus, the shutter curtain 1 can be wound a second rotation without being damaged.

The protecting band 27 and the protecting pad 28 can be integrally attached to a desired position by selectively and disengageably engaging a snap-receiving hole 29*a* disposed on the inner surface of the protecting pad 28 with one of the projecting snaps 29 arranged on the outer surface of the protecting band 27 at predetermined spacing. A cut 31 generally formed in a U-shape surrounds the snap 29 to easily relieve or remove the unused snaps that do not engage with the snap-receiving hole 29*a*. The remaining side of the U-shaped cut 31 may be perforated so that the snaps can be cut more easily. The cuts 31 are not necessary if the snaps 29 are formed with projections to such a degree that they do not interfere with winding the shutter curtain 1.

Moreover, fixing holes 32 for receiving the hanging members 1*c* are circumferentially provided at predetermined spacing for the protecting band 27. Therefore, no matter where the protecting pad 28 is attached, the hanging members facing opposite to each other do not engage due to the difference in level 28*b*.

As shown in FIG. 36, the protecting band 27' and the protecting pad 28 may be modified as follows. A recess groove 27*a* having a width equivalent to that of the protecting pad 28 is circumferentially formed on the outer surface of the protecting band 27'. The snap 29' is arranged not to project from the recess groove 27*a*. Thus, the protecting pad 28 attached to the protecting band 27' via a snap can be supported at both ends by the recess groove 27*a*. As a result, the protecting pad 28 can be reliably prevented from displacement caused by rotating around the position for receiving the snap, which might be caused by a vibration in winding the shutter curtain 1 on and off. Further, it is not necessary to cut the unused snaps 29'.

Figure 38:
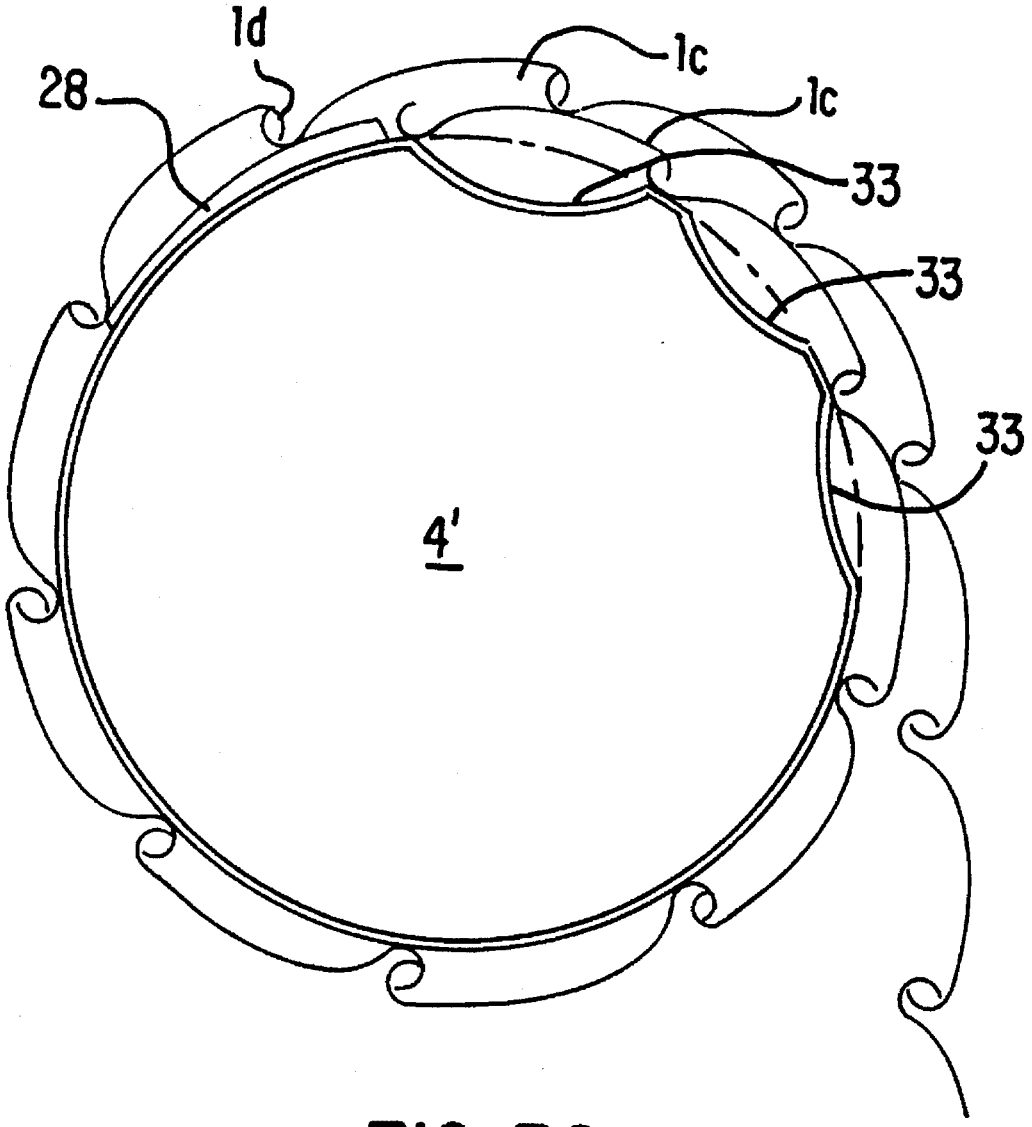
FIG. 38 is a schematic drawing of a pattern of a winding drum.
Figure 39:
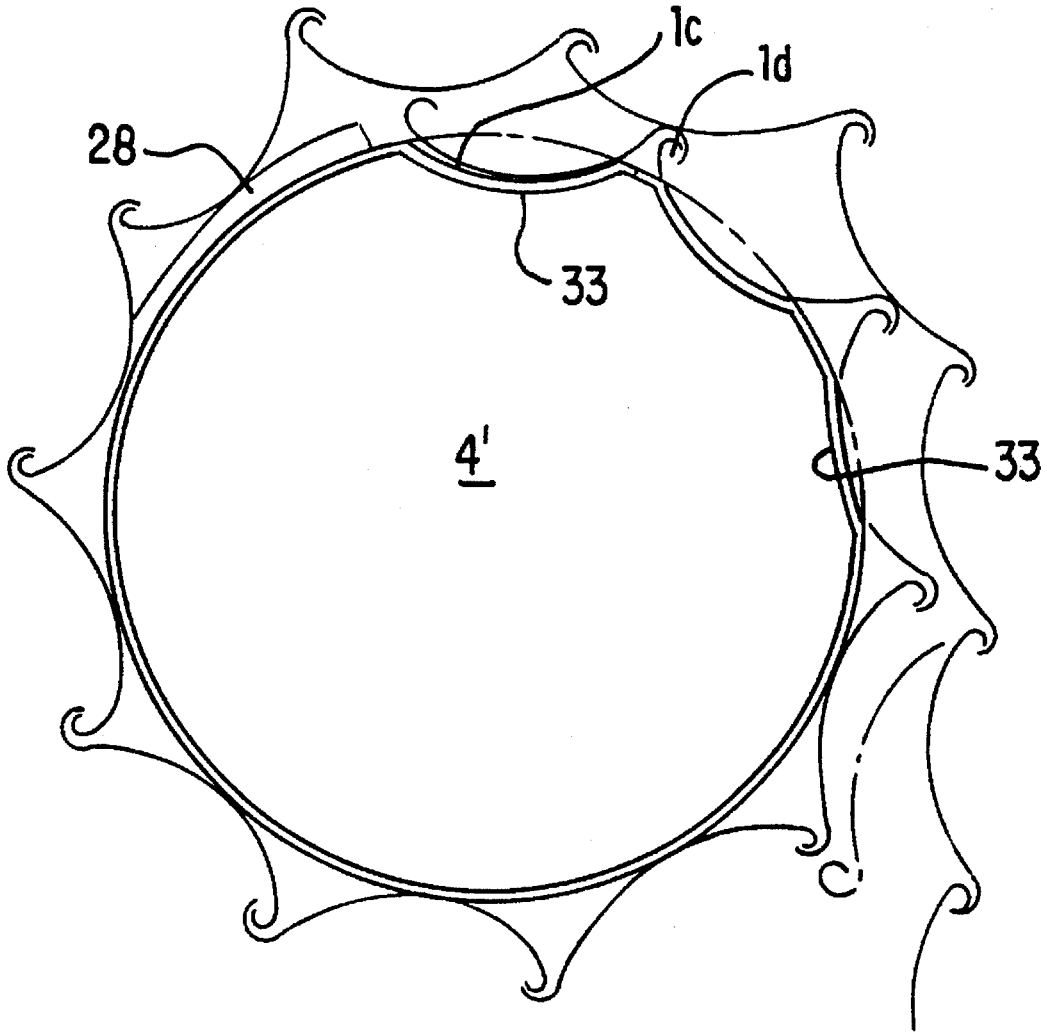
FIG. 39 is a schematic drawing of a pattern of the same winding drum as FIG. 38.
Figure 40:
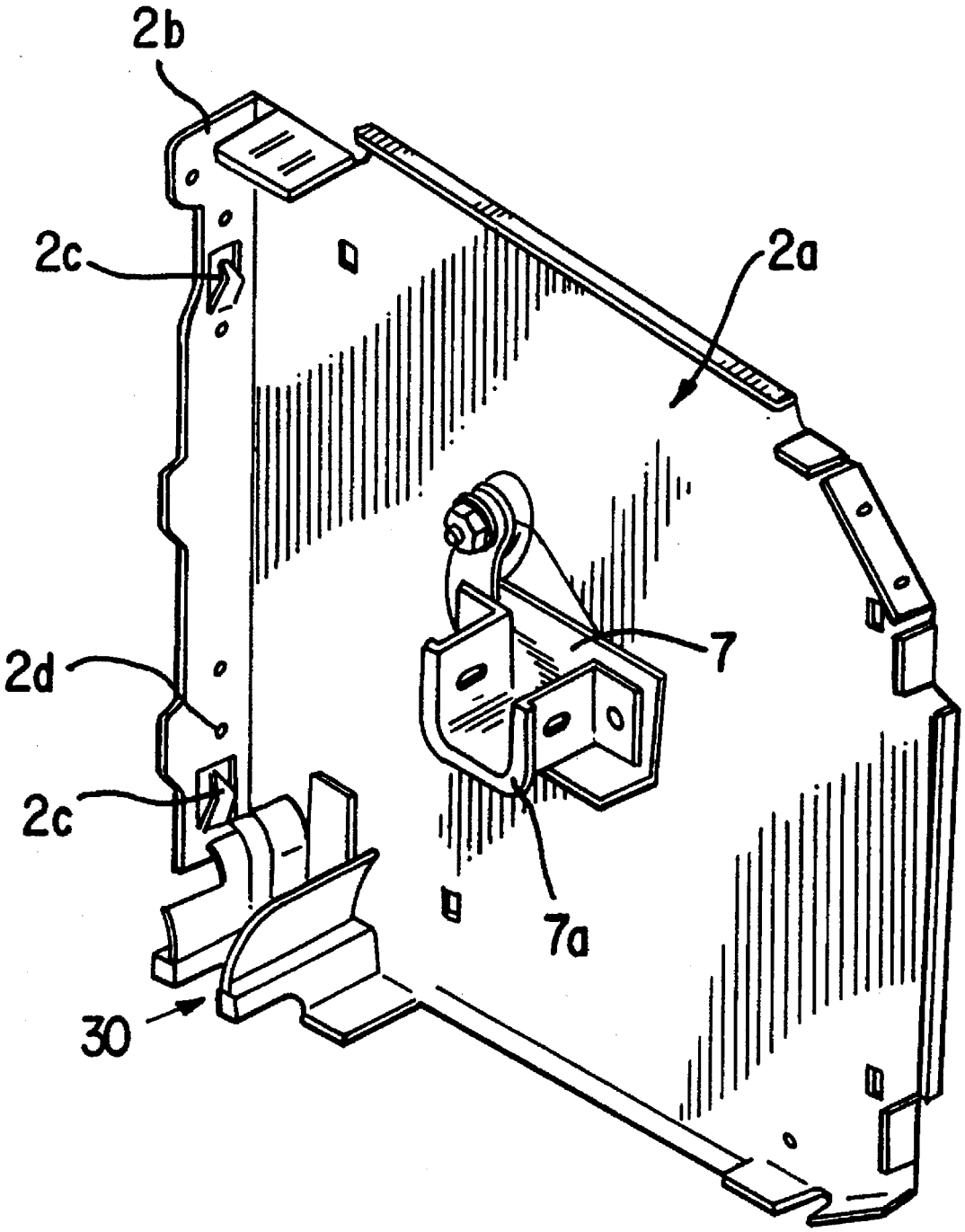
FIG. 40 is a perspective view of a side wall of a shutter case.

As illustrated in the embodiment of FIGS. 38 and 39, in the interlock-connecting type shutter curtain 1, recesses 33 corresponding to the shape of the slats of the shutter curtain 1 can be disposed on the outer surface of the winding drum 4'. The bending portions of the hanging members 1*c* (or the slats) are adapted to fit into the recesses 33 in the unwound state of the shutter curtain 1, as illustrated in FIG. 39, thereby adjusting the winding diameter of the shutter curtain 1. In this case, since the plurality of recesses 33 are formed to be successively shallower, the winding diameter can be adjusted even more properly, thus avoiding a sudden increase in the winding diameter. The shutter curtain 1 is wound such that the interlock-connecting portion 1*d* abuts between the neighboring recesses 33. Hence, the recesses 33 are not directly dependent on the winding of the shutter curtain 1.

The shutter case 2 is shown in detail in FIGS. 40–43. The shutter case 2 is arranged at the top of the building opening in which the shutter curtain 1 is accommodated so as to be wound on the winding drum 4. Prior to the shutter case 2 being integrally secured to the building or a support member, a pair of right and left side walls 2*a* forming the shutter case 2 are integrally attached to the support. The bearing plates 7 are each swingably supported by the side wall 2*a*, and the flare shutter guides 30 are integrally arranged for guiding the right and left ends of the shutter curtain 1, which is wound on the winding shaft 3 within the guide grooves of the guide rails 5.

A securing portion 2*b* is formed at the rear edge of the side wall 2*a* and secured to the support by utilizing fasteners (not shown) such as nails or the like. Temporary retaining projections 2*c* are formed on the top and bottom ends of the securing portion 2*b* to bypass holes 2*d* for receiving the fasteners and to avoid interference with the winding of the shutter curtain 1. The temporary retaining projections 2*c* are cut and raised so that they comprise sharp top edges 2*e* and bending portions 2f that prevent the projections 2c from interfering with the securing portion 2b abutting with the support. Prior to securing the side walls 2a to the support by driving the fasteners, the side walls 2a can be temporarily retained by driving the temporarily projections 2c into the support. Subsequently, the side walls 2a are screwed to the body via fasteners by a tool, thus completing the securing operation. That is, since the side walls 2a can be temporarily retained without requiring a difficult operation such as driving the fasteners while supporting the side walls 2a, a bracket securing operation can be performed extremely easily and safely. This operation can be conventionally performed while holding the side walls 2a, bonding members and a tool in both hands at a high place. As a result, operational performance and safety in accordance with the operation of securing the side walls 2a can be remarkably enhanced. Also, the operation of positioning the side walls 2a is simplified.

Figure 41:
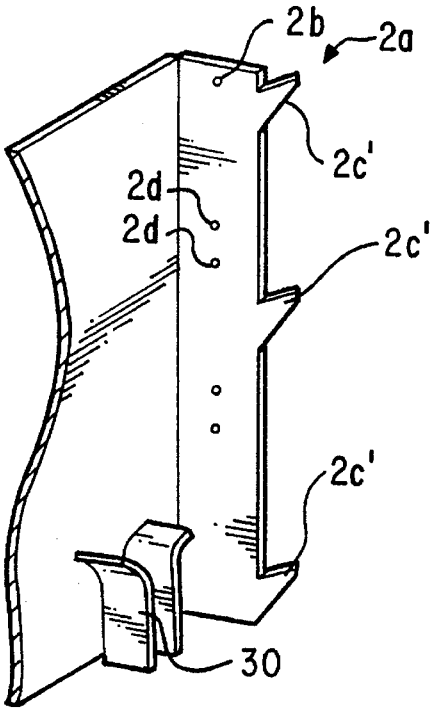
FIG. 41 is a partial perspective view of the side wall of FIG. 40.
Figure 43:
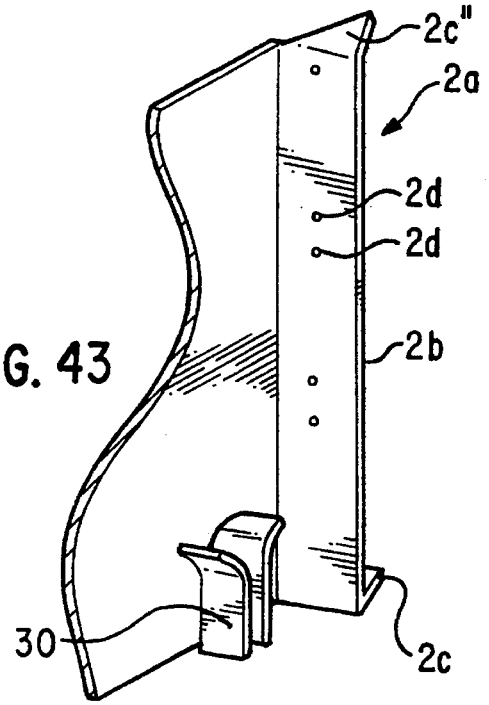
FIG. 43 is a partial perspective view of the side wall of FIG. 40.
Figure 42:
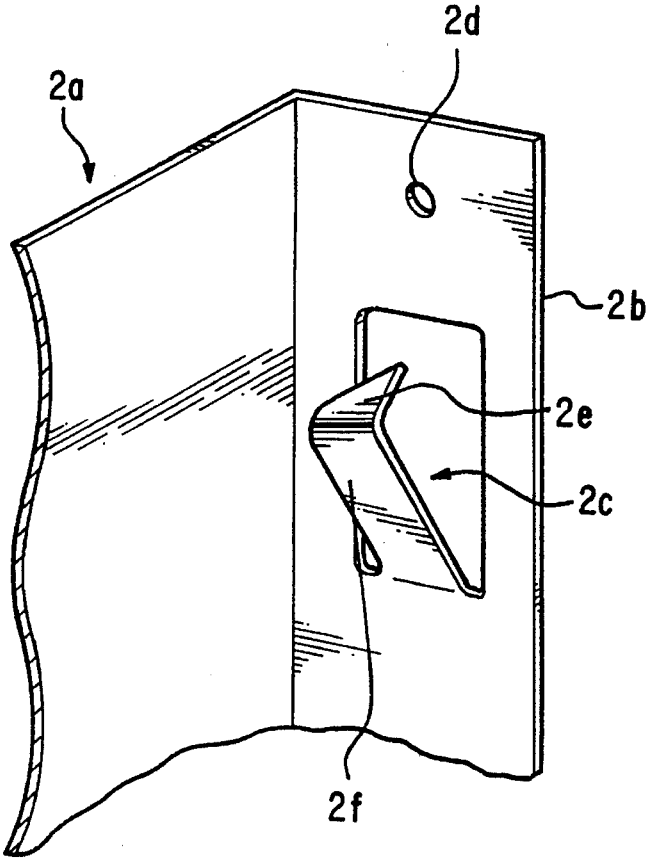
FIG. 42 is a partial perspective view of the side wall of FIG. 40.
Figure 44:
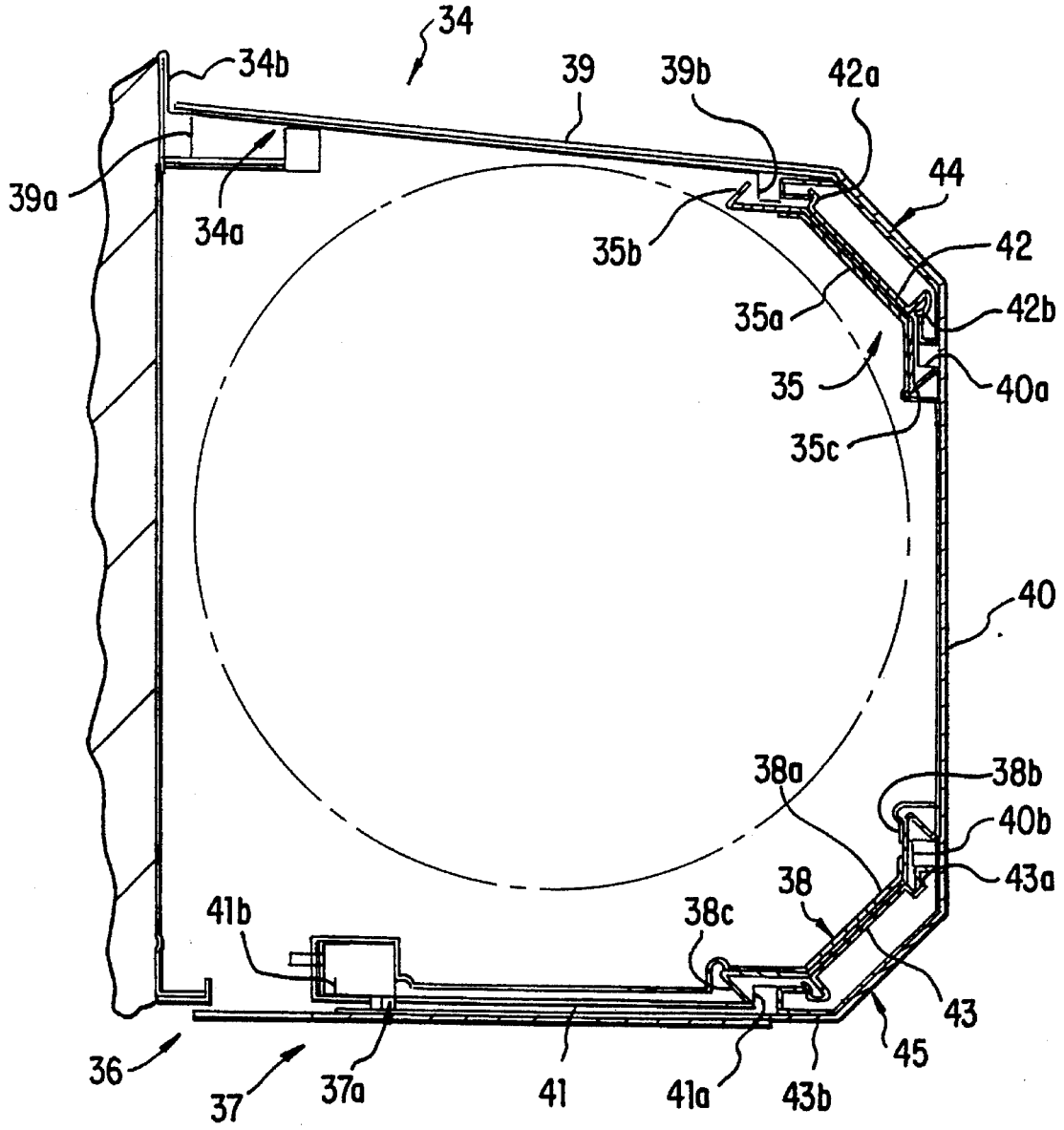
FIG. 44 is a sectional view of the shutter case.
Figure 45:
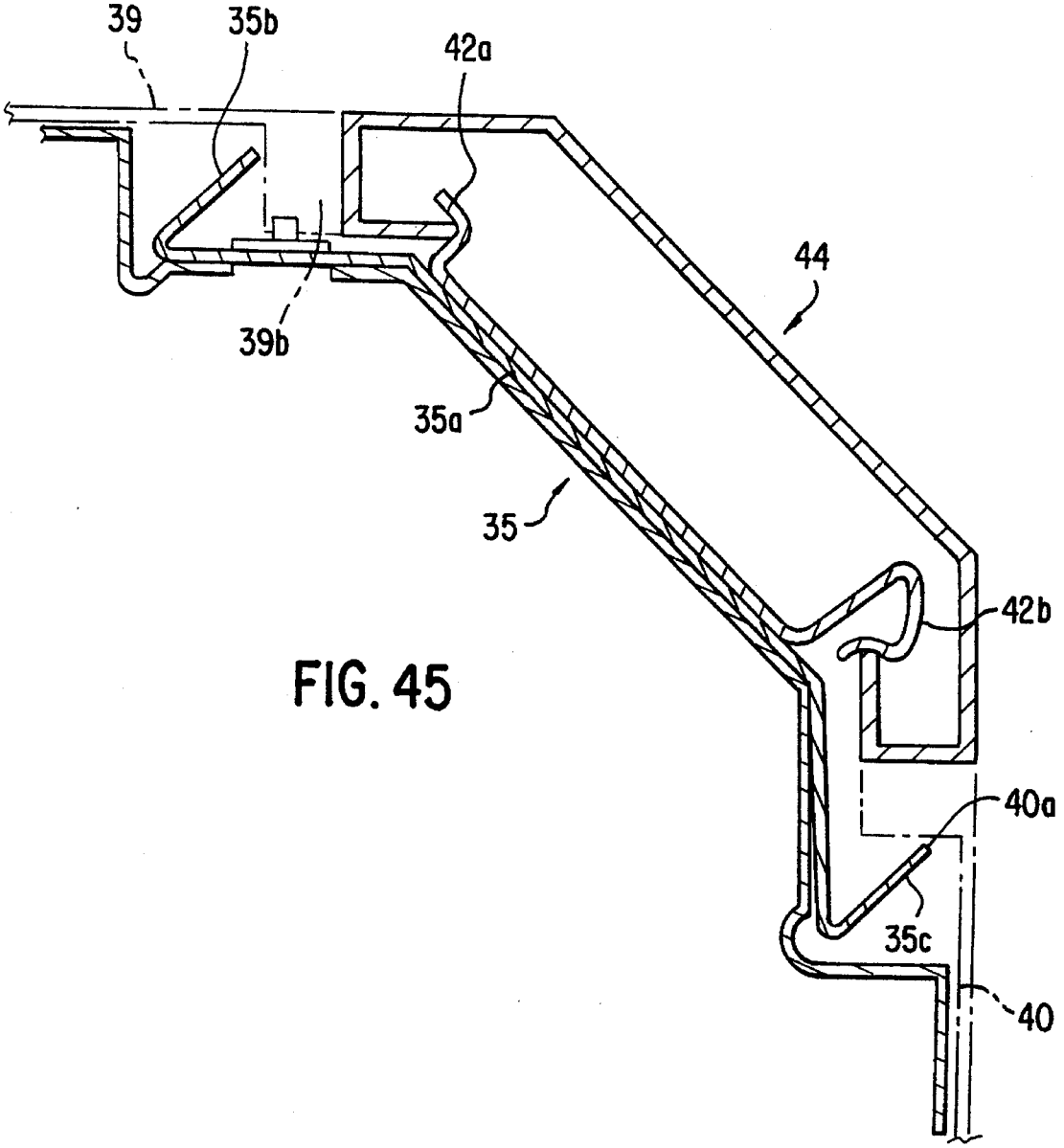
FIG. 45 is an enlarged sectional view of the shutter case of FIG. 44.

The temporary retaining means for temporarily retaining the side walls 2a may be constructed such that the temporary retaining projections 2c are formed on the upper and lower edges 2c of the securing portion 2b or on the top and bottom edges 2c of the securing portion 2b, as shown in FIGS. 41–43.

Referring to FIGS. 44–47, the shutter case 2 is constructed as follows. First and second case angles 34 and 35 are arranged on the upper portion of the respective right and left side walls 2a secured to the support as stated above such that the case angles 34 and 35 are positioned on a portion adjacent to the body (hereinafter referred to as the body side) and a portion adjacent to the exterior (hereinafter referred to the exterior side), respectively. Also, inner and outer lintel frames 36 and 37 positioned on the lintel of the lower portion of the side wall 2a and five angle frame members for a third case angle 38 positioned on the exterior side of the lower portion of the side wall 2a are disposed to frame these case angles 34, 35, 36, 37 and 38 with plates 39, 40 and 41. Thus, the shutter case 2 is assembled. That is, the top, bottom and front portions of the shutter case 2 are covered with the top case plate 39 supported between the first and second case angles 34 and 35, the front case plate 40 supported between the second and third case angles 35 and 38, and the bottom case plate 41 supported between the third case angle 38 and the outer lintel frame 37.

The construction of the respective case plates 39, 40 and 41 for assembly is as follows. The first case angle 34 is formed as a hollow having a generally quadrilateral section by, for example, roll-forming a band-like steel plate (the remaining angles are formed in a similar manner 346.) It has an opening 34a at the front top portion and a surface which will be attached to the support projecting upward adjacent to the interior. The second case angle 35 comprises a slant surface 35a gradiently slanted toward the front and a supporting surface 35b arranged above the slant surface 35a, which is bent toward the interior with a top end bent upward to generally form in a V-shape. Another supporting surface 35c is arranged below the slant surface 35a, which is bent downward with a top end bent toward the front to generally form a V-shape. The third case angle 38 is also shaped in a manner similar to the second case angle 35. The outer lintel frame 37 is formed as a hollow having a generally quadrilateral section and has an opening 37a at the front bottom portion. The outer lintel frame 37 is generally formed in an L-shape.

Further, fixing plates 42 and 43 are integrally attached to the exterior sides of the slant plates 35a and 38a of the second and third case angles, respectively. These fixing plates 42 and 43 have crank-shaped first retaining portions 42a and 43a at one end and second retaining portions 42b and 43b bent in an R-shaped, respectively, at the other end.

The top case plate 39 is formed of a bending portion 39a adjacent to the interior, the end close to the body of which is bent downward to generally form in an L-shape. Another bending portion 39b is formed adjacent to the exterior, the end close to the exterior of which is bent downward and the top end of which is further bent forward to form a crank-shape as viewed from the side of the shutter case 2. The front case plate 40 includes a crank-shaped upper bending portion 40a and a lower bending portion 40b at the top and bottom ends. Moreover, the bottom case plate 41 comprises a crank-shaped bending portion 41a adjacent to the exterior at one end close to the exterior, and a bending portion 41b adjacent to the interior, which is bent upward to generally form in an L-shape, at the other end close to the interior. The top case plate 39 is temporarily supported between both the angles 34 and 35. The bending portion 39a adjacent to the interior is inserted from the opening 34a of the first case angle 34 and the other bending portion 39b adjacent to the exterior is laid on the supporting surface 35b of the second case angle 35. The front case plate 40 is formed such that the upper bending portion 40a is retained by the supporting surface 35c of the second case angle 35 and the lower bending portion 40b is retained by the upper supporting surface 38b of the third case angle 38.

Figure 47:
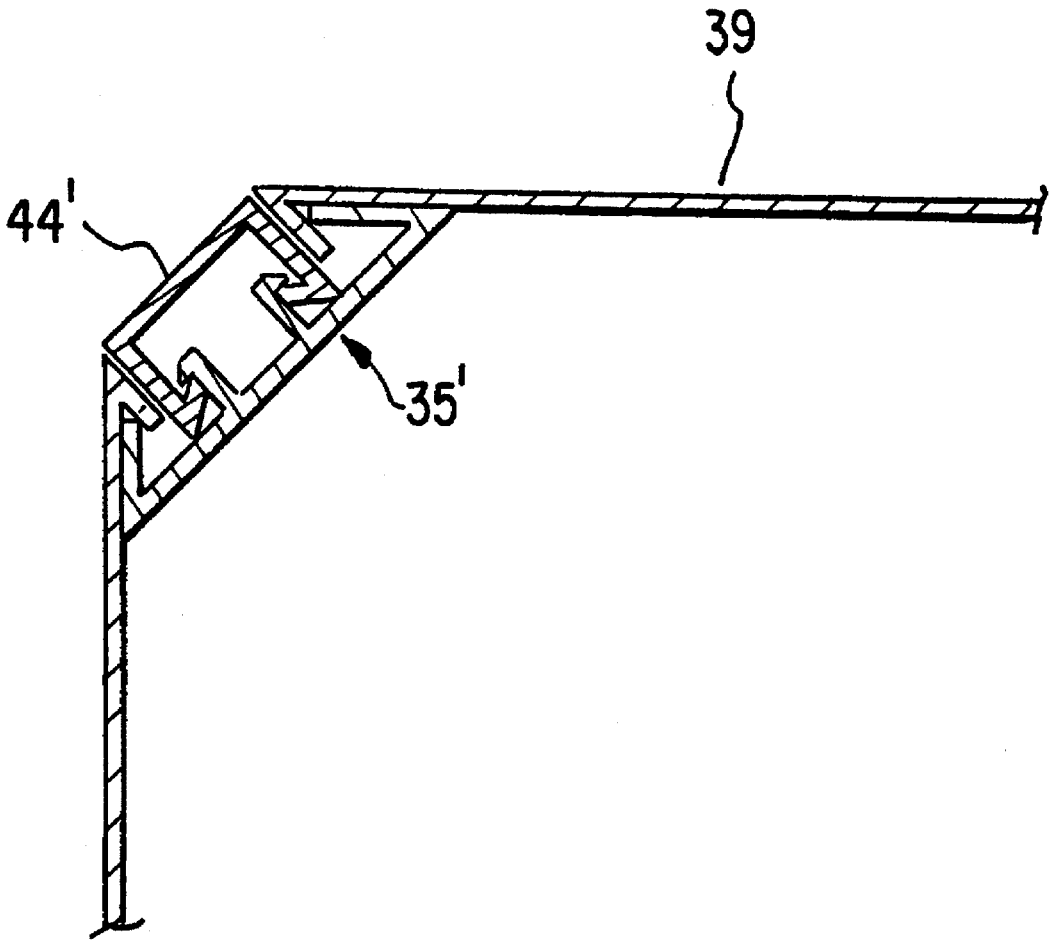
FIG. 47 is a partial side view of the shutter case of FIG. 44.

As seen in FIG. 47, a corner member 44 having bent ends that generally form in a U-shape is forced into the fixing plate 42 from the outside. Thereby, the corner member 44 abuts and supports the top end of the bending portion 39b adjacent to the exterior of the top case plate 39 and the upper end of the front case plate 40 against each other for fastening. Likewise, the lower end of the front case plate 40 and the end adjacent to the exterior of the bottom case plate 41 are supported and fastened by a corner member 45. The end adjacent to the interior of the bottom case plate 41 is supported by inserting the bending portion 41b close to the interior into the outer lintel frame 37 in a manner similar to the top case plate 39. Thus, the respective plates 39, 40 and 41 of the shutter case 2 are integrated into the respective case angles 34, 35, 37 and 38 from outside. The corner members 44 and 45 are forced into the fixing plates 42 and 43, respectively, thus completing the assembly of the shutter case 2.

The shutter case 2 may be modified by the following constructions. The second and third case angles 35' and 38 are shaped as shown in FIG. 47, and the corner members 44' and 45 are pushed from the outside to the case angles 35' and 38, respectively. The corner members 44' and 45 are detachable from the case angles 35' and 38 and may be formed in various shapes to be freely changed as desired. The latter modification has the advantage of freely changing the design of the shutter case 2.

In the shutter case 2 constructed above, the top case plate 39 is mounted on the first and second case angles 34 and 35 arranged adjacent to the interior and exterior. The bottom case plate 41 is mounted on the outer lintel frame 37 and the third case angle 38 arranged adjacent to the interior and exterior. In the top case plate 39, the bending portion 39a adjacent to the interior is inserted from the opening 34a disposed on the first case angle 34 to move freely forward and backward (along the interior and exterior dimension.) Consequently, even though the fitting surface of the body is uneven, the shutter case 2 can be secured to the body by moving and adjusting the first case angle 34 forward and backward relative to the shutter case 2. Thus, the degree of freedom for attaching the shutter case 2 is remarkably improved, further enhancing operational performance.

Preferably, tapping screws are not employed for the case plates 39, 40 and 41 for mounting on the case angles 34, 35, 37 and 38. Instead, the bending portions of the case plates are simply inserted into the openings to be freely moved forward and backward and adjusted and the other bending portions are laid on the case angles to support the case plates. Then, the corner members 44 and 45 are pushed into the case angles 35 and 38. Therefore, fastening holes are not necessary, thus effectively avoiding the acceleration of corrosion that might be created therefrom and the leakage of rain into the cases. This further improves the protection of the shutter case 2 and also enhances the durability of the winding drum 4, the shutter curtain 1 and a driving device, such as a motor (not shown), against rain.

Figure 46:
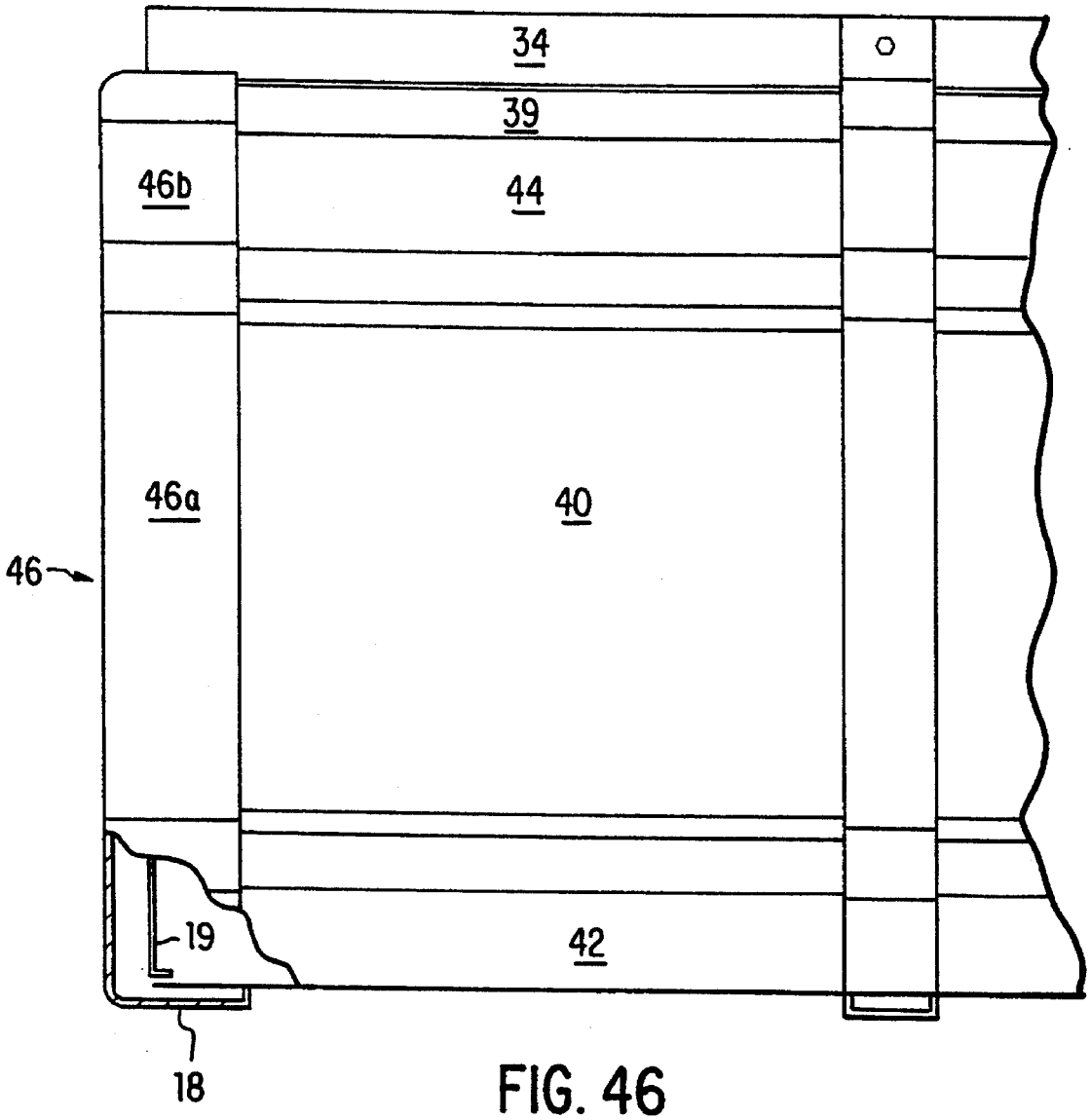
FIG. 46 is a partial front view of the shutter case of FIG. 44.
Figure 48:
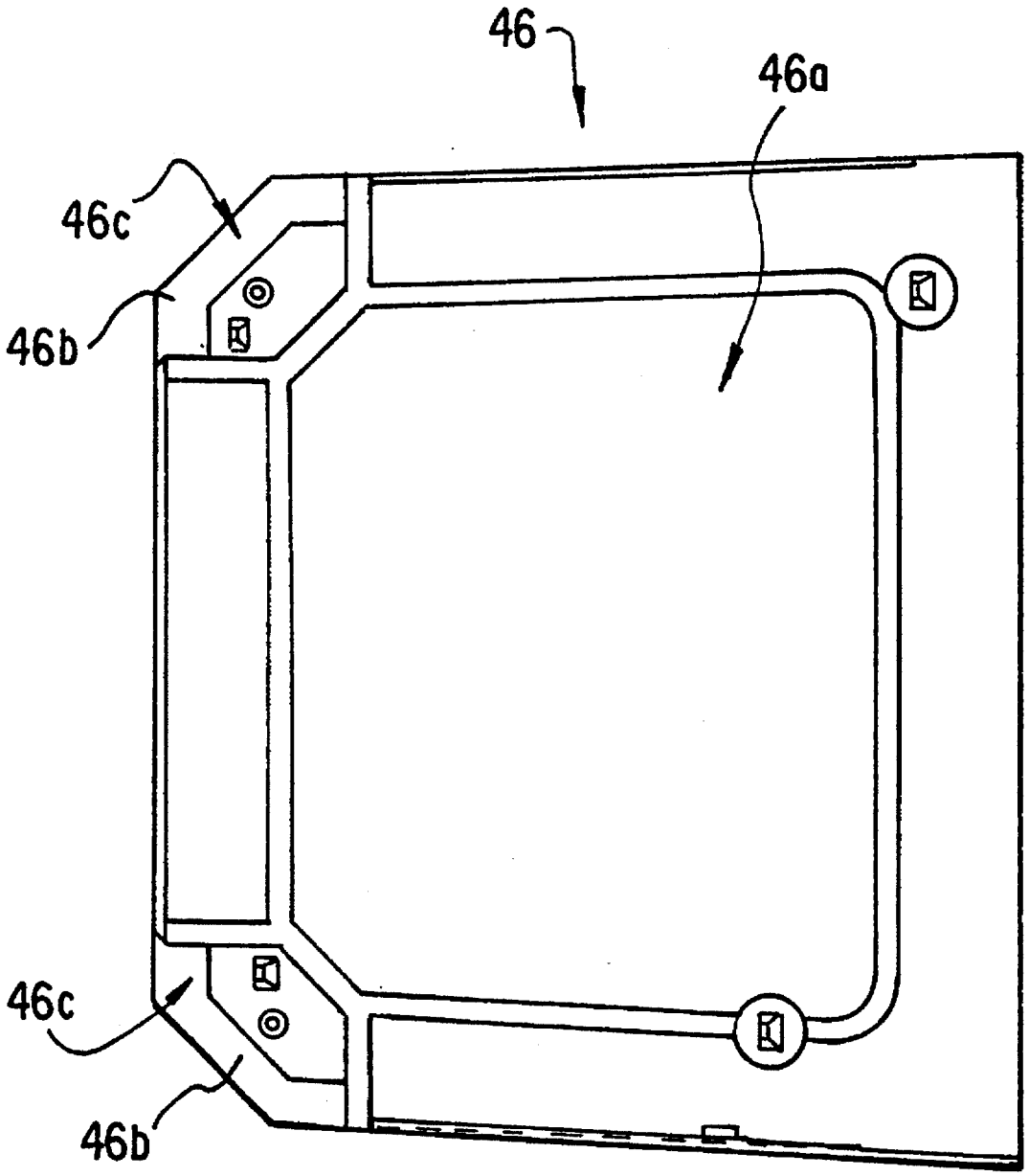
FIG. 48 is a side view of a side cover.
Figure 49:
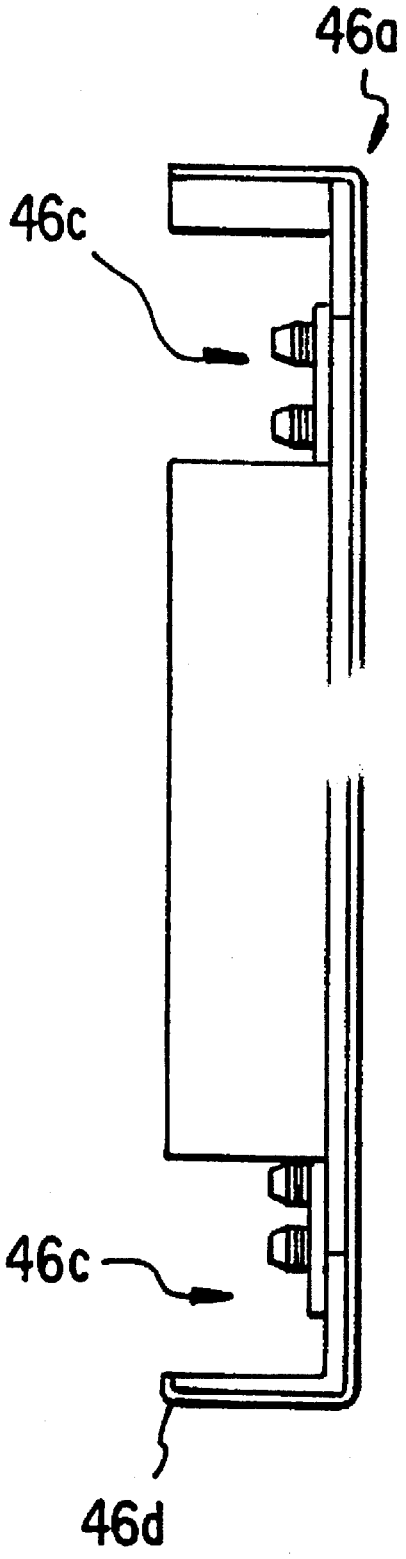
FIG. 49 is a front view of the side cover of FIG. 48.
Figure 50:
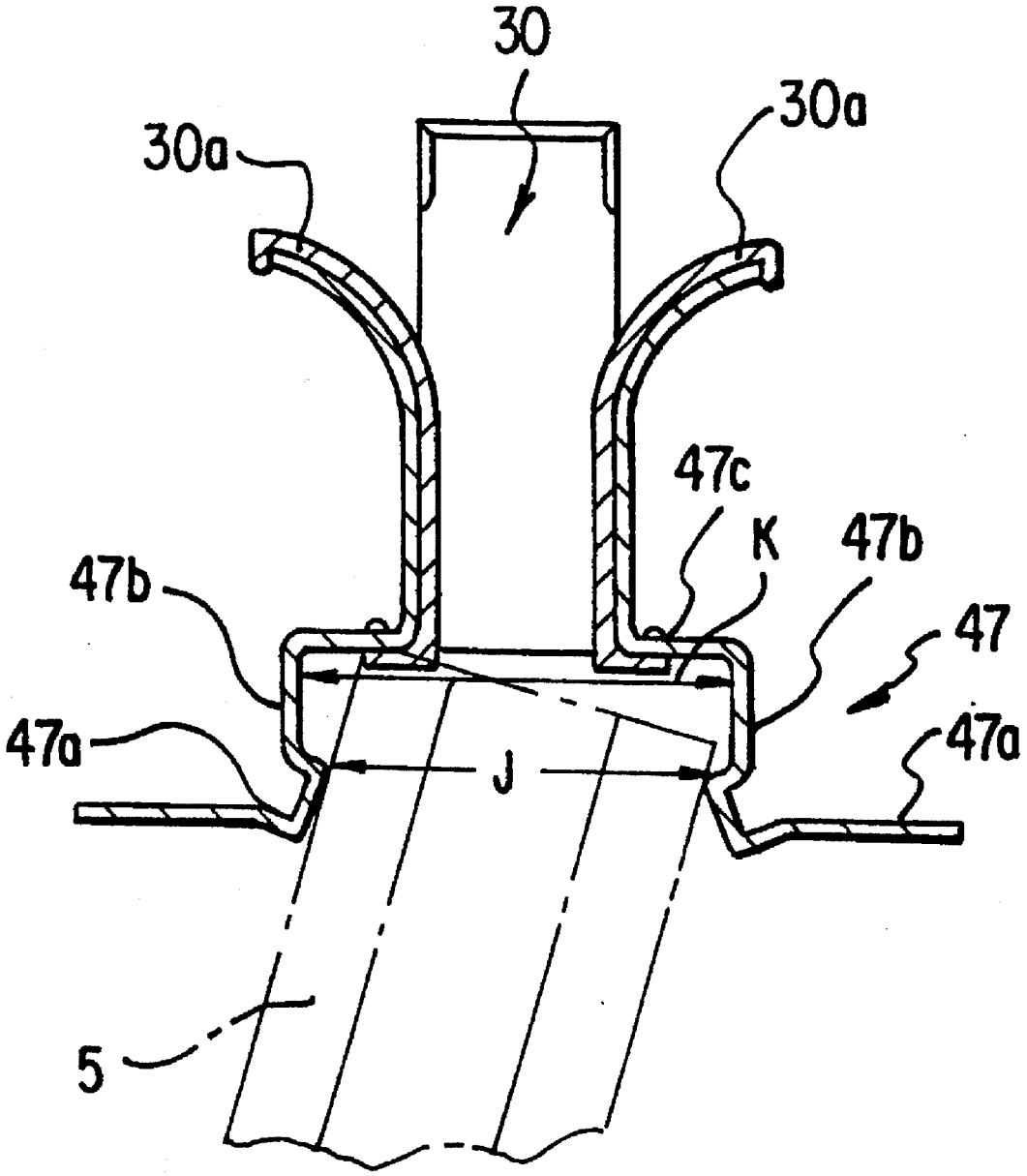
FIG. 50 is a sectional view of a shutter guide.

Shown in FIG. 46, 48 and 49, side covers 46 cover the right and left side walls 2*a* from outside in which top, front and bottom case plates 39, 40 and 41 are assembled and supported, thus completing the assembly of the shutter case 2. The side covers 46 each comprise a side cover body 46*a* covering the side wall 2*a* and corner covers 46*b* covering the corner members 44 and 45, respectively. The corner covers 46*b* have two portions having recesses shown generally at 46*c* formed on the side cover body 46*a* in advance, thus firmly connecting the corner covers 46*b* to the side cover body 46*a*. Subsequently, a bottom surface 46*d* of the side cover body 46*a* is screwed into the bottom surface of the side wall 2*a*. The corner covers 46*b* of the side cover 46 are preferably formed of hard plastics or a light alloy, and can be decorative from an aesthetic point of view by varying the colors. Thus, the arrangement of the side cover 46 prevents the right and left ends of the respective case plates 39, 40 and 41 from being directly exposed to the outside, thereby further improving the anti-corrosiveness.

Referring to FIGS. 50–53, the shutter guides 30 are arranged on the lintel portions of the shutter case 2. The shutter guides 30 arranged on either side of the shutter case 2 each generally have a flare section opening gradiently upward. A pair of guide portions 30*a* are integrally formed on the upper end of the shutter guide 30 to guide the shutter curtain 1 pulled out from the winding drum 4. An insertion guide 47 is integrally formed on the lower end of the shutter guide 30 such that the lower portion is open and formed in a recess groove. The backward portion of the groove on the upper portion lead to the guide portions 30*a*, thereby enabling the insertion of the upper end of the guide rail 5 from the inlet of the lower portion of the insertion guide 47. The groove portions forming the groove along a front and rear dimension (the right and left dimension in FIG. 50) is determined such that the width of inlet portions 47*a* positioned on the inlet side is substantially equivalent, or slightly wider than the width J of the guide rail 5. The width K of backward portions 47*b* positioned on the backward groove side is greater than the width J of the guide rail 5 (J<K). Thus, the insertion guide 47 is formed in an ant's nest shape. The upper end of the guide rail 5 can be inserted obliquely along a front and rear dimension, preventing the corner portion on the upper end of the guide rail 5 from being caught by the groove portion. The guide rail 5 with the upper end inserted is raised vertically so that it can be inserted into the insertion guide 47 and positioned by the inlet portions 47*a* forming a narrow width therebetween. Also, a guide surface 5*a* of the guide rail 5 shown in FIG. 52 and the guide portions 30*a* of the shutter guide 30 precisely match each other, thereby communicating therewith and further improving the opening and closing of the shutter curtain 1 remarkably.

Figure 51:
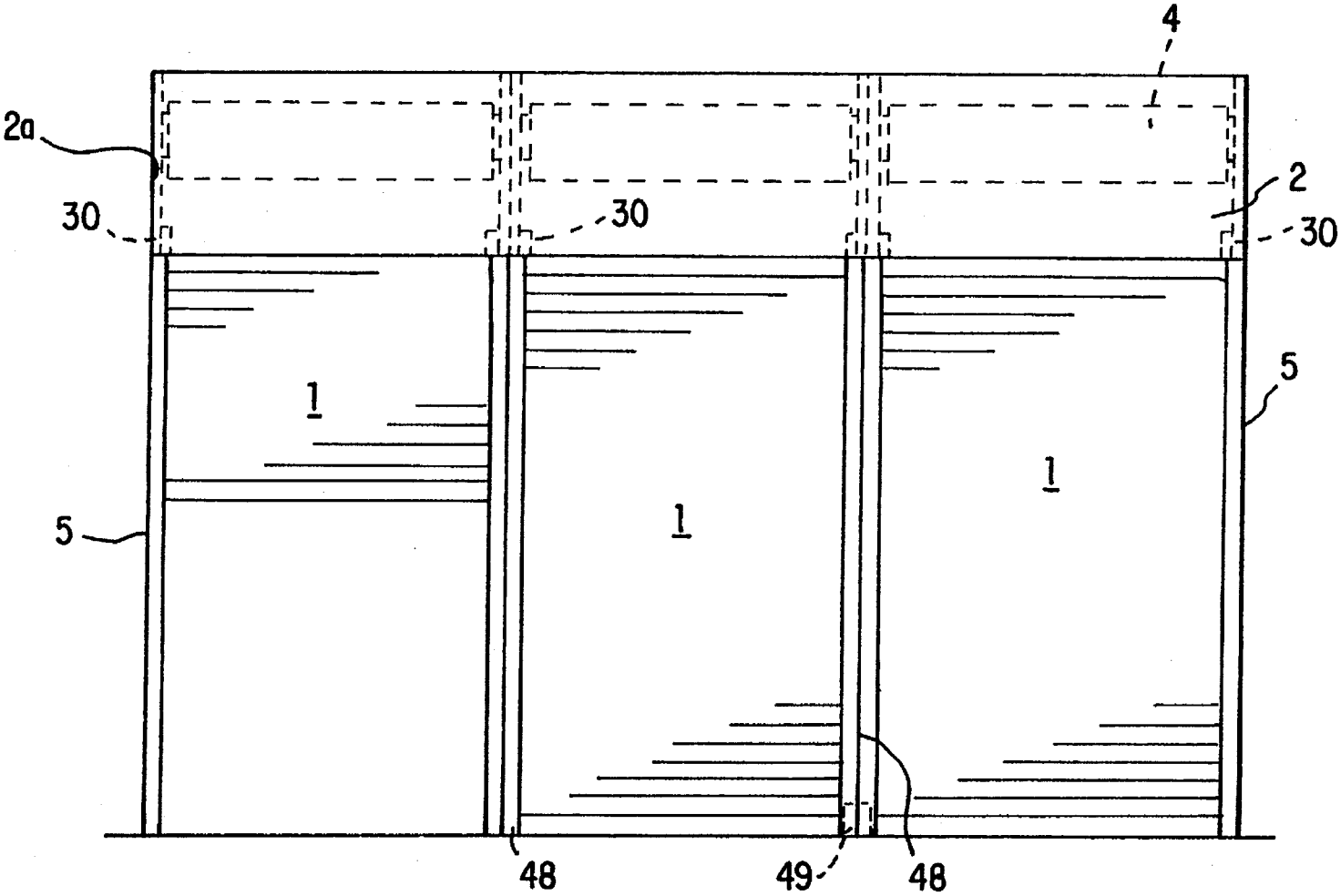
FIG. 51 is a schematic front view of a shutter.
Figure 52:
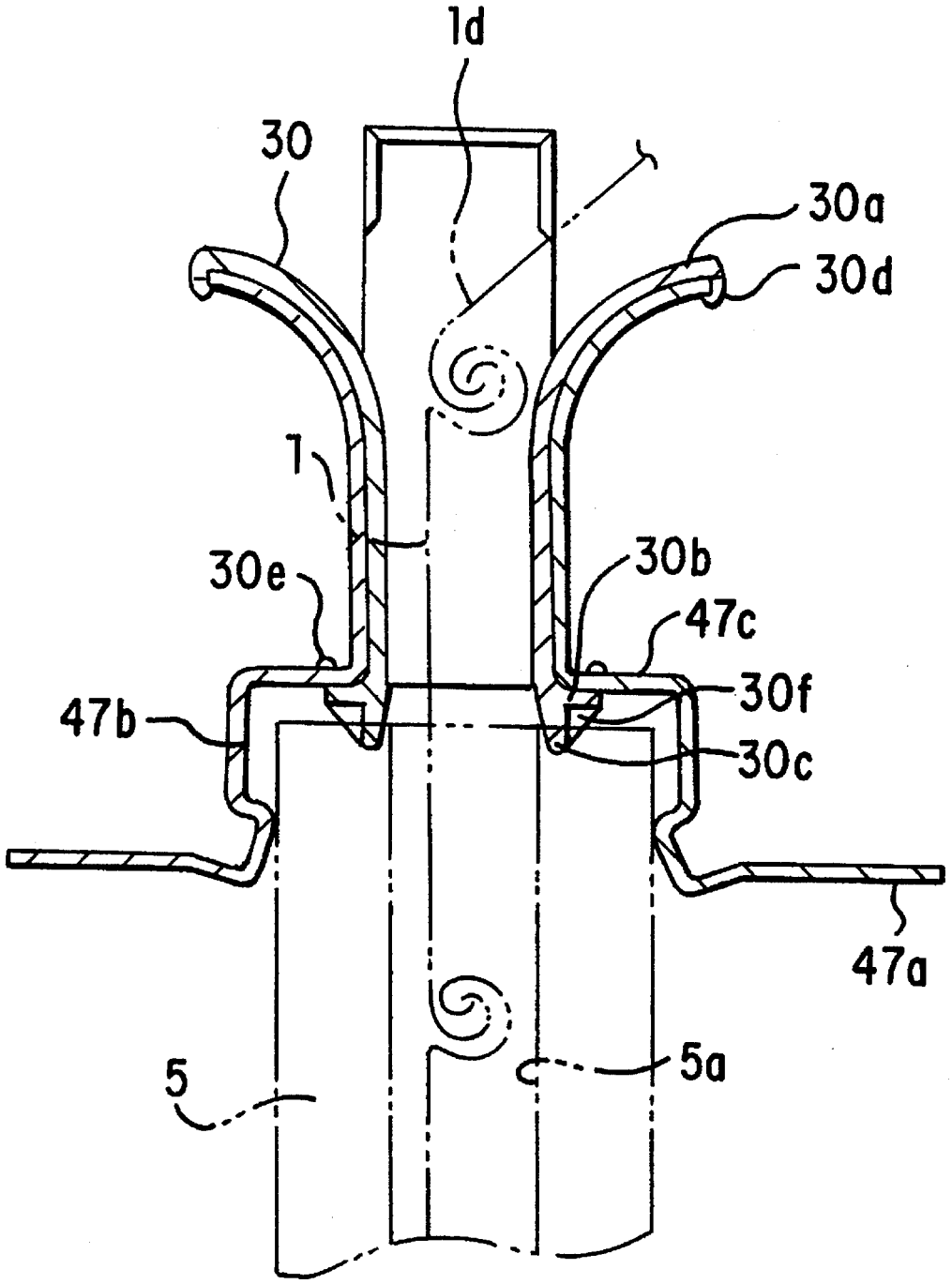
FIG. 52 is a sectional view of the shutter guide of FIG. 51.
Figure 53:
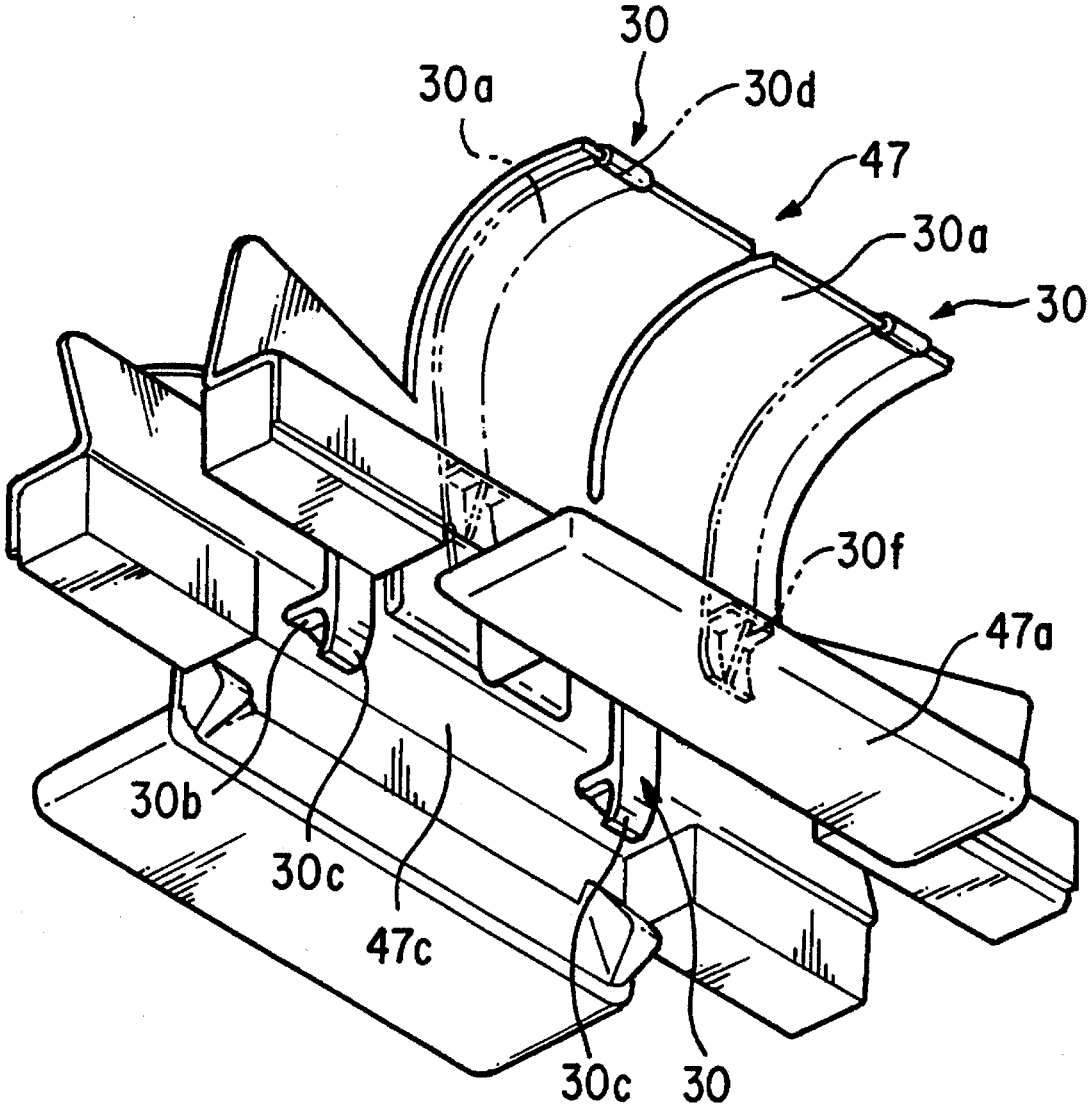
FIG. 53 is a perspective view of the shutter guide of FIG. 52.

The shutter guides 30 are preferably formed of a resin material to prevent the damage of the shutter curtain 1. In this case, as shown in FIGS. 51–53, the shutter guides 30 each comprise the guide portions 30*a*, retaining portions 30*b* bending outward from the bottom end of the guide portions 30*a* and extending along groove bottom surfaces 47*c* of the insertion guide 47, and spanning portions 30*c* that project from the bottom end of the guide portions 30*a* to the insertion guide 47 to have gradually greater width facing the insertion guide 47 and spanning the guide rail guiding surface 5*a*. The guide rail 5 is made shorter in order to compensate for various possible errors, and thus troublesome cutting operations of the guide rails are not necessary where the shutter curtain is opened and closed. In such a shutter guide, when a gap having a different level is produced between the guiding surface 5*a* and the guide portions 30*a*, it is spanned with the spanning portion 30*c* as if it were a bridge, thereby avoiding a projection, such as an interconnecting portion for interconnecting two slats, from being inserted into the gap.

Further, retaining portions 30*d* for retaining the shutter guide 30 and retaining projections 30*e* are formed on the guide portions 30*a* and the retaining portions 30*b*, respectively. Reinforcing ribs 30*f* are also each arranged at the corner between the retaining portion 30*b* and the spanning portion 30*c*. The insertion guide 47 for receiving the upper end of the guide rail 5 is formed in an ant's nest shape to make the width between the backward portions 47*b* greater than that between the inlet portions 47*a*, thereby enabling the oblique insertion of the guide rail 5. When such guide rails are used for middle posts 48 required for the shutter curtain 1 shown in FIG. 51, the middle posts 48 can be simply attached and detached, and also be easily and precisely positioned.

Figure 54:
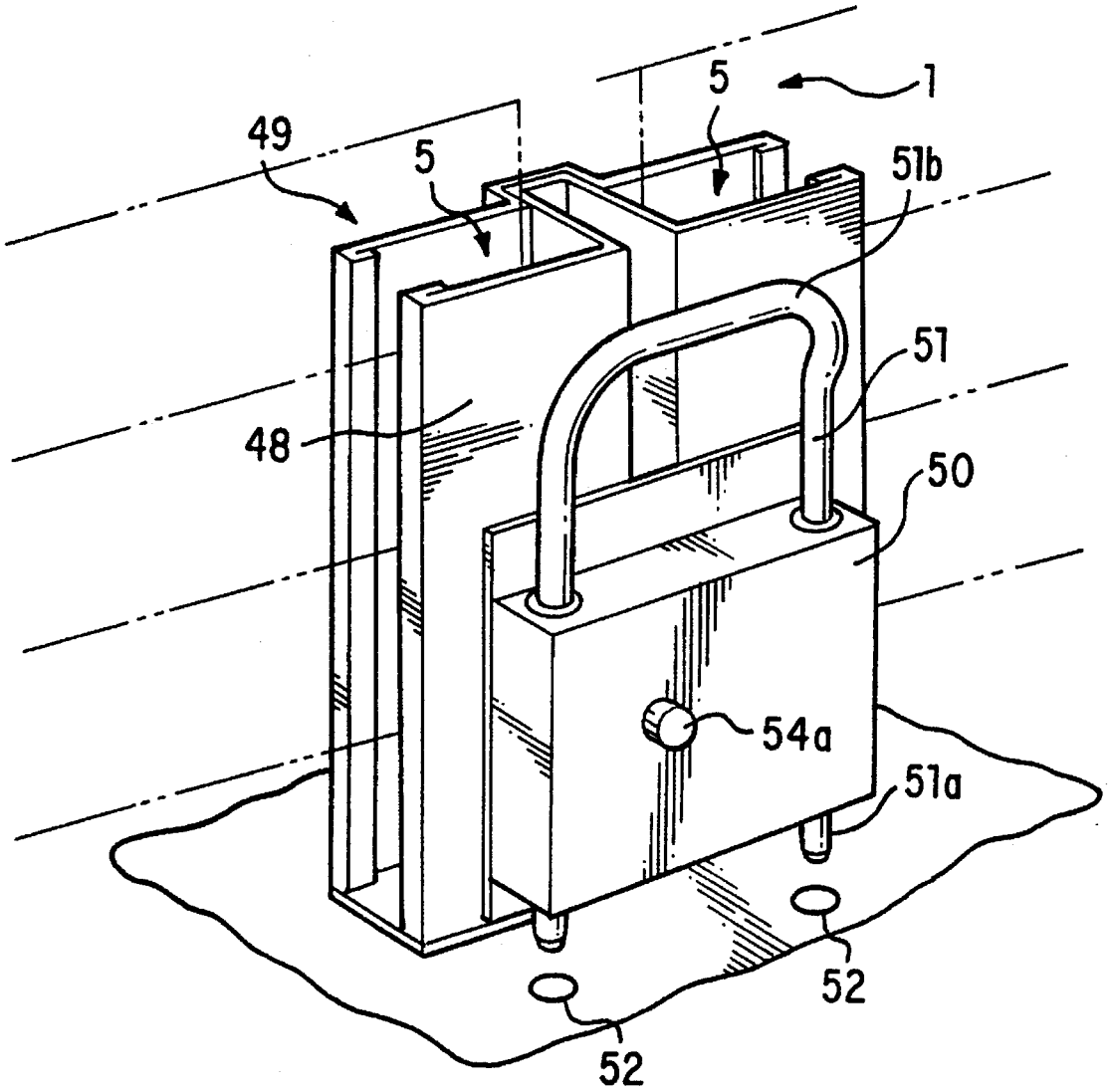
FIG. 54 is a perspective view of a locking device.
Figure 55A:
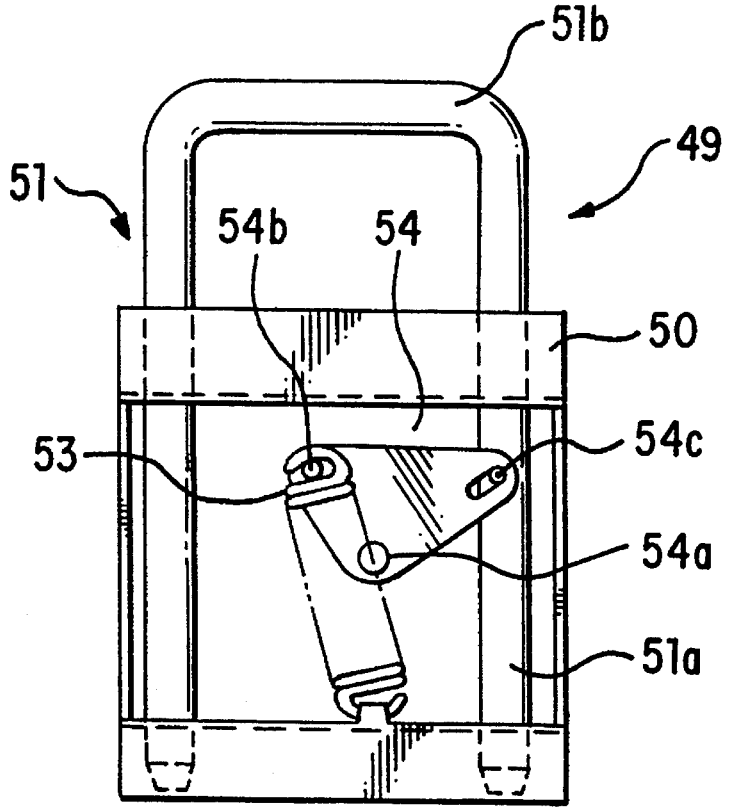
FIG. 55A is a front view of an unlocked state of the locking device.
Figure 55B:
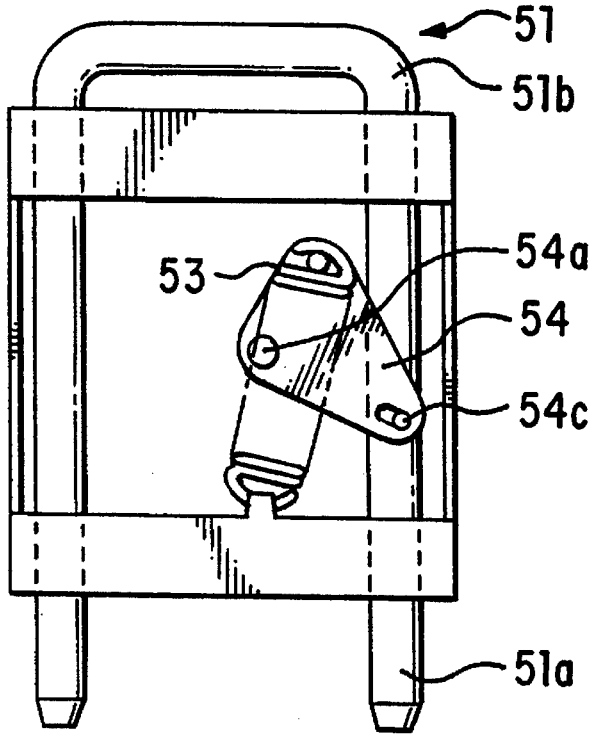
FIG. 55B is a front view of a locked state of the locking device.

Shown in FIGS. 54–56B, a locking device can be disposed on the middle post 48 when the shutter curtains used for a building are connectingly fitted together. As illustrated in FIGS. 54 and 55, a locking device 49 is constructed with legs 51*a* of a U-shaped drop rod 51 slidably upwardly and downwardly inserted into an accommodating case 50 arranged on the interior side at the bottom of the middle post forming the guide rails 5 on either side. A handle 51*b* of the drop rod 51 is pushed and pulled, thereby disengageably fitting the top ends of the legs 51*a* of the drop rod 51 into engaging holes 52 disposed on the surface for placing the shutter. Hence, the locking device 49 can be locked and unlocked.

A coil spring 53 urging the drop rod 51 is swingably connected at one end via a pin 54*b* to one side of a pivotable plate 54, which is pivotally supported by the accommodating case 50 via a pin pivot 54*a* and at the other end integrally to the bottom of the accommodating case 50. The leg 51*a* of the drop rod 51 is swingably arranged on the other side of the pivotable plate 54 via a pin 54*c*, thereby pivoting the pivotable plate 54 around the pin pivot 54*a* according to the upper and lower motion of the drop rod leg 51*a*. When the drop rod 51 is unlocked, the coil spring 53 is positioned on one side away from the leg 51*a*, thereby urging the drop rod 51 in the unlocking direction (upward.) On the other hand, when the drop rod 51 is pushed down and locked, the coil spring 53 displaces from the one side away from the leg 51*a* to the other side adjacent thereto, passing over the pin pivot 54*a*, thereby urging the drop rod 51 in the locking direction (downward.) That is, the coil spring 53 is adapted to change the urging directions of the drop rod by passing over the pivot. Thus, in a locked state, the drop rod legs 51*a* can be firmly engaged with the engaging holes 52. Even when the middle post 48 is vibrated, by a strong wind for example, the legs 51*a* are firmly connected to the surface for placing the shutter without pulling the legs 51*a* out of the engaging holes 52. On the other hand, an unlocked state can be securely maintained. Further, the locking and unlocking operations can be performed rapidly, lightly and securely.

Figure 56A:
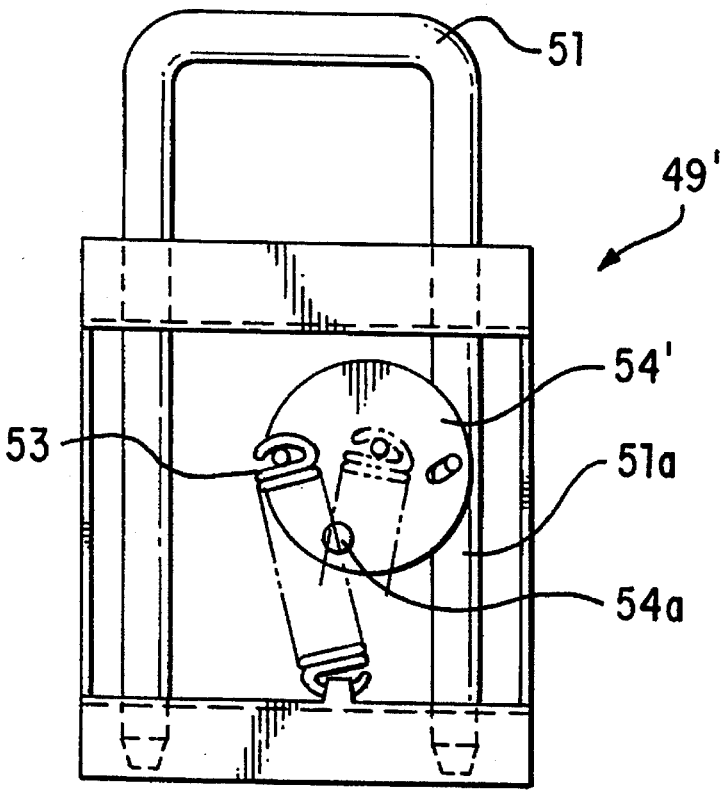
FIG. 56A is a front view of a locking device in another embodiment.
Figure 56B:
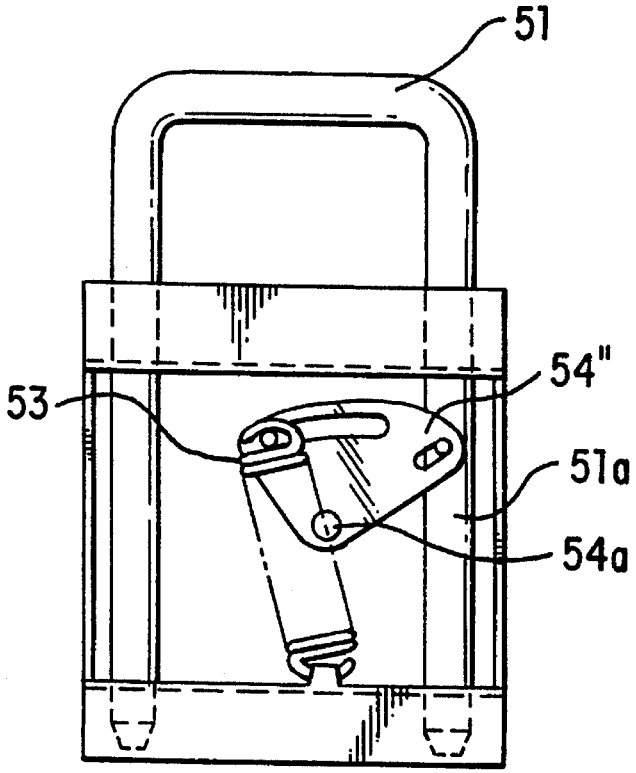
FIG. 56B is a front view of a locking device in another embodiment.

The locking device 49' may also be constructed as shown in FIGS. 56A and B. No matter how it is constructed, in a locked state, legs 51*a* of a drop rod 51 are urged in the locking direction by a coil spring 53, whereas in an unlocked state, they are urged in the unlocking direction by the coil spring 53.

In the preferred embodiments of the present invention described above, in the fully-open state of the shutter curtain 1, the bearing plate 7 is fully open and controlled by the second stopper 11*b* separate from the shutter guide 30. In this state, the winding diameter of the shutter curtain 1 is greater. Thus, the shutter curtain 1 is substantially perpendicular to the shutter guide 30. From the fully-open state, as the shutter curtain 1 is gradually pulled out, the winding diameter becomes smaller. Accordingly, the pulled-out portion of the shutter curtain 1 becomes greater. Thus, the rotation moment M due to the weight of the pulled-out portion of the shutter curtain 1 is exerted on the bearing plate 7, thereby swinging the links 8*a* and 8*b* toward the shutter guide 30 and further gradually shifting the bearing plate 7 toward the shutter guide 30. As a result, the shutter is simply constructed such that a pair of right and left bearing plates 7 are each swingably supported by the links 8*a* and 8*b*. With such a simple construction, a quick response can be made to the imbalance of the force exerted on the bearing plate 7 whereby the links 8*a* and 8*b* swing to move the bearing plate 7. More specifically, when the shutter curtain 1 is pulled out to make the winding diameter smaller, the winding shaft moves toward the shutter guide 30, while the shutter curtain 1 is wound up. The winding shaft 3 gradually moves away from the shutter guide 30, thus maintaining the position of the shutter curtain 1 facing the shutter guide 30 below. As a result, the noise and the damage due to a shock caused by the shutter curtain 1 abutting against the shutter guide 30 can be minimized.

Also, both the first and second links 8*a* and 8*b* for swinging the bearing plate 7 are adapted to be accommodated within the diameter of the winding wheel 22. Thus, unlike a conventional shutter in which first and second links project upward outer-circumferentially from a winding wheel, it is not necessary to ensure the space for arranging the links between the end of the winding wheel 22 and the side plate 2*a*. Instead, the space for the links 8*a* and 8*b* can be guaranteed within the diameter of the winding wheel 22. Hence, the space for accommodating the links 8*a* and 8*b* can be reduced as small as possible, further enabling the downsizing of the shutter case 2.

Moreover, the stoppers 11*a* and 11*b* are arranged on the protecting link 11, thus reliably preventing the swinging link mechanism from passing over the change point (the dead point) and from being in the unreturnable position. The protecting link 11 also serves the function of strengthening the side wall 2*a*, thereby increasing the strength of the shutter. It goes without saying that the stoppers may be arranged adjacent to the support.

As will be clearly understood from the foregoing description, the present invention offers the following advantages.

Since the rotation moment due to the weight of the pulled-out portion of the shutter curtain acts on the bearing, the winding shaft moves forward and backward on the basis of the winding diameter, which varies in accordance with the winding and rewinding of the shutter curtain. As a result, when the shutter curtain is pulled out, the position of the shutter curtain can be maintained to face the shutter guide below. Thus, the shutter curtain is prevented from abutting against the shutter guide and the noise and the damage due to shock is minimized.

The arrangement of the links for swinging the bearing plate is as follows. The first link is pivoted at one end to one end of the bearing plate, adjacent to the shutter guide, and at the base end swingably to the support side so as to project upward away from the shutter guide. The second link is pivoted at one end to the other end of the bearing plate, away from the shutter guide, and at the base end swingably to the support side so that the second link extends under the winding shaft toward the shutter guide such as to bypass the winding shaft. Thus, both the first and second links can be accommodated within the diameter of the winding wheel. Hence, unlike a conventional shutter in which first and second links project upward outer-circumferentially from a winding wheel, it is not necessary to ensure a space for arranging the links between the end of the winding wheel and the side plate. Instead, the space for the links can be guaranteed within the diameter of the winding wheel. As a result, the space for accommodating the links can be reduced as much as possible, thus further enabling the downsizing of the shutter case.

Moreover, the protecting link disposed between the base ends of both the links with the stoppers reliably prevents a swinging link mechanism from passing over the change point and from being in the unreturnable position. The protecting link also functions to strengthen the body side pivotally supporting both the links, thereby increasing the strength of the shutter.

While advantageous embodiments have been described herein, it will be apparent to those skilled in the art that many modifications and changes may be made within the spirit and scope of the invention defined in the appended claims.

What is claimed is:

1. An assembly for adjusting a position of a winding shaft in a shutter used for a building, comprising:

a bearing plate having a holder for supporting the winding shaft, a first pivot located to one side of said holder, and a second pivot located to another side of said holder;

a first link having first and second ends, said first end pivotally coupled to said first pivot and said second end swingably coupled to a support, said first link extending outward from said holder;

a second link having first and second ends, said first end pivotally coupled to said second pivot and said second end swingably coupled to a support, said second link extending past said holder, whereby said first and second link support said bearing plate for swinging movement; and a third link coupled to said first link and said second link and having a stopping mechanism thereon that controls the swinging movement of said bearing plate.

2. The assembly of claim 1, wherein said pivots are located on opposed sides of said bearing plate and on either side of said holder.

3. The assembly of claim 1, wherein said third link has first and second ends, said first end being pivotally coupled to said second end of said first link and said second end being pivotally coupled to said second end of said second link.

4. The assembly of claim 3, wherein said stopping mechanism comprises a pair of stoppers, one stopper being adjacent said first end and interfering with upward swinging of said bearing plate and the other stopper being adjacent said second end and interfering with downward swinging of said second link.

5. The assembly of claim 4, wherein said third link is generally arcuately shaped and has an outer arcuate surface, said stoppers protruding from said outer surface.

6. The assembly of claim 1, wherein said third link has first and second ends, said first end being pivotally coupled to said second end of said first link and said second end being pivotally coupled to said first end of said second link.

7. The assembly of claim 6, wherein said stopping mechanism comprises an elongated slot extending from said second end toward said first end of said third link, said second pivot of said bearing plate engaged with said slot and said slot defining a swinging range of said second pivot.

8. The assembly of claim 1, wherein said first link is generally arcuately shaped and extends above and outward of said bearing plate and said second link is generally L-shaped and extends below and underneath said bearing plate.

9. A winding assembly for a movable shutter, comprising:

a movable shutter curtain for closing an opening, said shutter curtain movable between a rolled and an unrolled position;

a case for storing said shutter curtain in said rolled position, wherein said case comprises a pair of side plates and at least one shutter guide that guides said shutter curtain from said rolled position to said unrolled position, and said at least one shutter guide comprises an insertion guide portion shaped to receive an end of a guide rail, and a pair of facing outwardly flaring guide portions extending from said insertion guide portion and shaped to receive said shutter curtain, said pair of guide portions defining a channel having a width less than a width of said insertion guide portion;

a winding mechanism supporting said shutter curtain;

an adjustable support assembly coupled to said case and supported by said side plates, said adjustable support assembly supporting said winding mechanism, wherein said adjustable support assembly automatically adjusts positions in said case to accommodate said shutter curtain in said rolled and said unrolled positions; and a control mechanism coupled to said winding mechanism that controls winding and unwinding of said shutter curtain.

10. The winding assembly of claim 9, wherein said shutter curtain comprises a plurality of interlocking slats.

11. The winding assembly of claim 10, wherein said slats include alternating main rigid slats interconnected to flexible subsidiary slats, whereby said shutter curtain can be rolled and have a continuous surface.

12. The winding assembly of claim 10, wherein said slats include a flexible plate-like slat and a plurality of rigid skeleton slats secured to said plate-like slat.

13. The winding assembly of claim 12, further comprising an incombustible foaming member disposed between said plate-like slat and said skeleton slats.

14. The winding assembly of claim 10, wherein said slats are constructed of a material selected from the group consisting of translucent material, metal plate, synthetic resin film, and woven material.

15. The winding assembly of claim 9, wherein said winding mechanism comprises a winding shaft coupled to said support assembly, a plurality of winding wheels rotatably supported by said winding shaft, and a winding drum coupled to said winding wheels, surrounding said winding shaft and secured to said shutter curtain.

16. The winding assembly of claim 15, wherein said winding drum is elliptically shaped having a small lateral diameter and a large longitudinal diameter.

17. The winding assembly of claim 16, wherein an end of said shutter curtain is secured to said winding drum where said small lateral diameter extends.

18. The winding assembly of claim 15, further comprising a protecting band secured to at least one winding wheel, said protecting band having at least one fastening formation securing said shutter curtain thereto, and a generally wedge-shaped protecting pad secured to said protecting band, wherein said protecting pad forms a ramp that said shutter curtain wraps around and protects said shutter curtain from being damaged in said rolled position by said fastening formation and underlying shutter curtain.

19. The winding assembly of claim 18, wherein said protecting band has snaps that engage said protecting pad, said snaps being removable when not in use.

20. The winding assembly of claim 18, wherein said protecting band has a groove shaped to accommodate said protecting pad.

21. The winding assembly of claim 15, wherein said winding drum has a plurality of radially spaced recesses of decreasing depth shaped to correspond to said shutter curtain.

22. The winding assembly of claim 15, wherein said adjustable support assembly extends within an exterior diameter of said winding drum.

23. The winding assembly of claim 9, wherein said adjustable support assembly comprises a bearing plate having a holder for supporting said winding mechanism, a first pivot located to one side of said holder, and a second pivot located to another side of said holder;

a first link having first and second ends, said first end pivotally coupled to said first pivot and said second end swingably coupled to a support, said first link extending outward from said holder; and a second link having first and second ends, said first end pivotally coupled to said second pivot and said second end swingably coupled to a support, said second link extending past said holder, whereby said first and second link support said bearing plate for swinging movement.

24. The winding assembly of claim 23, wherein said pivots are located on opposed sides of said bearing plate and on either side of said holder.

25. The winding assembly of claim 23, further comprising a third link coupled to said first link and said second link and having a stopping mechanism thereon that controls the swinging movement of said bearing plate.

26. The winding assembly of claim 25, wherein said third link has first and second ends, said first end being pivotally coupled to said second end of said first link and said second end being pivotally coupled to said second end of said second link.

27. The winding assembly of claim 26, wherein said stopping mechanism comprises a pair of stoppers, one stopper being adjacent said first end and interfering with upward swinging of said bearing plate and the other stopper being adjacent said second end and interfering with downward swinging of said second link.

28. The winding assembly of claim 27, wherein said third link is generally arcuately shaped and has an outer arcuate surface, said stoppers protruding from said outer surface.

29. The winding assembly of claim 25, wherein said third link has first and second ends, said first end being pivotally coupled to said second end of said first link and said second end being pivotally coupled to said first end of said second link.

30. The winding assembly of claim 29, wherein said stopping mechanism comprises an elongated slot extending from said second end toward said first end of said third link, said second pivot of said bearing plate engaged with said slot and said slot defining a swinging range of said second pivot.

31. The winding assembly of claim 23, wherein said first link is generally arcuately shaped and extends above and outward of said bearing plate and said second link is generally L-shaped and extends below and underneath said bearing plate.

32. The winding assembly of claim 9, wherein each of said side plates have temporary retainers that temporarily retain said case to a support.

33. The winding assembly of claim 9, wherein said case further comprises lintel frames secured to each said side plate, a plurality of angle frames secured to said lintel frames, and a plurality of case plates secured to said angle frames and lintel frames to form a hollow open-backed casing configured to surround said shutter curtain in said rolled position.

34. The winding assembly of claim 33, wherein said case plates are shaped to snap fit onto said angle frames and said lintel frames.

35. The winding assembly of claims 9, wherein said at least one shutter guide comprises a plurality of shutter guides spaced along said case.

36. The winding assembly of claim 9, wherein said pair of outwardly flaring guide portions include retaining portions extending into said insertion guide portion and retaining projections.

37. The winding assembly of claim 9, wherein said pair of guide portions are made of a resin material.

38. The winding assembly of claim 10, wherein said control mechanism comprises a buffer spring for absorbing impact of said shutter curtain when said shutter curtain is in said unrolled position and a balance spring for balancing force needed for operating said shutter curtain, both said springs being secured to said winding mechanism.

39. The winding assembly of claim 38, wherein said winding mechanism comprises a winding shaft and a pair of rotatable winding wheels carried by said winding shaft, said buffer spring surrounding said winding shaft and having two ends, one end being secured to one of said winding wheels and the other end being secured to said winding shaft, and further comprising a retaining claw engaging said buffer spring and travelling through said spring upon rotation of said winding wheel to said other end of said buffer spring.

40. The winding assembly of claim 39, wherein said buffer spring comprises a split-type spring having first and second parts, and a weight of inertia disposed between said first and second parts, said first part being secured to said one winding wheel and said second part being secured to said winding shaft.

41. The winding assembly of claim 40, wherein said first part includes a large coil wound in a direction and a small coil wound in an opposite direction.

42. The winding assembly of claim 40, wherein said retaining claw is disposed on said weight of inertia and movably retains said first part of said spring.

43. The winding assembly of claim 40, wherein said retaining claw is disposed on said winding wheel and movably retains said first part of said spring.

44. The winding wheel of claim 38, wherein said winding mechanism comprises a winding shaft, a pair of rotatable winding wheels carried by said winding shaft, and a winding drum secured to said winding wheels for carrying said shutter curtain, wherein said balance spring surrounds said winding shaft and has two ends, one end being secured to one of said winding wheels and the other end being secured to said winding shaft.

45. The winding assembly of claim 44, wherein said balance spring has hooks on each said end and said hooks engage said winding wheel and said winding shaft respectively.

46. The winding assembly of claim 44, wherein said balance spring is a split-type spring with first and second portions and a retainer secured therebetween and rotatably retained on said winding shaft.

47. The winding assembly of claim 46, wherein said retainer has at least one fastening formation thereon and said first and second portions have hooks that engage said at least one fastening formation.

48. The winding assembly of claim 46, wherein said retainer is threaded and said winding wheel and said winding shaft have threaded connectors thereon, said first and second portions of said balance spring being threadedly secured to said retainer, said winding wheel and said winding shaft respectively.

49. The winding assembly of claim 46, wherein said retainer comprises an operating pin extending therefrom, said operating pin abutting said winding drum during rotation of said winding wheels.

50. The winding assembly of claim 49, wherein said winding drum has a groove therein and a stopper pin disposed in said groove, said operating pin engaging said stopper pin when said shutter curtain is partially unrolled, thus controlling movement of said balance spring from said winding wheel.

51. The winding assembly of claim 49, wherein said winding shaft has a stopper pin extending radially therefrom located at said retainer, and said retainer has an operating pin extending therefrom that engages with said stopper pin upon rotation of said balance spring and said winding shaft.

52. The winding assembly of claim 9, further comprising a lock removably secured to said shutter curtain for locking said shutter curtain in said unrolled position.

53. The winding assembly of claim 52, wherein said lock comprises a locking case secured to said shutter curtain and a drop rod movably secured to said locking case for engaging a surface, said locking case including a spring secured thereto and a pivot plate secured thereto, said pivot plate having three triangularly disposed pivot points, a first pivot point secured to said drop rod, a second pivot point secured to said spring, and a third pivot point disposed between said first and second pivot points secured to said locking case.

54. A device for moving a winding shaft in a shutter for a building, the winding shaft supporting a shutter curtain that rolls and unrolls through a shutter guide, comprising:

a bearing plate for supporting the winding shaft and having a first end and a second end, said first end being arranged adjacent the shutter guide and said second end being arranged away from the shutter guide; and a link assembly coupled to said bearing plate for swinging said bearing plate forward and backward and comprising a first link with a first end and a second end, said first end pivotally coupled to said first end of said bearing plate and said second end swingably coupled to a support, said first link arranged to project in a direction upward and away from the shutter guide; and a second link with a first end and a second end, said first end pivotally coupled to said second end of said bearing plate and said second end swingably coupled to a support, said second link arranged to project in a direction under the winding shaft toward the shutter guide.

55. The device of claim 54, further comprising a protecting link coupled between said second end of said first link and said second end of said second link, and a stopper located on said protecting link that controls a swing range of said bearing plate.

56. A shutter support assembly for a shutter that selectively closes and opens an opening in a building, comprising:

a winding shaft assembly for supporting a shutter curtain in a wound and an unwound position;

a shutter guide for guiding the shutter curtain from said winding device to and from the wound and unwound positions, said shutter guide disposed adjacent and to one side of said winding device;

a bearing plate disposed on each end of said winding shaft assembly to swingably support said winding shaft assembly; and a link mechanism coupled to each bearing plate that automatically swingably adjusts said winding shaft based on the wound and unwound position of the shutter curtain, each said link mechanism comprising a first link with a first end and a second end, said first end pivotally coupled to said bearing plate adjacent said shutter guide and said second end swingably coupled to a support, said first link arranged to project upward and away from said shutter guide; and a second link with a first end and a second end, said first end pivotally coupled to said bearing plate on a side opposed to said shutter guide and said second end swingably coupled to a support, said second link arranged to project in a direction under said winding shaft assembly and toward said shutter guide.

57. The shutter support assembly of claim 56, further comprising a protecting link coupled between said second end of said first link and said second end of said second link, and a stopper located on said protecting link that controls a swing range of said bearing plate.

* * * * *